US010309620B2

(12) United States Patent
Shum et al.

(10) Patent No.: US 10,309,620 B2
(45) Date of Patent: Jun. 4, 2019

(54) ACCESSORIES FOR LED LAMP SYSTEMS

(71) Applicant: SORAA, INC., Fremont, CA (US)

(72) Inventors: Frank Tin Chung Shum, Sunnyvale, CA (US); Artem Mishin, Pacifica, CA (US); Zinovy Dolgonosov, San Francisco, CA (US); Clifford Jue, Santa Cruz, CA (US); Abdul Assaad, Fremont, CA (US); Aurelien J. F. David, San Francisco, CA (US); Wilfred Martis, San Francisco, CA (US)

(73) Assignee: SORAA, INC., Fremont, CA (US)

( * ) Notice: Subject to any disclaimer, the term of this patent is extended or adjusted under 35 U.S.C. 154(b) by 137 days.

(21) Appl. No.: 15/344,206

(22) Filed: Nov. 4, 2016

(65) Prior Publication Data

US 2017/0122530 A1 May 4, 2017

Related U.S. Application Data

(63) Continuation of application No. 14/166,692, filed on Jan. 28, 2014, now Pat. No. 9,488,324, which is a (Continued)

(51) Int. Cl.
*F21V 17/10* (2006.01)
*F21V 29/83* (2015.01)

(Continued)

(52) U.S. Cl.
CPC ..... *F21V 17/105* (2013.01); *F21K 9/23* (2016.08); *F21K 9/232* (2016.08); *F21K 9/233* (2016.08);

(Continued)

(58) Field of Classification Search
CPC ..... F21K 9/238; F21K 9/237; F21V 23/003; F21V 23/06; H05B 37/0272

(Continued)

(56) References Cited

U.S. PATENT DOCUMENTS 8,382,315 B2 * 2/2013 Lee ..... F21V 23/02 362/217.08
8,382,321 B2 * 2/2013 Lee ..... H05B 33/0803 362/249.02

(Continued)

*Primary Examiner* — Laura K Tso
(74) *Attorney, Agent, or Firm* — Fisherbroyles LLP

(57) ABSTRACT

Accessories for LED lamp systems and methods of attaching accessories to illumination sources (e.g., LED lamps) are disclosed. A beam shaping accessories mechanically affixed to the LED lamp. The lens is designed to adapt to a first fixture that is mechanically attached to the lens. Accessories are designed to have a second fixture for mating to the first fixture such that the first fixture and the second fixture are configured to produce a retaining force between the first accessory and the lens. The retaining force is a mechanical force that is accomplished by mechanical mating of mechanical fixtures, or the retaining force is a magnetic force and is accomplished by magnetic fixtures configured to have attracting magnetic forces. In some embodiments, the accessory is treated to modulate an emanated light pattern (e.g., a rectangular, or square, or oval, or circular or diffused emanated light pattern). A USB connector is also provided.

19 Claims, 65 Drawing Sheets

Related U.S. Application Data continuation-in-part of application No. 14/014,112, filed on Aug. 29, 2013, now Pat. No. 9,109,760, which is a continuation-in-part of application No. 13/915,432, filed on Jun. 11, 2013, now abandoned, said application No. 14/166,692 is a continuation-in-part of application No. 13/480,767, filed on May 25, 2012, now abandoned, and a continuation-in-part of application No. 13/886,547, filed on May 3, 2013, now abandoned.

(60) Provisional application No. 61/659,386, filed on Jun. 13, 2012, provisional application No. 61/530,832, filed on Sep. 2, 2011, provisional application No. 61/642,984, filed on May 4, 2012, provisional application No. 61/783,888, filed on Mar. 14, 2013, provisional application No. 61/776,173, filed on Mar. 11, 2013, provisional application No. 61/757,597, filed on Jan. 28, 2013.

(51) Int. Cl.

| | |
|---|---|
| ***F21K 9/23*** | (2016.01) |
| ***F21K 9/233*** | (2016.01) |
| ***F21K 9/60*** | (2016.01) |
| ***F21V 29/77*** | (2015.01) |
| ***F21K 9/238*** | (2016.01) |
| ***F21K 9/232*** | (2016.01) |
| ***F21K 9/235*** | (2016.01) |
| ***F21K 9/237*** | (2016.01) |
| ***F21V 5/04*** | (2006.01) |
| ***F21V 7/00*** | (2006.01) |
| ***F21V 23/00*** | (2015.01) |
| ***F21V 23/06*** | (2006.01) |
| ***H05B 37/02*** | (2006.01) |
| *F21Y 115/10* | (2016.01) |
| *F21V 9/08* | (2018.01) |
| *F21V 9/14* | (2006.01) |

(52) U.S. Cl.

CPC ..... *F21K 9/235* (2016.08); *F21K 9/237* (2016.08); *F21K 9/238* (2016.08); *F21K 9/60* (2016.08); *F21V 5/04* (2013.01); *F21V 7/00* (2013.01); *F21V 7/0091* (2013.01); *F21V 23/003* (2013.01); *F21V 23/06* (2013.01); *F21V 29/773* (2015.01); *F21V 29/83* (2015.01); *H05B 37/0272* (2013.01); *F21V 9/08* (2013.01); *F21V 9/14* (2013.01); *F21Y 2115/10* (2016.08)

(58) Field of Classification Search

USPC ..... 362/233

See application file for complete search history.

(56) References Cited

U.S. PATENT DOCUMENTS

| | | | | |
|---|---|---|---|---|
| 2013/0016500 | A1* | 1/2013 | Tress | F21V 33/0012 362/133 |
| 2013/0241419 | A1* | 9/2013 | Ghafoori | H05B 37/0272 315/154 |
| 2014/0218888 | A1* | 8/2014 | Chen | F21V 23/003 362/8 |

* cited by examiner

13A00

13B00

2000

2200

2700

3200

3900

4000

4200

LED spectrum and increased gamut in various regions (T=3000K).

4700

LED spectrum and increased gamut in the yellow region (T=2700K).

5000

LED spectrum and increased gamut in various regions (T=3000K), with a shifted white point.

52E00

52G00

ACCESSORIES FOR LED LAMP SYSTEMS

The present application is a continuation of U.S. application Ser. No. 14/166,692, filed on Jan. 28, 2014, which is continuation-in-part of U.S. application Ser. No. 14/014,112, filed on Aug. 29, 2013, which is a continuation-in-part of U.S. application Ser. No. 13/915,432, filed on Jun. 11, 2013, which claims the benefit under 35 U.S.C. § 119(e) of U.S. Provisional Application No. 61/659,386, filed on Jun. 13, 2012, and this application is a continuation-in-part of U.S. application Ser. No. 13/480,767 filed on May 25, 2012, which claims the benefit under 35 U.S.C. § 119(e) of U.S. Provisional Application No. 61/530,832, filed on Sep. 2, 2011; and this application is a continuation-in-part of U.S. application Ser. No. 13/886,547, filed on May 3, 2013, which claims the benefit under 35 U.S.C. § 119(e) of U.S. Provisional Application No. 61/642,984 filed on May 4, 2012 and U.S. Provisional Application No. 61/783,888 filed on Mar. 14, 2013; and the present application claims the benefit under 35 U.S.C. § 119(e) of U.S. Provisional Application No. 61/776,173, filed on Mar. 11, 2013, and U.S. Provisional Application No. 61/757,597, filed on Jan. 28, 2013; each of which is incorporated by reference in its entirety.

FIELD

The disclosure relates to the field of LED illumination and more particularly to techniques for improved accessories for LED lamp systems.

BACKGROUND

Accessories for standard halogen lamps such as MR16 lamps include, for example, lenses, diffusers, color filters, polarizers, linear dispersion, accessories, collimators, projection frames, louvers and baffles. Such accessories are commercially available from companies such as Abrisa, Rosco, and Lee Filters. These accessories can be used to control the quality of light from the lamps including elimination of glare, to change the color temperature of the lamp, or to tailor a beam profile for a particular application.

Generally, accessories for certain lamps (e.g., halogen lamps) are required to withstand high temperatures. Often, such halogen lamp accessories require disassembly of the lamp from the luminaire to incorporate the accessory. This set of disadvantages results in the accessories having high costs and being cumbersome and/or expensive and/or complicated to install.

Moreover, with the advances in LED illumination, LED lamps offer much longer lifetimes, much more efficient lighting and other attributes that improve function and reduce overall cost of ownership. This situation provides a baseline for introducing features into LED lamps in order to still further improve the utility of LED lamps. For example, LED lamps can be fitted with a wide variety of active accessories. Miniaturized electronics have become very small, and relatively inexpensive (e.g., a CCD camera), thus setting up an opportunity to deploy miniaturized electronics adapted as active accessories to be used in conjunction with LED lamps.

There is a need for improved approaches for attaching field-installable accessories to lamps and/or lamp systems.

SUMMARY

This disclosure relates to an apparatus allowing for simple and low cost implementation of accessories for LED lamp systems that can be used to retrofit existing luminaires.

In a first aspect, apparatus are disclosed comprising an LED lamp, a lens mechanically affixed to the LED lamp; a first fixture mechanically attached to the lens; a first accessory having a second fixture, wherein the first accessory is mated in proximity to the lens using the first fixture and the second fixture; and wherein the first fixture and the second fixture are configured to produce a retaining force between the first accessory and the lens.

In a second aspect, methods of providing and assembling LED lamp accessories are disclosed.

In a third aspect, methods of providing baffles to be used in assembling LED lamp systems are provided.

In a fourth aspect, techniques to adapt miniaturized electronics to be used as active accessories for LED lamps are presented.

BRIEF DESCRIPTION OF THE DRAWINGS

Those skilled in the art will understand that the drawings, described herein, are for illustration purposes only. The drawings are not intended to limit the scope of the present disclosure.

DETAILED DESCRIPTION

Figure 1A:
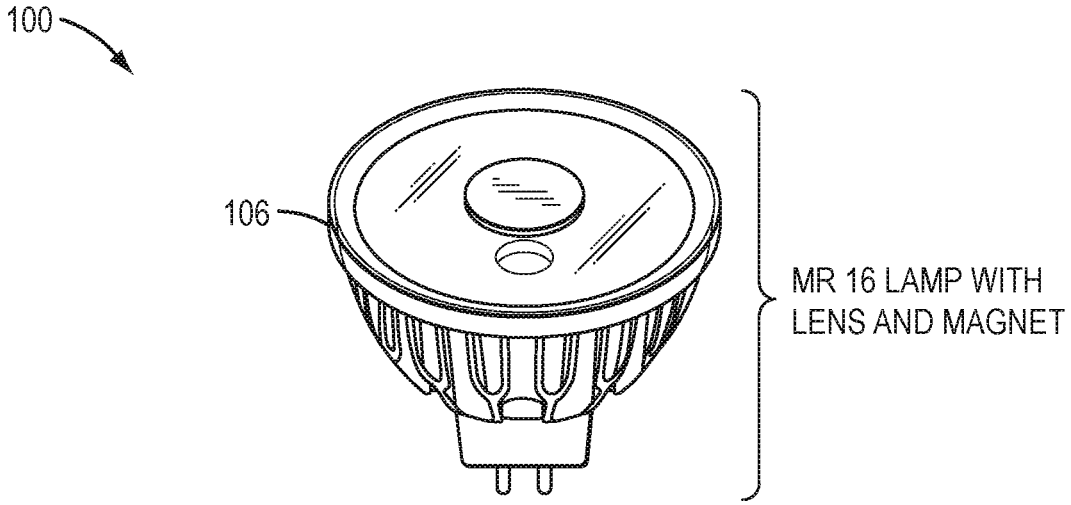
FIG. 1A depicts an assembly of an LED having improved accessories for LED lamp systems, according to certain embodiments.

The term "accessory" or "accessories" includes any mechanical, optical or electro-mechanical component or electrical component to be mated to an LED lamp. In certain embodiments, an accessory comprises an optically transmissive film, sheet, collimator, frame, plate, or combination of any of the foregoing. In certain embodiments, an accessory includes a mechanical fixture to retain the accessory in its mated position. In certain embodiments, an accessory is magnetically retained in place.

The acronym "FWHM" refers to a measurement known in the art as "full-width half-maximum".

The term "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The term "or" is intended to mean an inclusive "or" rather than an exclusive "or".

That is, unless specified otherwise, or is clear from the context, "X employs A or B" is intended to mean any of the natural inclusive permutations. That is, if X employs A, X employs B, or X employs both A and B, then "X employs A or B" is satisfied under any of the foregoing instances. In addition, the articles "a" and "an" as used in this application and the appended claims should generally be construed to mean "one or more" unless specified otherwise or is clear from the context to be directed to a singular form.

Reference is now made in detail to certain embodiments. The disclosed embodiments are not intended to be limiting of the claims.

The compositions of wavelength-converting materials referred to in the present disclosure comprise various wavelength-converting materials.

Wavelength conversion materials can be ceramic or semiconductor particle phosphors, ceramic or semiconductor plate phosphors, organic or inorganic downconverters, upconverters (anti-stokes), nano-particles, and other materials which provide wavelength conversion. Some examples are listed below:

(Srn,Ca1-n)10(PO4)6*B2O3:Eu2+ (wherein 0≤n≤1)
(Ba,Sr,Ca)5(PO4)3(Cl,F,Br,OH):Eu2+, Mn2+
(Ba,Sr,Ca)BPO5:Eu2+, Mn2+
Sr2Si3O8*2SrCl2:Eu2+
(Ca,Sr,Ba)3MgSi2O8:Eu2+, Mn2+
BaAl8O13:Eu2+
2SrO*0.84P2O5*0.16B2O3:Eu2+
(Ba,Sr,Ca)MgAl10O17:Eu2+, Mn2+
K2SiF6:Mn4+
(Ba,Sr,Ca)Al2O4:Eu2+
(Y,Gd,Lu,Sc,La)BO3:Ce3+, Tb3+
(Ba,Sr,Ca)2(Mg,Zn)Si2O7:Eu2+
(Mg,Ca,Sr, Ba,Zn)2Si1-xO4-2x:Eu2+ (wherein 0≤x≤0.2)
(Ca, Sr, Ba)MgSi2O6:Eu2+
(Sr,Ca,Ba)(Al,Ga)2S4:Eu2+
(Ca,Sr)8(Mg,Zn)(SiO4)4Cl2:Eu2+, Mn2+
Na2Gd2B2O7:Ce3+, Tb3+
(Sr,Ca,Ba,Mg,Zn)2P2O7:Eu2+, Mn2+
(Gd,Y,Lu,La)2O3:Eu3+, Bi3+
(Gd,Y,Lu,La)2O2S:Eu3+, Bi3+
(Gd,Y,Lu,La)VO4:Eu3+, Bi3+
(Ca,Sr)S:Eu2+, Ce3+
(Y,Gd,Tb,La,Sm,Pr,Lu)3(Sc,Al,Ga)5-nO12-3/2n:Ce3+ (wherein 0≤n≤0.5)
ZnS:Cu+, Cl−
(Y,Lu,Th)3Al5O12:Ce3+
ZnS:Cu+, Al3+
ZnS:Ag+, Al3+
ZnS:Ag+, Cl−

The group:

Ca1-xA1x−xySi1-x+xyN2-x−xyCxy:A
Ca1-x−zNazM(III)x−xy−zSi1-x+xy+zN2-x−xyCxy:A
M(II)1-x−zM(I)zM(III)x−xy−zSi1-x+xy+zN2-x−xyCxy:A
M(II)1-x−zM(I)zM(III)x−xy−zSi1-x+xy+zN2-x−xy−2w/3CxyOw-v/2Hv:A
M(II)1-x−zM(I)zM(III)x−xy−zSi1-x+xy+zN2-x−xy−2w/3-v/3CxyOwHv:A wherein 0<x<1, 0<y<1, 0≤z<1, 0≤v<1, 0<w<1, x+z<1, x>xy+z, and 0<x−xy−z<1, M(II) is at least one divalent cation, M(I) is at least one monovalent cation, M(III) is at least one trivalent cation, H is at least one monovalent anion, and A is a luminescence activator doped in the crystal structure.

LaAl(Si 6-z Al z)(N 10-z Oz):Ce3+ (wherein z=1)
(Ca, Sr) Ga2S4:Eu2+
AlN:Eu2+
SrY2S4:Eu2+
CaLa2S4:Ce3+
(Ba,Sr,Ca)MgP2O7:Eu2+, Mn2+
(Y,Lu)2WO6:Eu3+, Mo6+
CaWO4
(Y,Gd,La)2O2S:Eu3+
(Y,Gd,La)2O3:Eu3+
(Ba,Sr,Ca)nSinNn:Eu2+ (where 2n+4=3n)
Ca3(SiO4)Cl2:Eu2+
(Y,Lu,Gd)2-nCanSi4N6+nC1-n:Ce3+, (wherein 0≤n≤0.5)
(Lu,Ca,Li,Mg,Y) alpha-SiAlON doped with Eu2+ and/or Ce3+
(Ca,Sr,Ba)SiO2N2:Eu2+, Ce3+
Ba3MgSi2O8:Eu2+, Mn2+
(Sr,Ca)AlSiN3:Eu2+
CaAlSi(ON)3:Eu2+
Ba3MgSi2O8:Eu2+
LaSi 3N5:Ce3+
Sr10(PO4)6Cl2:Eu2+
(BaSi)O12N2:Eu2+
M(II)aSibOcNdCe:A wherein (6<a<8, 8<b<14, 13<c<17, 5<d<9, 0<e<2) and M(II) is a divalent cation of (Be,Mg, Ca,Sr,Ba,Cu,Co,Ni,Pd,Tm,Cd) and A of (Ce,Pr,Nd,Sm,Eu, Gd,Tb,Dy,Ho,Er,Tm,Yb,Lu,Mn,Bi,Sb)
SrSi2(O,Cl)2N2:Eu2+
SrSi9Al19 ON31:Eu2+
(Ba,Sr)Si2(O,Cl)2N2:Eu2+
LiM2O8:Eu3+ where M=(W or Mo)

For purposes of the application, it is understood that when a phosphor has two or more dopant ions (i.e., those ions following the colon in the above phosphors), this is to mean that the phosphor has at least one (but not necessarily all) of those dopant ions within the material. That is, as understood by those skilled in the art, this type of notation means that the phosphor can include any or all of those specified ions as dopants in the formulation.

Further, it is to be understood that nanoparticles, quantum dots, semiconductor particles, and other types of materials can be used as wavelength converting materials. The list above is representative and should not be taken to include all the materials that may be used within embodiments described herein.

Reference is now made in detail to certain embodiments. The disclosed embodiments are not intended to be limiting of the claims.

In certain embodiments, an LED lamp comprises a lens having a center and a diameter, a first magnet attached to the center of the lens, a first accessory disposed on the lens, and a second magnet attached to the center of the first accessory wherein the first magnet and the second magnet are configured to retain the first accessory against the lens. In a further embodiment, the magnets are configured such that the magnetic force between the first magnet and the second magnet enable the self-centering of the accessory on to the lamp.

FIG. 1A depicts an assembly 100 of an LED lamp of an embodiment having improved accessories for LED lamp systems. As shown in FIG. 1A the MR16 lamp with lens 106 comprises an LED lamp with an installed accessory.

Figure 1B:
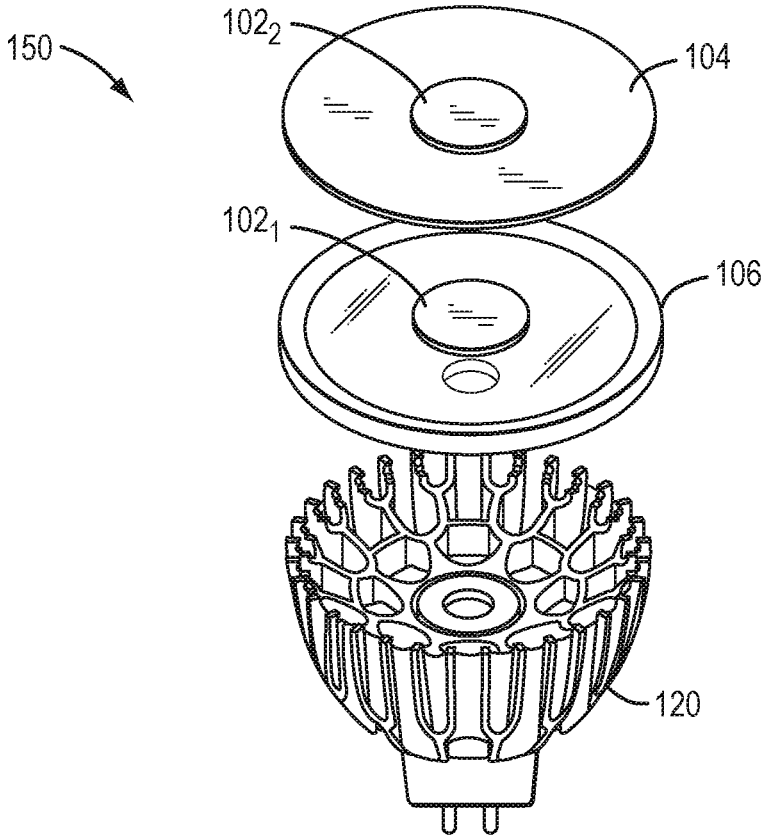
FIG. 1B shows an exploded view of an LED lamp with an accessory in a system having improved accessories for LED lamp systems, according to certain embodiments.

FIG. 1B shows an exploded view of an LED lamp 150 with an accessory in a system having improved accessories for LED lamp systems.

FIG. 1B shows an example of an LED lamp 150 having an MR16 form factor including a heat sink 120. A lens 106 is attached to the heat sink 102 or other part of the lamp. In certain embodiments, the lens 106 comprises a folded total internal reflection lens. A first magnet (e.g., magnet $\mathbf{102}_1$) is attached to the center of the lens 106. An accessory 104 (e.g., a plastic accessory) having a second magnet (e.g., magnet $\mathbf{102}_2$) attached to the center can be disposed over the lens 106 and the opposing magnets (e.g., magnet $\mathbf{102}_1$, magnet $\mathbf{102}_2$) can hold the accessory 104 to the lens 106.

The first and second opposing magnets can be configured to retain the accessory against the lens. For example, the opposing magnets may have an opposite polarity. The accessory 104 may have substantially the same diameter as the lens, and in certain embodiments cover an optical region of the lens such as, for example, greater than 90% of the optical aperture of the LED lamp. For example, in certain embodiments the diameter of the accessory is from about 99% to 101% of the diameter of the lens, from about 95% to 105% the diameter of the lens, and in certain embodiments from about 90% to about 110% the diameter of the lens. In certain embodiments, the accessory comprises a transparent film such as, for example, a plastic film. In other embodiment, the accessory may be a plate made of light transmissive material including plastic or glass. In certain embodiments, the accessory is selected from a diffuser, a color filter, a polarizer, a linear dispersion element, a projector, a louver, a baffle, and/or any combination of any of the foregoing. In certain embodiments, the first magnet and the first accessory have a combined thickness of less than about 5 mm, less than about 3 mm, less than about 1 mm, less than about 0.5 mm, and in certain embodiments, less than about 0.25 mm.

In some embodiments, a metallic member (e.g., using iron, nickel, cobalt, certain steels and/or other alloys, and/or other rigid or semi-rigid materials) may replace one of the magnets, and may serve to accept a mechanically mated accessory. Any one or more known-in-the-art techniques can be applied to the design of the lens 106 (and/or lens subassembly) so as to accommodate a mechanically mated accessory. For example, the aforementioned mechanical mating techniques may comprise a mechanical fixture such as a ring clip member, a bayonet member, a screw-in ring member, a leaf spring member, a hinge, or a combination of any of the foregoing. Any of the mating techniques disclosed herein can further serve to center the accessory upon installation and/or during use.

Figure 2:
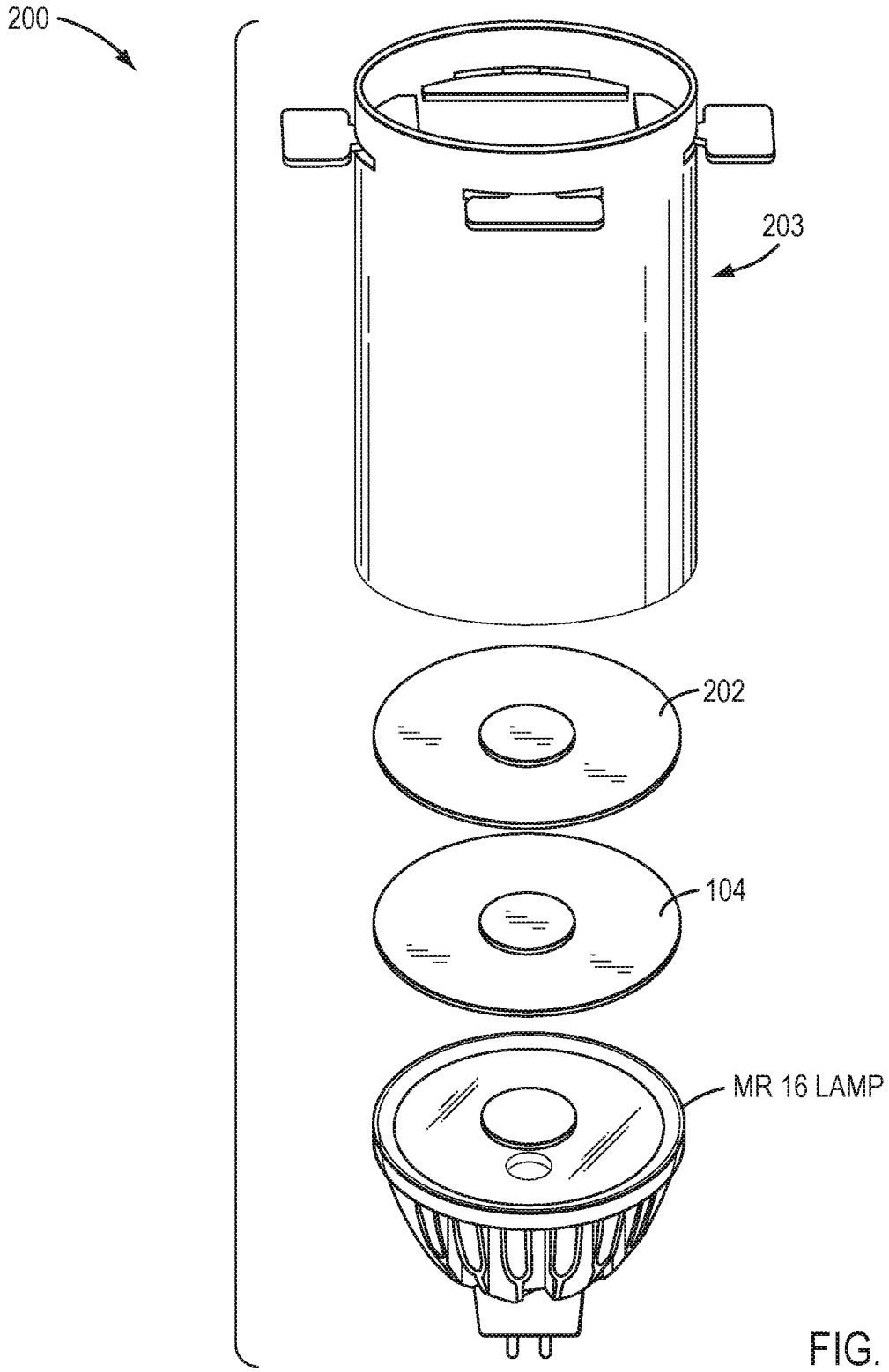
FIG. 2 shows an exploded view of an LED lamp with multiple accessories in a system having improved accessories for LED lamp systems, according to certain embodiments.

FIG. 2 shows an exploded view 200 of an LED lamp with multiple accessories in a system having improved accessories for LED lamp systems.

In certain embodiments as shown in FIG. 2, an LED lamp comprises a second accessory 202 disposed adjacent to a first accessory 104. In certain embodiments, a second magnet is attached to the center of the second accessory and is used to affix the second accessory to the lamp.

In certain embodiments, a third accessory 203 can be attached. For example, a third accessory can be a projection frame (as shown), a collimator (see FIG. 8A), or other accessory or combination of accessories.

A collimator is a tube with walls that attenuates light, or are opaque (e.g., do not transmit light). The purpose of the collimator is to block or "cut off" or reduce the projection of high angle light coming from the lamp. The collimator can be formed of a tube with openings such as, for example, one opening at each end of the tube. At the end near the lamp, light enters the tube and the low angle light exits the tube at the other end of the collimator opening whereas high angle light is absorbed by and/or is extracted by the collimator walls. The length of the collimator can be determined, at least in part, by the amount of high angle light emitted by the lamp.

A projection frame is similar to a collimator with the addition of a set of light frame features such as, for example, shatters, baffles, and/or louvers, positioned at the output end of the collimator. The light frame features are positioned a distance away from the lens, and as such, features formed by the shape of the frame can be projected on the wall. The frame for example may comprise a set of baffles that block, direct, and/or reflect at least part of the light to form any arbitrary set of patterns, for example, rectangular, square, oval, and/or triangular patters of the projected light from the lamp. In certain embodiments, the frame may have a silhouette image that is designed to be projected onto a surface such as a wall.

The term "LED lamp" can any include any type of LED illumination source including lamp types that emit directed light where the light distribution is generally directed within a single hemisphere. Such lamp types include, for example, lamps having form factors such as MR, PAR, BR, ER, or AR. Table 1 below lists a subset of specific designations of the aforementioned form factors.

TABLE 1

| Designation | Base Diameter (crest of thread) |
|---|---|
| MR11 | 35 mm |
| MR13-1/4 | 42 mm |
| MR16 | 51 mm |
| PAR16 | 50 mm |
| PAR20 | 65 mm |
| PAR30 | 95 mm |
| PAR36 | 115 mm |
| PAR38 | 120 mm |
| PAR46 | 145 mm |
| PAR56 | 175 mm |
| PAR64 | 200 mm |

Also, some embodiments of an LED lamp are in the form of directional lamps of various designations, as given in Table 2.

TABLE 2

| Designation | Name/Characteristic |
|---|---|
| R | Reflector: "Reflector" type designated an R . . . with multiple bulb diameters |
| RBL | Reflector bulged, lens end |
| RD | Reflector dimpled |
| RB | Reflector bulged |
| RE | Reflector Elliptical |

Still further, there are many configurations for the base of LED lamp systems beyond the depicted GU5.3 MR16 lamp (e.g., see FIG. 3A) that may be used with embodiments provided by the present disclosure. For example Table 3 gives standards (see "Designation") and corresponding characteristics of the base of the lamp.

TABLE 3

| Designation | Base Diameter (crest of thread) | Name/Characteristic | IEC 60061-1 Standard Sheet |
|---|---|---|---|
| E05 | 5 mm | Lilliput Edison Screw (LES) | 7004-25 |
| E10 | 10 mm | Miniature Edison Screw (MES) | 7004-22 |
| E11 | 11 mm | Mini-Candelabra Edison Screw (mini-can) | (7004-6-1) |
| E12 | 12 mm | Candelabra Edison Screw (CES) | 7004-28 |
| E14 | 14 mm | Small Edison Screw (SES) | 7004-23 |
| E17 | 17 mm | Intermediate Edison Screw (IES) | 7004-26 |
| E26 | 26 mm | [Medium] (one-inch) Edison Screw (ES or MES) | 7004-21A-2 |
| E27 | 27 mm | [Medium] Edison Screw (ES) | 7004-21 |
| E29 | 29 mm | [Admedium] Edison Screw (ES) | |
| E39 | 39 mm | Single-contact (Mogul) Giant Edison Screw (GES) | 7004-24-A1 |
| E40 | 40 mm | (Mogul) Giant Edison Screw (GES) | 7004-24 |

Additionally, there are many G-type lamps such as G4, GU4, GY4, GZ4, G5, G5.3, G5.3-4.8, GU5.3, GX5.3, GY5.3, G6.35, GX6.35, GY6.35, GZ6.35, G8, GY8.6, G9, G9.5, GU10, G12, G13, G23, GU24, G38, GX53.

In certain lamps such as an ER lamp, the lens is referred to as a shield. Thus, in certain embodiments, a lens includes shields which do not substantially serve to divert light.

Accessories and methods of attached accessories disclosed herein may be used with any suitable LED lamp configuration such as, for example, any of those disclosed in Table 1, and/or those configurations disclosed in Table 2, and/or those configurations disclosed in Table 3, and/or those configurations disclosed as G-type lamps above.

FIG. 1A and FIG. 2 describe accessories attached at the central axis of the lamp/lens. The accessories can also be attached, mechanically or magnetically at other locations. For example, the attachment point may be made near the perimeter of the lens or at the perimeter of the lamp form factor envelope. Various embodiments wherein the accessories are mechanically or magnetically attached at other locations are disclosed herein.

Figure 3A:
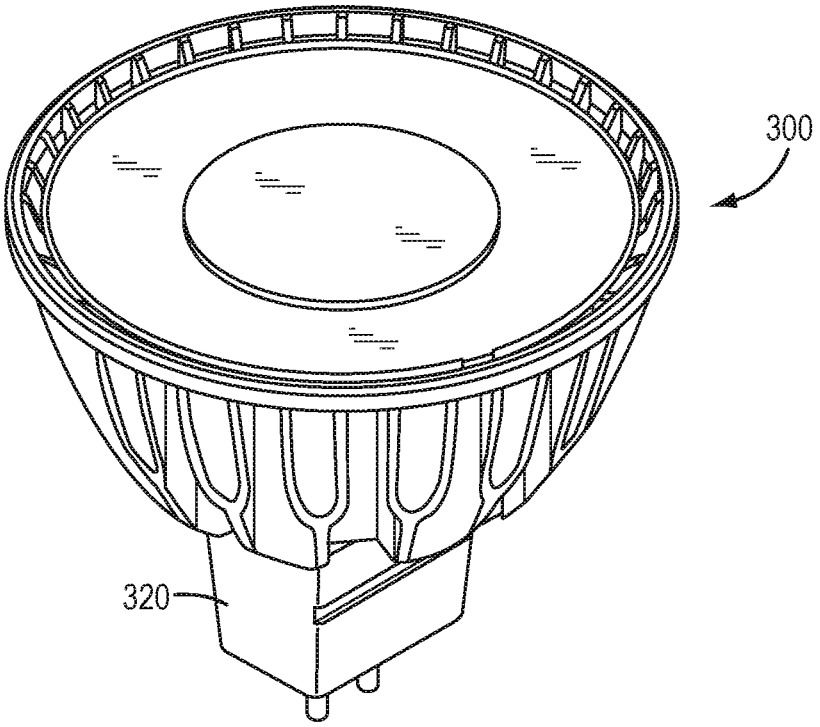
FIG. 3A and FIG. 3B illustrate various embodiments of MR16 form factor-compatible LED lighting sources, according to certain embodiments.
Figure 3B:
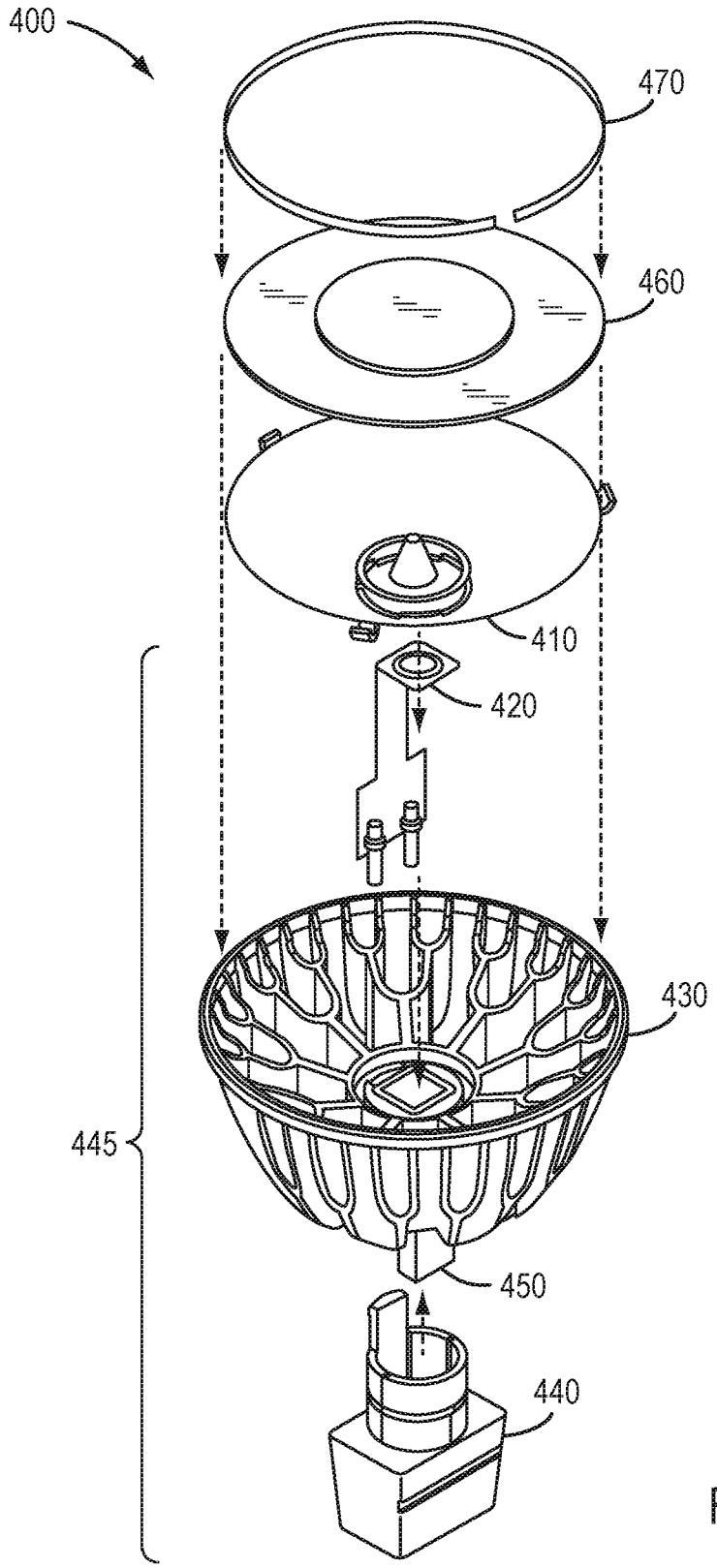

FIG. 3A illustrates an embodiment of the present disclosure. More specifically, FIG. 3A and FIG. 3B illustrate embodiments of MR16 form factor-compatible LED lighting sources 300 having a GU 5.3 form factor-compatible base 320. GU 5.3 MR16 lighting sources typically operate at 12 volts, alternating current (e.g., VAC). In the examples illustrated, LED lighting source 300 is configured to provide a spot beam angle less than 15 degrees. In other embodiments, LED lighting sources may be configured to provide a flood light having a beam angle greater than 15 degrees. In certain embodiments, an LED assembly may be used within LED lighting source 300. Advanced LED assemblies are currently under development by the assignee of the present patent application. In various embodiments, LED lighting source 300 may provide a peak output of greater than about 1,000 candelas (or greater than 100 lumens). For certain high output applications, the center beam candle power may be greater than 10,000 candela or 100,000 candela with associated light levels greater than 1000 lumens or 5000 lumens. Various embodiments of the present disclosure achieve the same or higher brightness than conventional halogen bulb MR16 lights.

FIG. 3B illustrates a modular diagram according to various embodiments of the present disclosure. As can be seen in FIG. 3B, in various embodiments, an LED lighting source 400 includes a lens 410, a light source in the form of an LED module/assembly 420, a heat sink 430, a base module 440, a mechanically-retained accessory 460, and a retainer 470. As will be discussed further below, in various embodiments, the modular approach to assembling a lighting source 400 can reduce the manufacturing complexity, reduce manufacturing costs, and increase the reliability of such lighting sources.

In various embodiments, lens 410 and mechanically-retained accessory 460 may be formed from transparent material such as glass, polycarbonate, acrylic, COC material, or other material. In certain embodiments, the lens 410 may be configured in a folded path configuration to generate a narrow output beam angle. Such a folded optic lens enables embodiments of the lighting source 400 to have a tighter columniation of output light than is normally available from a conventional reflector of equivalent depth. The mechanically-retained accessory 460 may perform any of the function or functions as previously described for accessories.

In FIG. 3B, lens 410 may be secured to a heat sink 430 by means of one or more clips integrally formed on the edge of the reflecting lens 410. In addition, the reflecting lens 410 may also be secured using an adhesive compound disposed proximate to where the integrated LED assembly 420 is secured to the heat sink 430. In various embodiments, separate clips may be used to restrain reflecting lens 410. These clips may be formed, for example, of heat resistant plastic material that may be white colored to reflect backward scattered light back through the lens.

In other embodiments, lens 410 may be secured to a heat sink 430 using the clips described above. Alternatively, lens 410 may be secured to one or more indents of the heat sink 430, as will be illustrated below in greater detail. In some embodiments, once lens 410 is secured to the heat sink 430; the attachments are not intended to be removed by hand. In some cases, one or more tools are to be used to separate these components without damage.

The embodiments of FIG. 3A and FIG. 3B are merely illustrative embodiments. The particulars of the basic LED lamp components 445 can vary from one LED lamp to another, and the configuration or selection of any one or more particular members of the basic LED lamp components 445 may result in an assembly having certain characteristic such as efficiency, brightness, color, thermal properties, and/or others.

In certain embodiments, as will be discussed below, integrated LED assemblies and modules may include multiple LEDs such as, for example, 36 LEDs arranged in a series, in parallel series (e.g., three parallel strings of 12 LEDs in series), or other configurations. In certain embodiments, any number of LEDs may be used such as, for example, 1, 10, 16, or more. In certain embodiments, the LEDs may be electrically coupled serially or in any other appropriate configuration.

In certain embodiments, the targeted power consumption for LED assemblies is less than 13 W. This is much less than the typical power consumption of halogen-based MR16 lights (50 W). Accordingly, embodiments of the present disclosure are capable of matching the brightness or intensity of halogen-based MR16 lights, but using less than 20% of the energy. In certain embodiments, the LED assemblies may be configured for higher power operation such as greater than 13 W and incorporated into higher-output lamp form factors such as PAR30, PAR38, and other lamp form factors. In certain applications, an LED assembly can be incorporated into a luminaire and the lens assembly can accommodate accessorizing according to the embodiments provided by the present disclosure, which is not limited to retrofit lamps.

In various embodiments of the present disclosure, the LED assembly 420 is directly secured to the heat sink 430 to dissipate heat from the light output portion and/or the electrical driving circuits. In some embodiments, the heat sink 430 may include a protrusion portion 450 to be coupled to electrical driving circuits. As will be discussed below, LED assembly 420 typically includes a flat substrate such as silicon or the like. In various embodiments, it is contemplated that an operating temperature of the LED assembly 420 may be on the order of 125° C. to 140° C. The silicon substrate is then secured to the heat sink using a high thermal conductivity epoxy (e.g., thermal conductivity ~96 W/mk). In some embodiments, a thermoplastic/thermoset epoxy may be used such as TS-369, TS-3332-LD, or the like, available from Tanaka Kikinzoku Kogyo K.K. Other epoxies may also be used. In some embodiments, no screws are used to secure the LED assembly to the heat sink, however, screws or other fastening means may be used in other embodiments.

In some embodiments, heat sink 430 may be formed from a material having a low thermal resistance/high thermal conductivity. In some embodiments, heat sink 430 may be formed from an anodized 6061-T6 aluminum alloy having a thermal conductivity k=167 W/mk, and a thermal emissivity e=0.7. In other embodiments, other materials may be used such as 6063-T6 or 1050 aluminum alloy having a thermal conductivity k=225 W/mk and a thermal emissivity e=0.9. In other embodiments, still other alloys such AL 1100, or the like may be used. In still other embodiments, a die cast alloy with thermal conductivity as low as 96 W/mk is used. Additional coatings may also be added to increase thermal emissivity, for example, paint provided by ZYP Coatings, Inc., which incorporate $CR_2O_3$ or $CeO_2$ may provide a thermal emissivity e=0.9; coatings provided by Materials Technologies Corporation under the trade name Duracon™ may provide a thermal emissivity e>0.98 and the like. In other embodiments, heat sink 430 may include other metals such as copper, or the like.

In some examples, at an ambient temperature of 50° C., and in free natural convection, the heat sink 430 has been measured to have a thermal resistance of approximately 8.5° C./W, and the heat sink 430 has been measured to have a thermal resistance of approximately 7.5° C./W. With further development and testing, it is believed that a thermal resistance of as little as 6.6° C./W may be achieved. In view of the present disclosure, one of ordinary skill in the art will be able to envision other materials having different thermal properties.

In certain embodiments, a base module 440 in FIG. 3B provides a standard GU 5.3 physical and electronic interface to a light socket. As will be described in greater detail below, a cavity within base module 440 includes high temperature resistant electronic circuitry used to drive an LED assembly 420. In some embodiments, an input voltage of 12 VAC to the lamps are converted to 120 VAC, 40 VAC, or other voltage by the LED driving circuitry. The driving voltage may be set depending upon the specific LED configurations (e.g., series, parallel/series, etc.) desired. In various embodiments, protrusion portion 450 extends within the cavity of base module 440.

The shell of base module 440 may be formed from an aluminum alloy or a zinc alloy and/or may be formed from an alloy similar to that used for heat sink. In one example, an alloy such as AL 1100 may be used. In other embodiments, high temperature plastic material may be used. In some embodiments, instead of being separate units, base module 440 may be monolithically formed with heat sink 430.

As illustrated in FIG. 3B, a portion of the LED assembly 420 (silicon substrate of the LED device) contacts the heat sink 430 in a recess within the heat sink. Additionally, another portion of the LED assembly 420 (containing the LED driving circuitry) is bent downwards and is inserted into an internal cavity of base module 440.

In some embodiments, to facilitate a transfer of heat from the LED driving circuitry to the shell of the base assemblies and to facilitate transfer of heat from the silicon substrate of the LED device, a potting compound may be provided. The potting compound may be applied in a single step to the internal cavity of base module 440 and/or to the recess within heat sink 430. In certain embodiments, a compliant potting compound such as Omegabond® 200 available from Omega Engineering, Inc. or 50-1225 from Epoxies, Etc. may be used. In other embodiments, other types of heat transfer materials may be used.

Figure 4A:
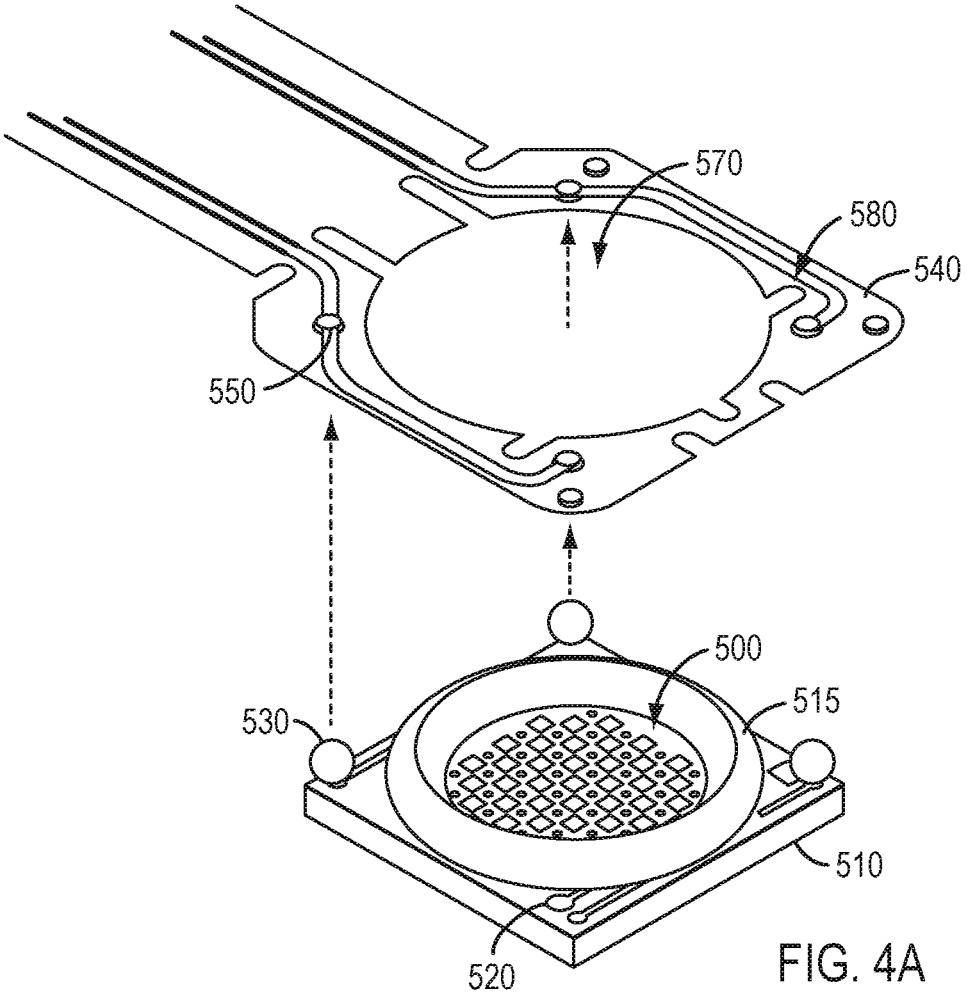
FIG. 4A and FIG. 4B illustrate flow diagrams of manufacturing processes, according to certain embodiments of the present disclosure.
Figure 4B:
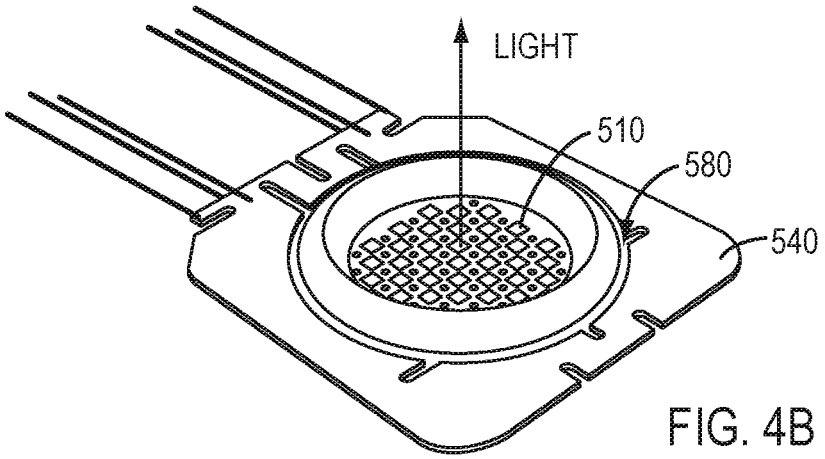

FIG. 4A and FIG. 4B illustrate an embodiment of the present disclosure. More specifically, FIG. 4A illustrates an LED package subassembly (LED module) according to certain embodiments. More specifically, a plurality of LEDs 500 is illustrated as being disposed upon a substrate 510. In some embodiments, the plurality of LEDs 500 may be connected in series and powered by a voltage source of approximately 120 VAC. To enable a sufficient voltage drop (e.g., 3 to 4V) across each LEDs 500, in various embodiments 30 to 40 LEDs may be used. In certain embodiments, 27 to 39 LEDs may be coupled in series. In other embodiments, LEDs 500 are connected in parallel series and powered by a voltage source of approximately 40 VAC. For example, the plurality of LEDs 500 include 36 LEDs that may be arranged in three groups each having 12 LEDs 500 coupled in series. Each group is thus coupled in parallel to the voltage source (40 VAC) provided by the LED driver circuitry such that a sufficient voltage drop (e.g., 3 to 4V) is achieved across each LED 500. In other embodiments, other driving voltages may be used, and other arrangements of LEDs 500 may also be employed.

In certain embodiments, the LEDs 500 are mounted upon a silicon substrate 510, or other thermally conductive substrate. In certain embodiments, a thin electrically insulating layer and/or a reflective layer may separate LEDs 500 and the silicon substrate 510. Heat produced from LEDs 500 may be transferred to the silicon substrate 510 and/or to a heat sink by means of a thermally conductive epoxy, as discussed herein.

In certain embodiments, the silicon substrate is approximately 5.7 mm×5.7 mm in size, and approximately 0.6 mm in depth, or the silicon substrate is approximately 8.5 mm×8 mm in size, and approximately 0.6 mm in depth. The dimensions may vary according to specific lighting requirements. For example, for lower brightness intensity, fewer LEDs may be mounted upon the substrate and accordingly the substrate may decrease in size. In other embodiments, other substrate materials may be used and other shapes and sizes may also be used.

As shown in FIG. 4A, a ring of silicone (e.g., silicon dam 515) is disposed around LEDs 500 to define a well-type structure. In certain embodiments, a phosphorus bearing material is disposed within the well structure. In operation, LEDs 500 provide a blue-emitting, a violet-emitting, or a UV-emitting light output. In turn, the phosphorous bearing material is excited by the output light, and emits white light output.

As illustrated in FIG. 4A, a number of bond pads 520 may be provided on substrate 510 (e.g., 2 to 4 bond pads). Then, a conventional solder layer (e.g., 96.5% tin and 5.5% gold) may be disposed upon silicon substrate 510, such that one or more solder balls 530 are formed thereon. In the embodiments illustrated in FIG. 4A, four bond pads 520 are provided, one at each corner, two for each power supply connection. In other embodiments, only two bond pads may be used, one for each AC power supply connection.

FIG. 4A shows a flexible printed circuit (FPC) 540. In certain embodiments, FPC 540 may include a flexible substrate material such as a polyimide, such as Kapton™ from DuPont, or the like. As illustrated, FPC 540 may have a series of bonding pads 550 for bonding to silicon substrate 510, and bonding pads 550 for coupling to the high supply voltage (e.g., 120 VAC, 40 VAC, etc.). Additionally, in some embodiments, an opening 570 is provided through which LEDs 500 will shine through.

Various shapes and sizes for FPC 540 may be used in the embodiments of the present disclosure. For example, as illustrated in FIG. 4A, a series of cuts 580 may be made upon FPC 540 to reduce the effects of expansion and contraction of FPC 540 with respect to substrate 510. As another example, a different number of bonding pads 550 may be provided such as two bonding pads. As another example, FPC 540 may be crescent shaped, and opening 570 may not be a through hole. In other embodiments, other shapes and sizes for FPC 540 may be used consistent with present patent disclosure.

In combining FIG. 4A the elements illustrated in FIG. 4A provide the assembly illustrated in FIG. 4B, substrate 510 is bonded to FPC 540 via solder balls 530, in a conventional flip-chip type arrangement to the top surface of the silicon. By making the electrical connection at the top surface of the silicon, the FPC is electrically isolated from the heat transfer surface of the silicon. This allows the entire bottom surface of the silicon substrate 510 to transfer heat to the heat sink. Additionally, this allows the LED to be bonded directly to the heat sink to maximize heat transfer instead of a printed circuit board material that typically inhibits heat transfer. As can be seen in this configuration, LEDs 500 are thus positioned to emit light through opening 570. In various embodiments, the potting compound discussed above may also be used as an under fill to seal the space (e.g., see cuts 580) between substrate 510 and FPC 540. After the electronic driving devices and the silicon substrate 510 are bonded to FPC 540, the LED package submodule or assembly 420 is thus constructed.

As an alternative, the LEDs 500 may be positioned to emit light into the cavity of the lamp, and the LEDs are powered by means of discrete conductors. In various embodiments, the LEDs may be tested for proper operation, and such testing can be done after the LED lamp is in a fully-assembled or in a partially-assembled state.

Figure 5A:
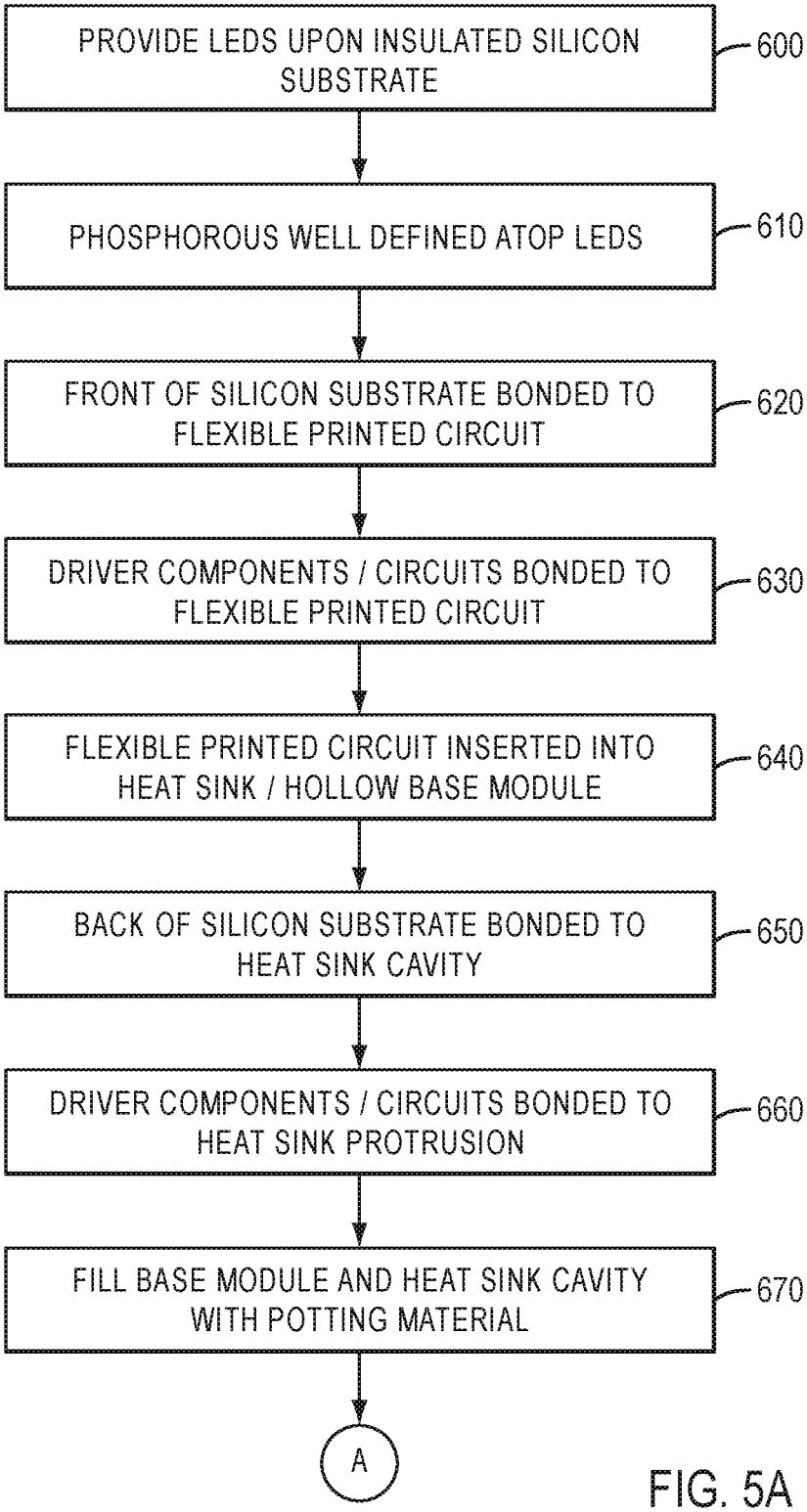
FIG. 5A and FIG. 5B illustrate flow diagrams of a manufacturing process, according to embodiments of the present disclosure.
Figure 5B:
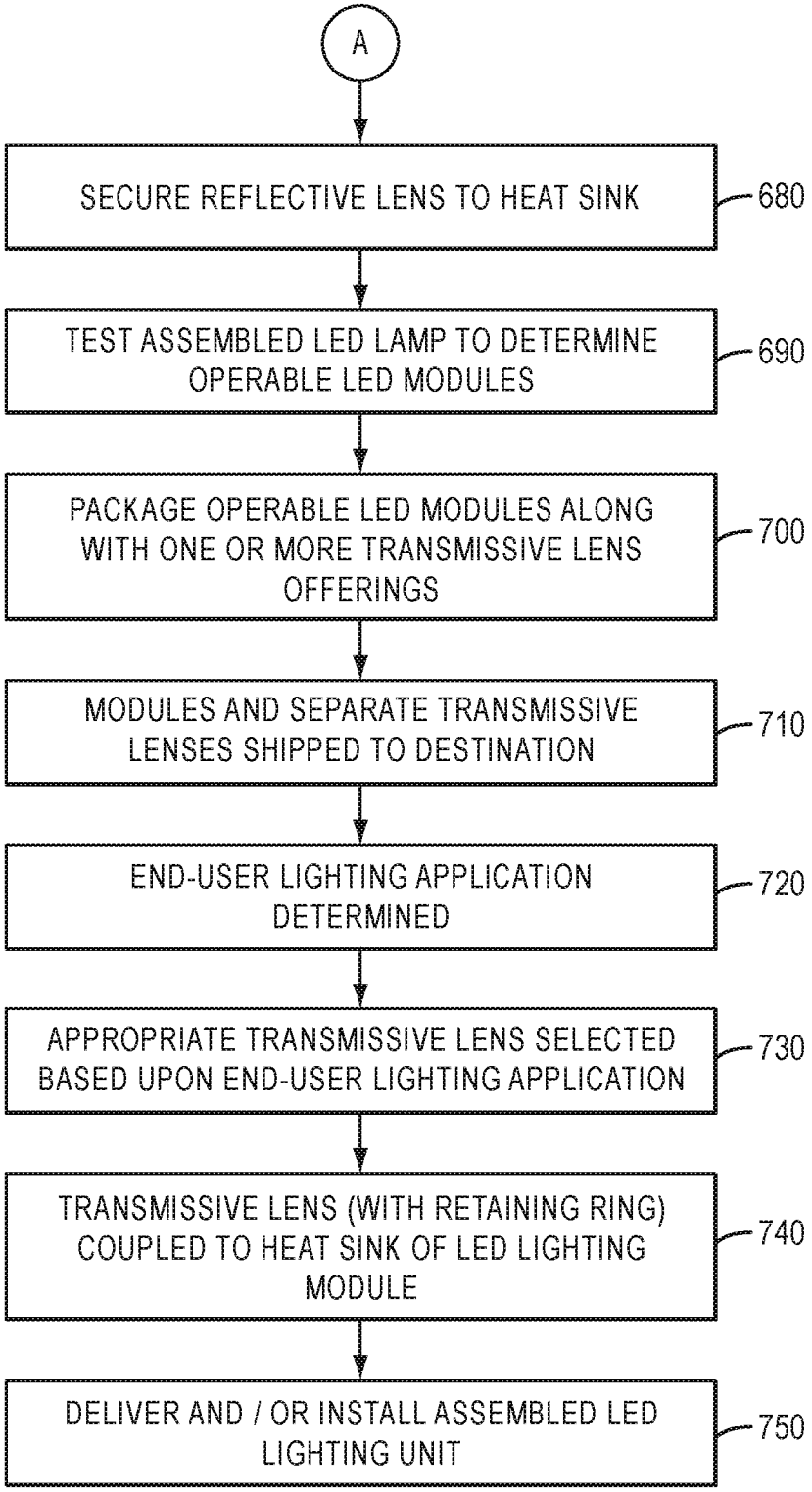

FIG. 5A and FIG. 5B illustrate flow diagrams of manufacturing processes according to embodiments of the present disclosure. In certain embodiments, some of the manufacturing processes may occur in parallel or in series. For understanding, reference may be given to features in prior figures.

In certain embodiments, the following process may be performed to form an LED assembly/module. Initially, a plurality of LEDs 500 are provided upon an electrically insulated silicon substrate 510 and wired, step 600. As illustrated in FIG. 4A, a silicone dam 515 is placed upon the silicon substrate 510 to define a well, which is then filled with a phosphor-bearing material, step 610. Next, the silicon substrate 510 is bonded to a flexible printed circuit 540, step 620. As disclosed above, a solder ball and flip-chip soldering may be used for the soldering process in various embodiments.

Next, a plurality of electronic driving circuit devices and contacts may be soldered to the flexible printed circuit 540, step 630. The contacts are for receiving a driving voltage of approximately 12 VAC. As discussed above, unlike present state of the art MR16 light bulbs, the electronic circuit devices, in various embodiments, are capable of sustained high-temperature operation, (e.g., 120° C.).

In various embodiments, the second portion of the flexible printed circuit including the electronic driving circuit is inserted into the heat sink and into the inner cavity of the base module, step 640. As illustrated, the first portion of the flexible printed circuit is then bent approximately 90 degrees such that the silicon substrate is adjacent to the recess of the heat sink. The back side of the silicon substrate is then bonded to the heat sink within the recess of the heat sink using an epoxy, or the like, step 650.

In various embodiments, one or more of the heat producing the electronic driving components/circuits may be bonded to the protrusion portion of the heat sink, step 660. In some embodiments, electronic driving components/circuits may have heat dissipating contacts (e.g., metal contacts). These metal contacts may be attached to the protrusion portion of the heat sink via screws (e.g., metal, nylon, or the like). In some embodiments, a thermal epoxy may be used to secure one or more electronic driving components to the heat sink. Subsequently a potting material is used to fill the air space within the base module and to serve as an under fill compound for the silicon substrate, step 670.

Subsequently, a reflective lens may be secured to the heat sink, step 680, and the LED light source may then be tested for proper operation, step 690.

In certain embodiments, the base subassembly/modules that operate properly may be packaged along with one or more optically transmissive member offerings and/or a retaining ring (described above), step 700, and shipped to one or more distributors, resellers, retailers, or customers, step 710. In certain embodiments, the modules and separate optically transmissive member offerings may be stocked, stored, or the like. The optically transmissive member offerings may be in the form of lenses.

Subsequently, in various embodiments, an end user desires a particular lighting solution, step 720. In certain examples, the lighting solution may require different beam angles, different cut-off angles or roll-offs, different coloring, different field angles, and the like. In various embodiments, the beam angles, the field angles, and the full cutoff angles may vary from the above, based upon engineering and/or marketing requirements. Additionally, the maximum intensities may also vary based upon engineering and/or marketing requirements.

Based upon the end-user's application, secondary optically transmissive members may be selected, step 730. In various embodiments, the selected lens may or may not be part of a kit for the lighting module. In other words, in some examples, various optically transmissive members are provided with each lighting module, while in other examples, lighting modules are provided separately from the optically transmissive members.

In various embodiments, an assembly process may include attaching the retaining ring to one or more optically transmissive member and snapping the retaining ring into a groove of the heat sink, step 740. In other embodiments, a retaining ring is already installed for each optically transmissive member that is provided.

In some embodiments, once the retaining ring is snapped into the heat sink, clips, or the like, the retaining ring (and secondary optic lens) cannot be removed by hand. In such cases, a tool such as a thin screwdriver, pick, or the like must be used to remove a secondary optic lens (optically transmissive members) from the assembled unit. In other embodiments, the restraint mechanism may be removed by hand.

In FIG. 5B, the assembled lighting unit may be delivered to the end-user and installed, step 750.

Figure 6A:
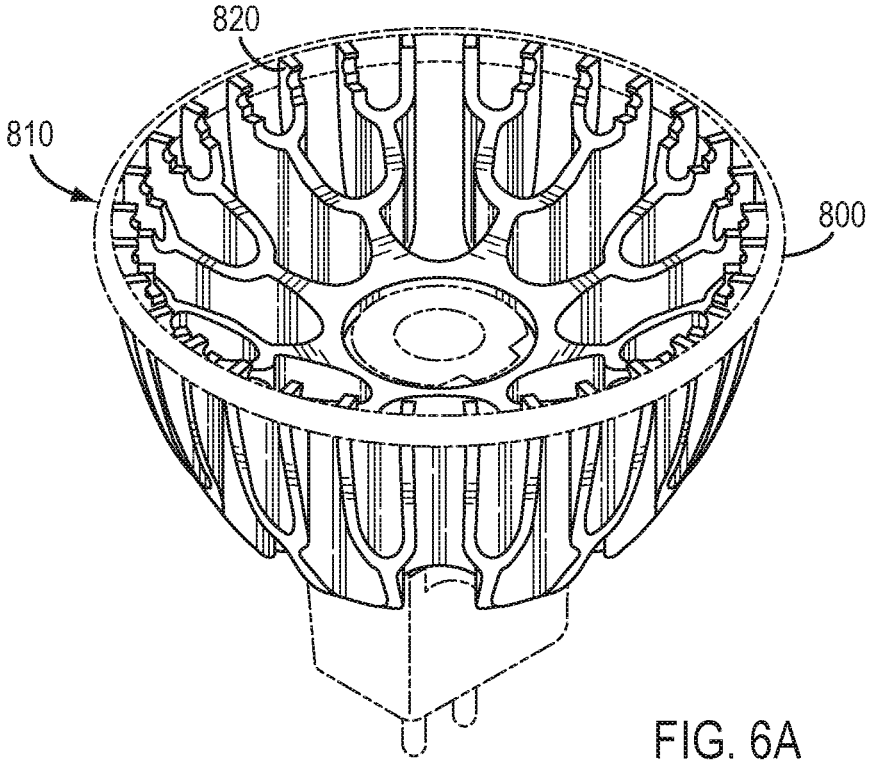
FIG. 6A and FIG. 6B illustrate various embodiments of a heat sink, according to certain embodiments of the present disclosure.
Figure 6B:
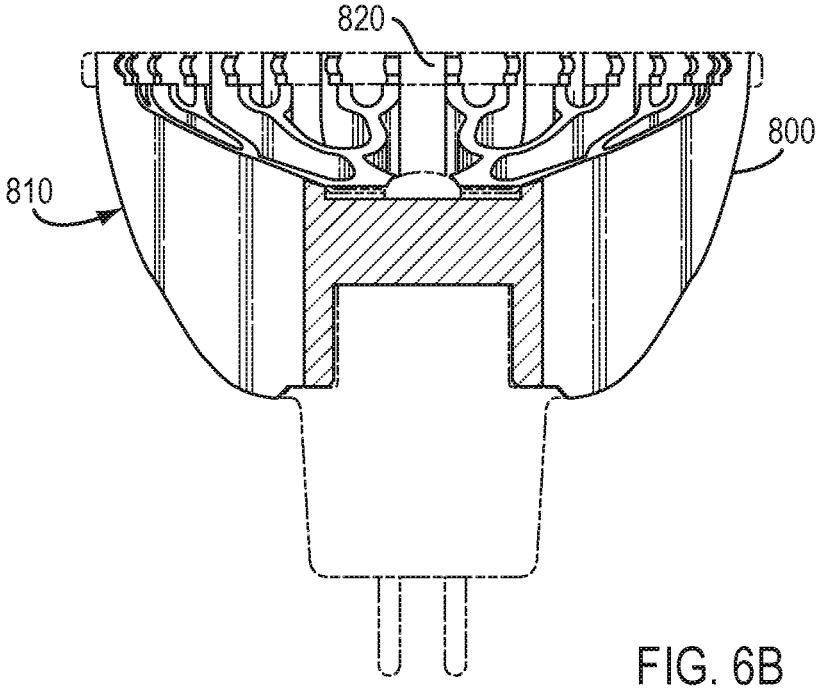

FIG. 6A and FIG. 6B illustrate embodiments of a heat sink according to certain embodiments of the present disclosure. More specifically, FIG. 6A illustrates a perspective view of a heat sink, and FIG. 6B illustrates a cross-section view of the heat sink.

In FIG. 6A and FIG. 6B, a heat sink 800 is illustrated including a number of heat dissipating fins 810. Additionally, fins 810 may include a mechanism for mating onto the retaining ring/optically transmissive members. As illustrated in the example in FIG. 6A and FIG. 6B, the mating mechanism includes indentations 820 on fins 810. In some embodiments, each of fins 810 may include an indentation 820, whereas in other embodiments, less than all of fins 810 may include an indentation. In other embodiments, the mating mechanism may include the use of an additional clip, a clip on the reflective optics, or the like.

Figure 7:
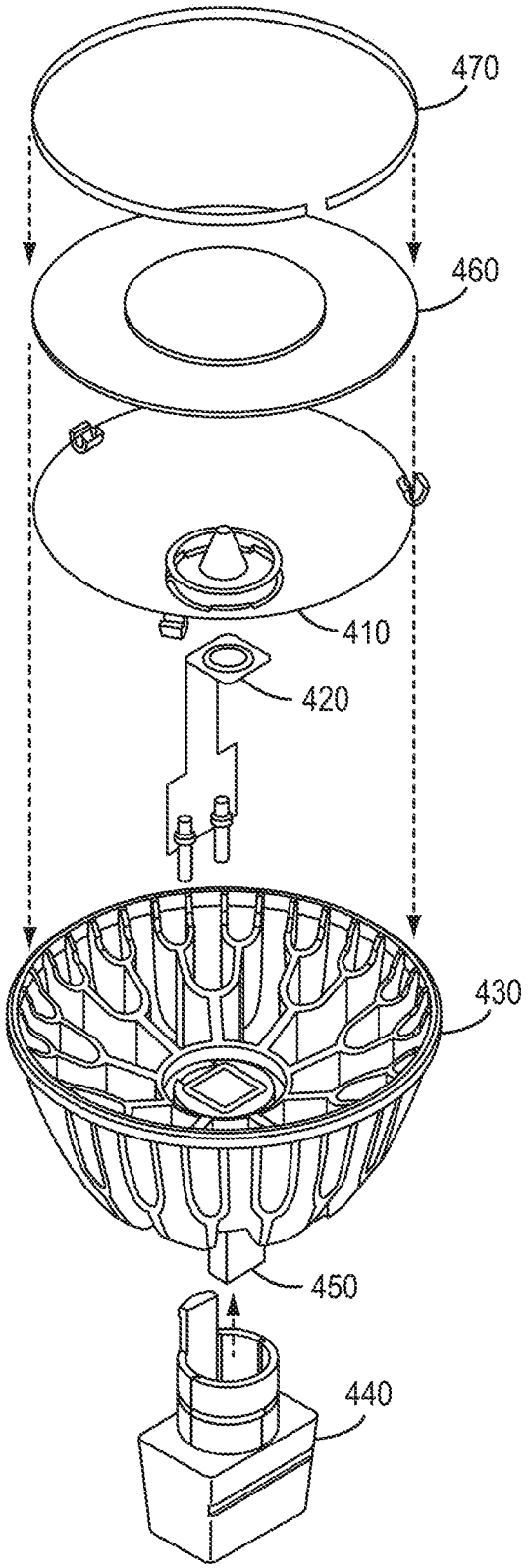
FIG. 7 depicts an exploded view of an LED lamp with multiple accessories, according to certain embodiments of the present disclosure.

FIG. 7 depicts an exploded view of an LED lamp with multiple accessories according to certain embodiments of the present disclosure.

In certain embodiments, the optically transmissive members may be coupled to an intermediate grille, or the like, that is coupled to the heat sink and/or reflective lens. Accordingly, embodiments of the present disclosure are applicable for use in wide-beam light sources or in narrow-beam light sources.

Figure 8A:
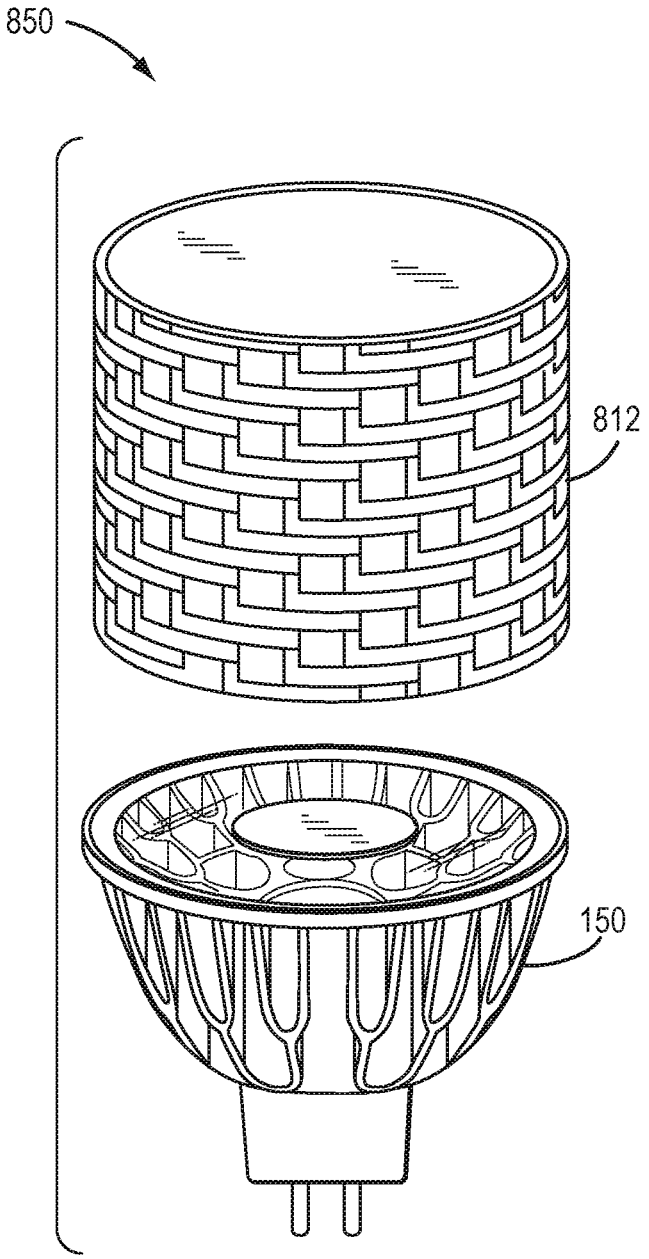
FIG. 8A depicts an arrangement of a collimator design for LED lamp systems, according to certain embodiments of the present disclosure.

FIG. 8A depicts an arrangements of a collimator 812 accessory for LED lamp systems. The arrangement 850 shows an LED lamp 150 comprising a lens having a center and a diameter to which is attached a first magnet so as to accommodate a collimator accessory where the collimator accessory is disposed on the lens and held in place by a second magnet $\mathbf{102}_2$ attached to the center of the collimator accessory (see FIG. 8B).

Figure 8B:
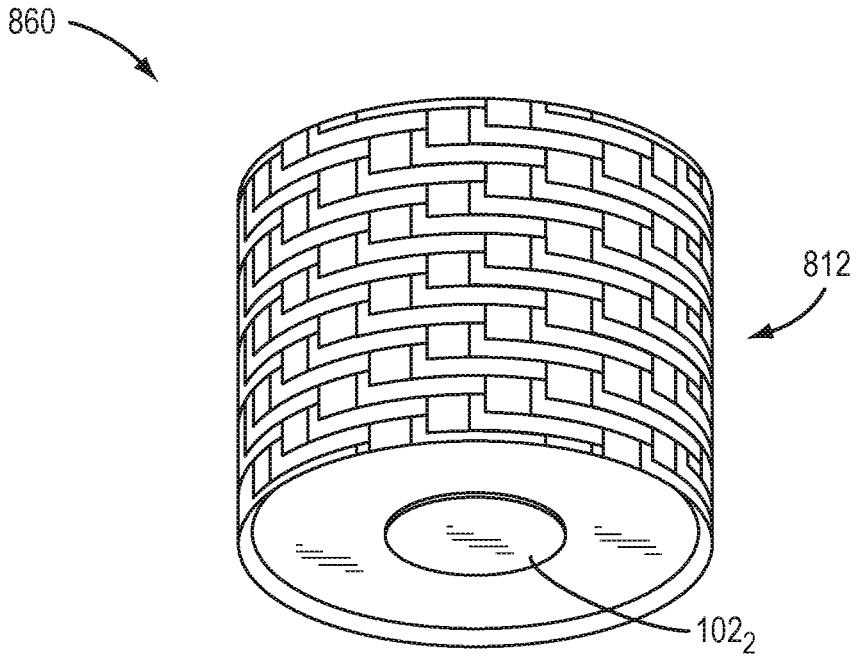
FIG. 8B is a rear view of a collimator design for LED lamp systems, according to certain embodiments of the present disclosure.

FIG. 8B is a rear view 860 of a collimator design for LED lamp systems. In the configuration shown, the collimator is operable for blocking side-emanating light. The surfaces of the collimator may be textured or polished or anodized or painted for ornamental or other purposes.

Figure 8C:
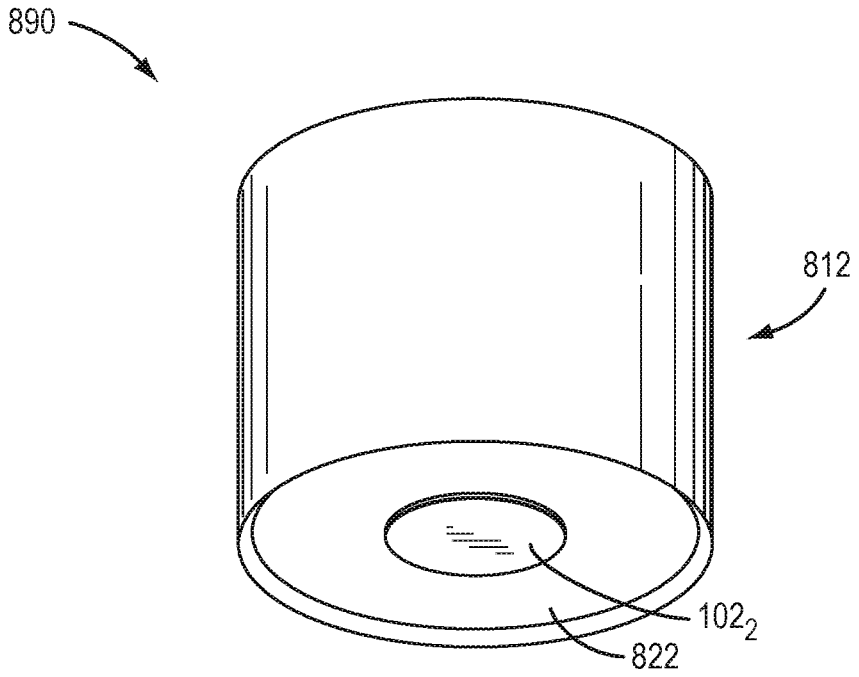
FIG. 8C is a rear view of a collimator design for LED lamp systems, according to certain embodiments of the present disclosure.

FIG. 8C is a rear view 890 of a collimator design for LED lamp systems. In the configuration shown, the collimator is operable for blocking side-emanating light, and includes a magnet $\mathbf{102}_2$ affixed to a diffuser 822, which is integrated into the collimator 812.

Figure 9A:
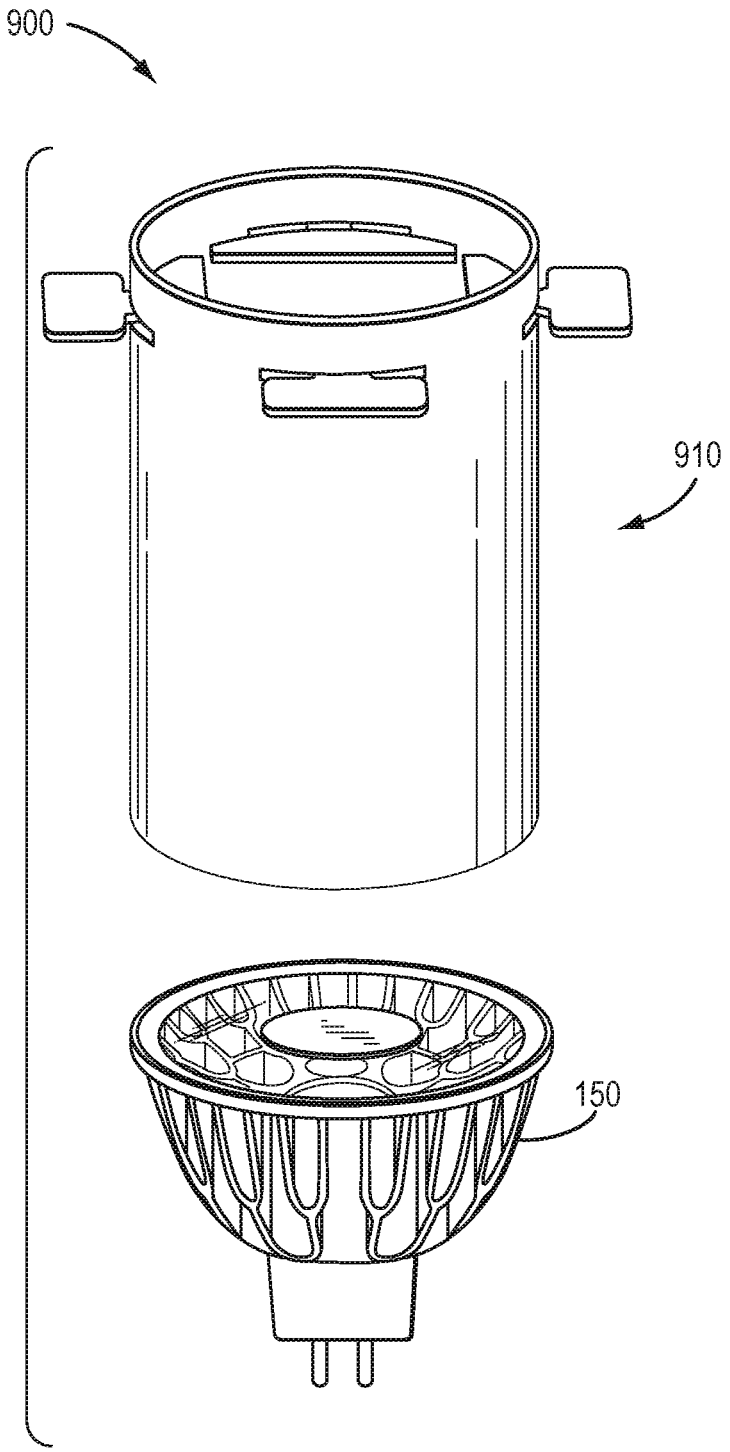
FIG. 9A depicts an arrangement of a projector accessory for LED lamp systems, according to certain embodiments of the present disclosure.

FIG. 9A depicts an arrangement 900 of a projector accessory 910 for LED lamp systems. The term "projector accessory" as used herein refers to an accessory attached to an LED lamp or other LED light source. As shown the projector accessory 910 is attached to an LED lamp by means of magnetic attraction (also see the collimator 812 of FIG. 8A and FIG. 8B). The projector accessory 910 comprises secondary optics and adjustable baffles. As shown in FIG. 9A, the arrangement 900 shows an LED lamp 150 comprising a lens having a center and a diameter to which is attached a first magnet so as to accommodate a projector accessory where the projector accessory is disposed on the lens and held in place by a second magnet $\mathbf{102}_2$ attached to the center of the projector accessory (see FIG. 9B). The projector accessory 910 has an adjustable aperture and focal lens(s) that allows manipulation of the projected light beam. In some cases, the LED lamp comprises a lamp output mechanical aperture. In some cases, the LED lamp comprises a first or second lens that is configured to cover more than 90% of the lamp output mechanical aperture.

Figure 9B:
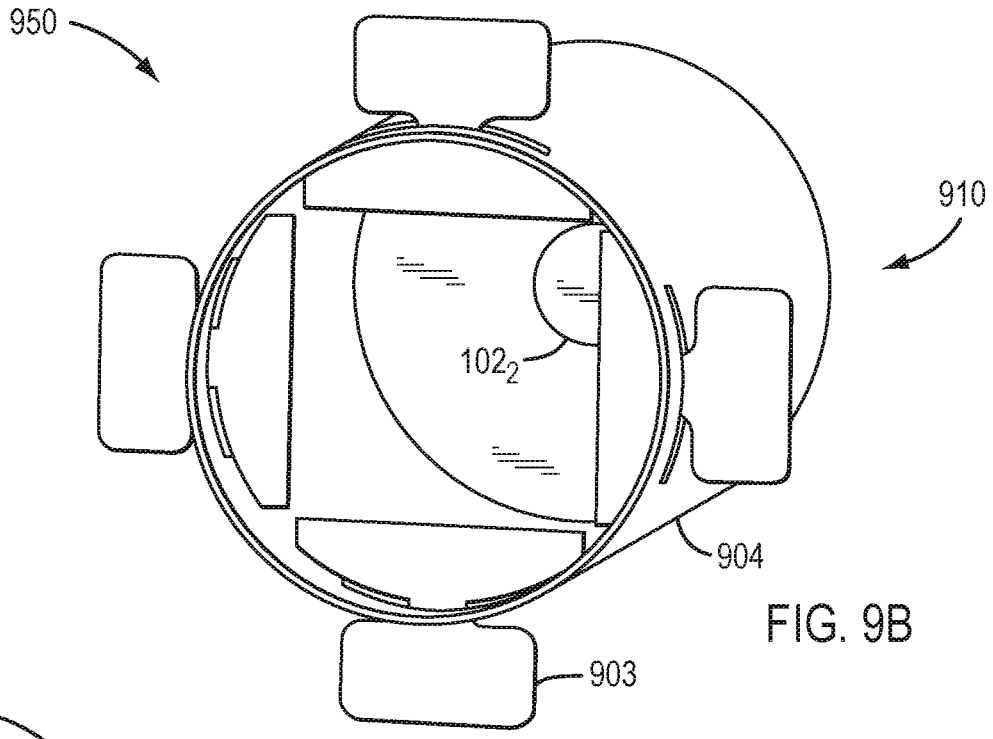
FIG. 9B is a front view of a projector accessory for LED lamp systems, according to certain embodiments of the present disclosure.

FIG. 9B is a front view 950 of a projector accessory 910 for LED lamp systems, according to certain embodiments of the present disclosure. As shown in FIG. 9B, the projector accessory 910 comprises a housing 904, into which are mated a plurality of adjustable baffles 903. The baffles shown are substantially rectilinear, however baffles may be formed into a non-rectangular or irregular shape. Furthermore, some embodiments of projector accessory 910 have one or more focal lens(s) that provide for manipulation of the projected light beam so as to focus a pattern on a surface (e.g., a wall, a painting, a door) that is positioned at a predetermined length from the focal lens.

Figure 9C:
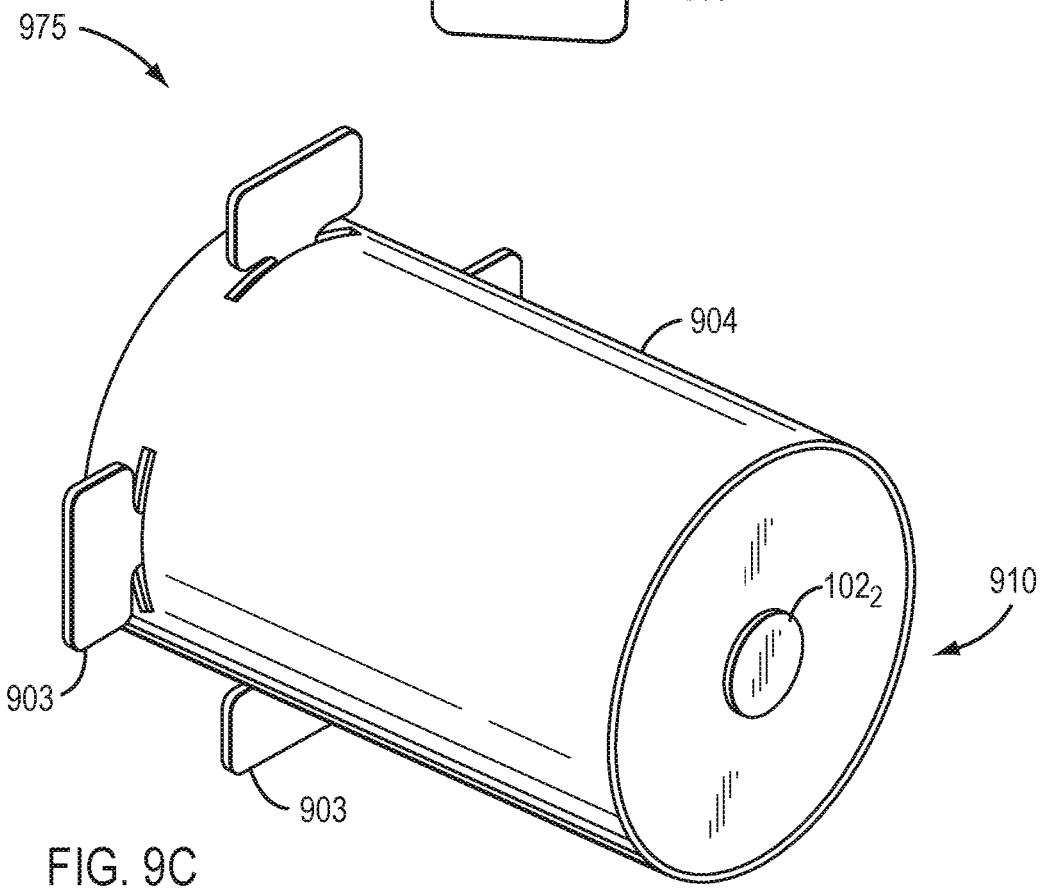
FIG. 9C is a side view of a projector accessory for LED lamp systems, according to certain embodiments of the present disclosure.

FIG. 9C is a side view 975 of a projector accessory for LED lamp systems. The rear view shows magnet $\mathbf{102}_2$.

Figure 10:
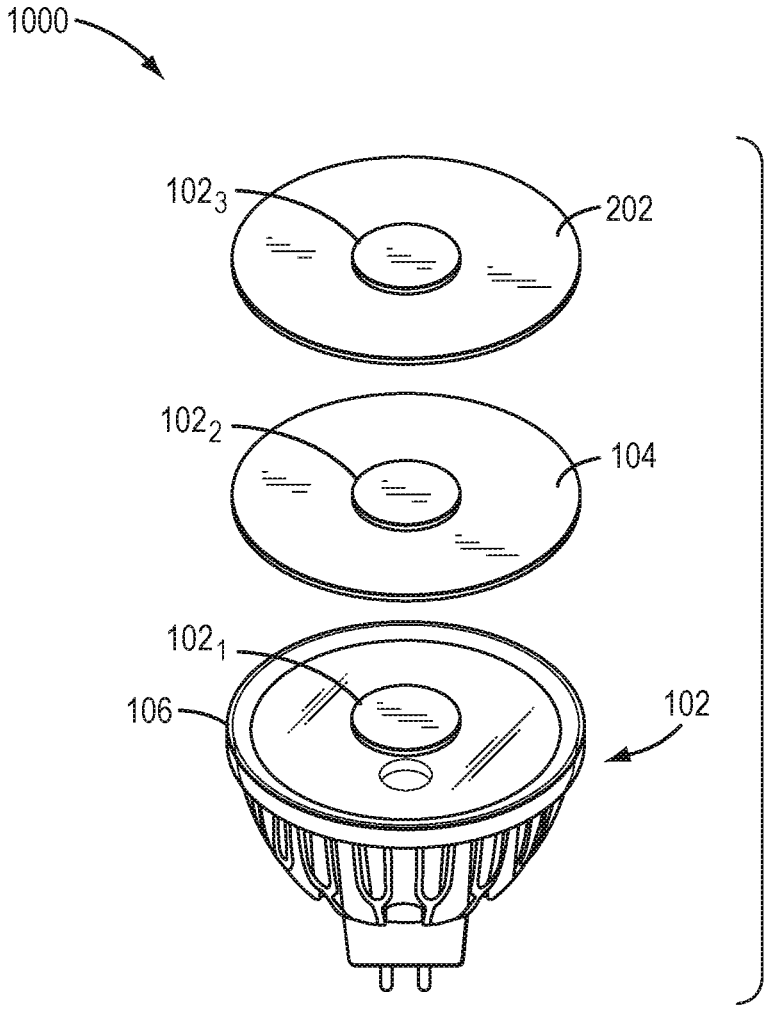
FIG. 10 is an exploded view of an LED lamp having magnet accessories, according to certain embodiments of the present disclosure.

FIG. 10 is an exploded view 1000 of an LED lamp having magnet accessories. As shown, an LED lamp is affixed to a lens 106 having a center and a diameter for mating to a first magnet $\mathbf{102}_1$ attached to the center of the lens 106. A first accessory 104 is disposed over the lens 106 using a second magnet $\mathbf{102}_2$ mechanically attached to the center of the first accessory 104. The first magnet $\mathbf{102}_1$ and the second magnet $\mathbf{102}_2$ are configured to retain the first accessory 104 against the lens 106. A second accessory 202 is disposed over the first accessory 104 using a third magnet $\mathbf{102}_3$ mechanically attached to the center of the second accessory 202.

In some embodiments, for example, embodiments without the magnet $\mathbf{102}_1$ attached to the center of the lens 106, there can be light leakage at high optical angles, which light leakage causes unwanted glare. The magnet $\mathbf{102}_1$ serves to block at least a portion of the unwanted high-angle light, and a reduction in glare is in response to the shape and position of the magnet. In some embodiments, the magnet $\mathbf{102}_1$ may have a special reflector coat on it to enhance the reflection of the high angle light back into or toward the general direction of the LED light source. In some embodiments, the magnet $\mathbf{102}_1$ may be coated with a material to absorb the light. In other embodiments, the magnet $\mathbf{102}_1$ may have an untreated surface that provides for tuned absorption and/or reflection. Furthermore, the magnet may be embodied as a disk, as a ring, as a doughnut, or any other appropriate shape.

Figure 11A:
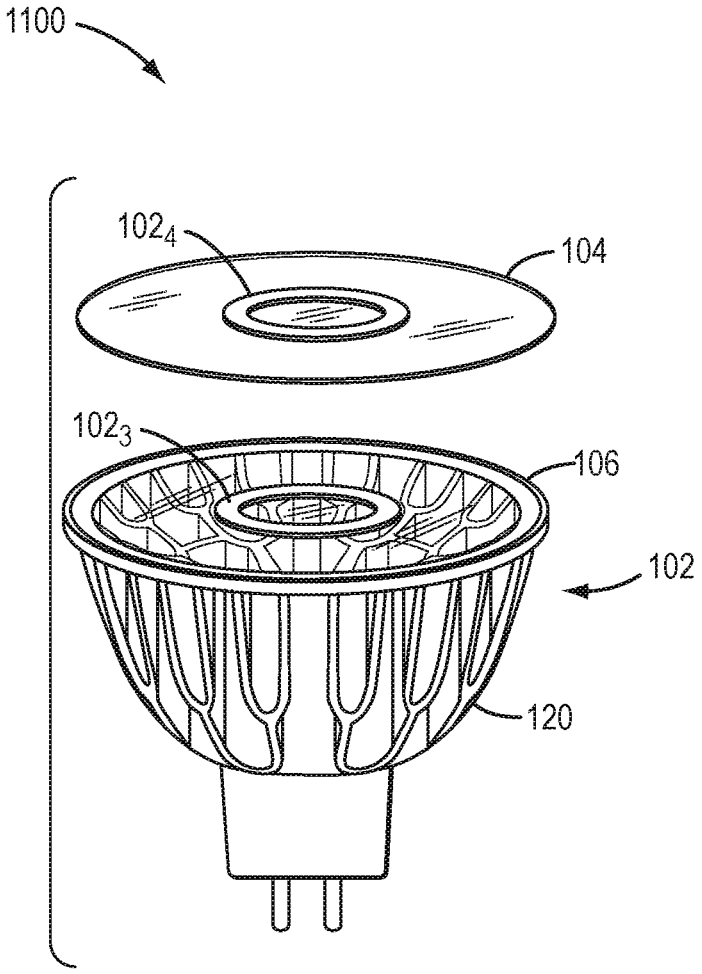
FIG. 11A is a top elevation view of an LED lamp assembly having magnet accessories, according to certain embodiments of the present disclosure.

FIG. 11A is a top elevation view 1100 of an LED lamp assembly having magnetic accessories. As shown in FIG. 11A, a lens 106 is attached to a heat sink 120. The design of lens 106 includes a magnet (e.g., a ring-shaped or doughnut magnet $\mathbf{102}_3$) which can hold accessory 104 to the lens 106. The first magnet (doughnut magnet $\mathbf{102}_3$) and second magnet (e.g., $\mathbf{102}_4$) are opposing magnets that can be configured to retain the accessory 104 against the lens 106. For example, the opposing magnets $\mathbf{102}_3$ and $\mathbf{102}_4$ may have the opposite polarity. Moreover the shape and position of the opposing magnets is such that an attachment is self-centering with respect to the lens 106 upon installation.

Figure 11B:
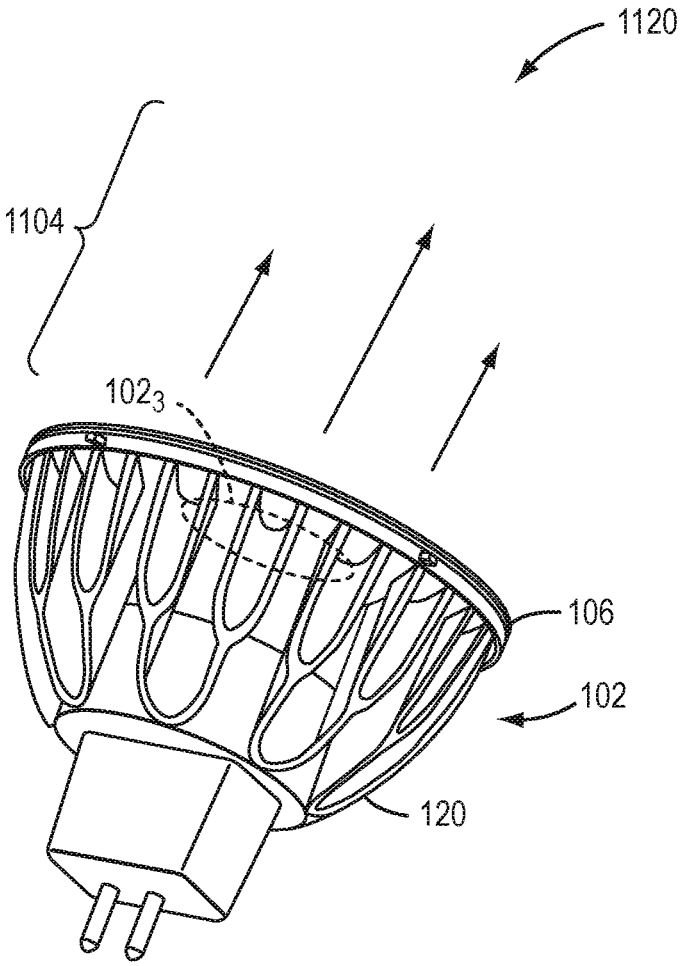
FIG. 11B is a rear elevation view of an LED lamp assembly having magnet accessories, according to certain embodiments of the present disclosure.

FIG. 11B is a rear elevation view 1120 of an LED lamp assembly having magnetic accessories. As shown, the doughnut magnet $\mathbf{102}_3$ is shaped and affixed to lens 106 in a particular position so as to occlude only a portion of the light emanating from the LED light source. In certain embodiments, the shape and position of the doughnut magnet serves to attenuate glare (see emanated light pattern 1104).

Figure 11C:
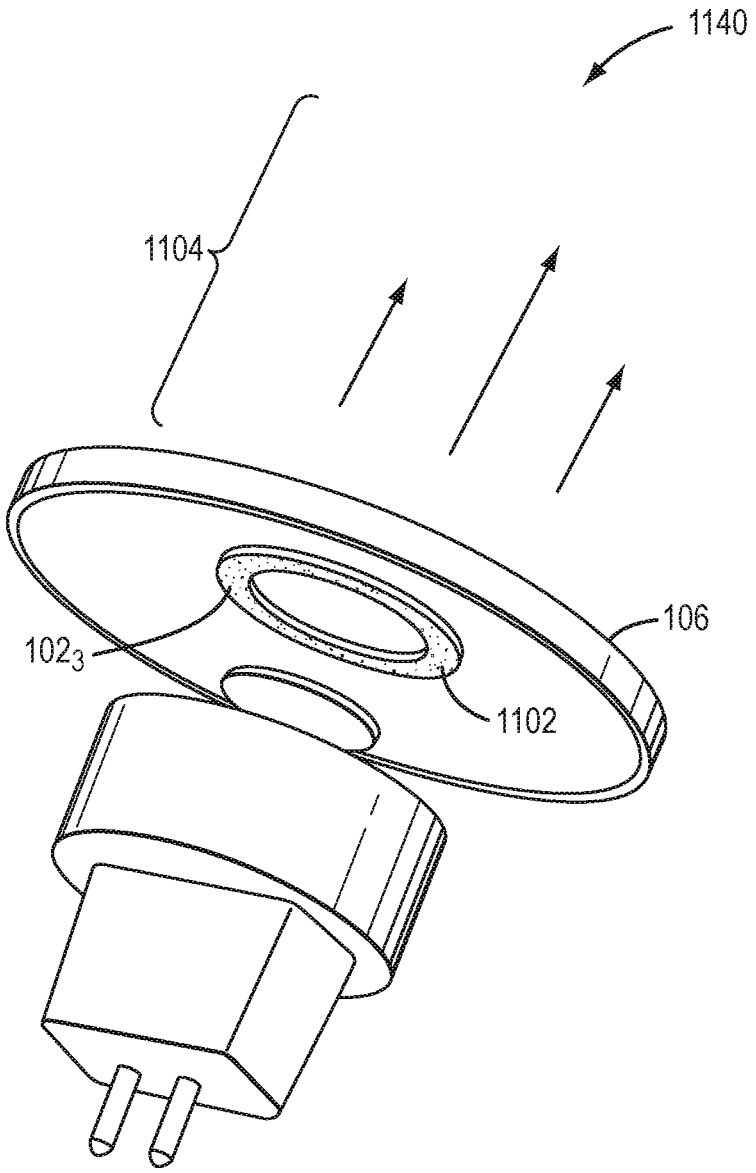
FIG. 11C is a rear cutaway view of an LED lamp assembly having magnet accessories, according to certain embodiments of the present disclosure.

FIG. 11C is a rear cutaway view 1140 of an LED lamp assembly having magnetic accessories. As shown, the doughnut magnet $\mathbf{102}_3$ is shaped and affixed to lens 106 in a particular position so as to reflect a portion of the light emanating from the LED light source back toward the general direction of the LED light source. In some embodiments, the treated surface 1102 of the doughnut magnet $\mathbf{102}_3$ is treated so as reflect light in a particular pattern and direction. A particular pattern and direction can be predetermined, and the selection of the shape, position, and surface treatment can be tuned so as to modulate the light (see emanated light pattern 1104) using the predetermined particular pattern and direction.

Figure 12:
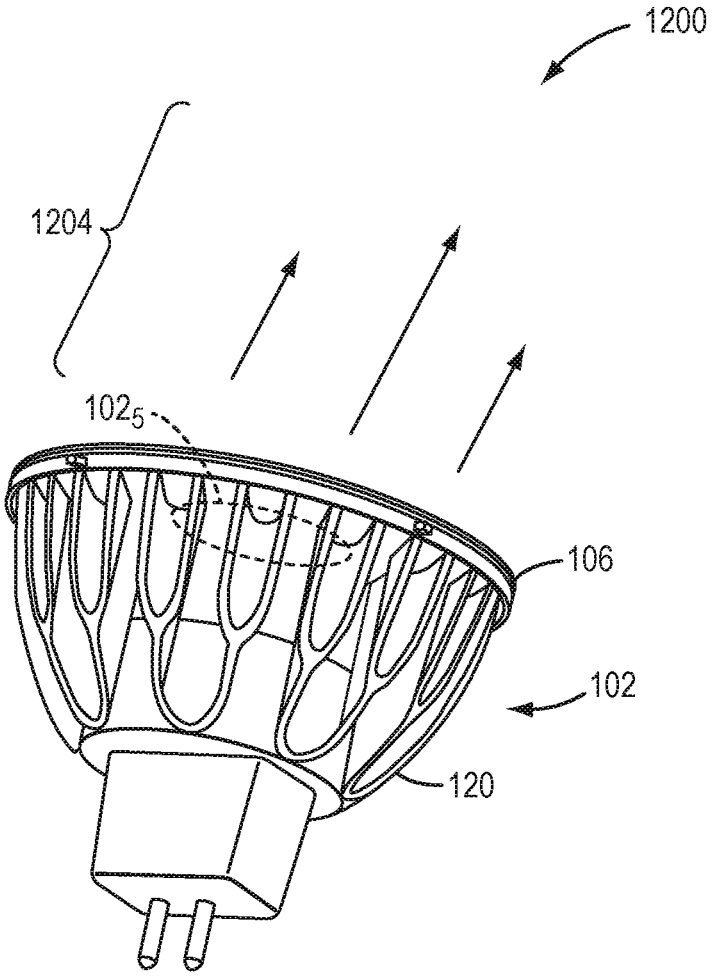
FIG. 12 is a rear elevation view of an LED lamp assembly having magnet accessories, according to certain embodiments of the present disclosure.

FIG. 12 is a rear elevation view 1200 of an LED lamp assembly having magnetic accessories. As shown, the disk magnet $\mathbf{102}_5$ is shaped and affixed to lens 106 in a particular position so as to occlude only a portion of the light emanating from the LED light source. In some embodiments, the shape and position of the disk magnet serves to attenuate glare (see emanated light pattern 1104). A particular pattern and direction can be predetermined, and the selection of the shape, position and surface treatment of the disk magnet $\mathbf{102}_5$ and its treated surface $\mathbf{1102}_2$ can be tuned so as to modulate the light (see emanated light pattern 1204) using the predetermined particular pattern and direction.

Figure 13A:
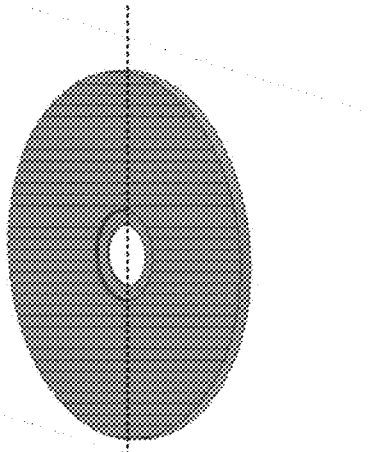
FIG. 13A is a perspective view of a beam shaping accessory and example attaching features for an LED lamp, according to some embodiments.

FIG. 13A is a perspective view of a beam shaping accessory 13A00 and example attaching features for an LED lamp. The attaching features of FIG. 13A are further described infra.

Figure 13B:
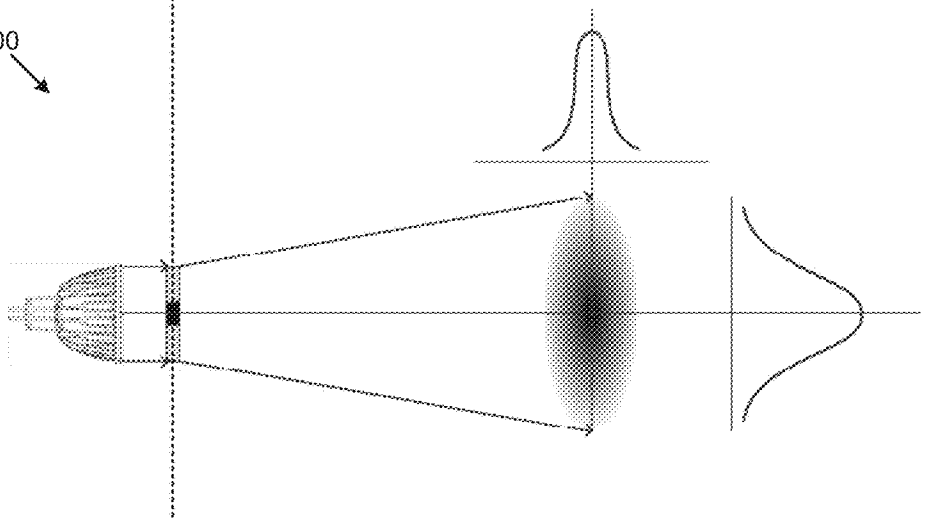
FIG. 13B is a schematic showing relative intensities of light after passing through an oval pattern beam shaping accessory that has been treated to modulate an emanated light pattern as used with an LED lamp, according to some embodiments.

FIG. 13B is a schematic 13B00 showing relative intensities of light after passing through an oval pattern beam shaping accessory that has been treated to modulate an emanated light pattern as used with an LED lamp.

Figure 14:
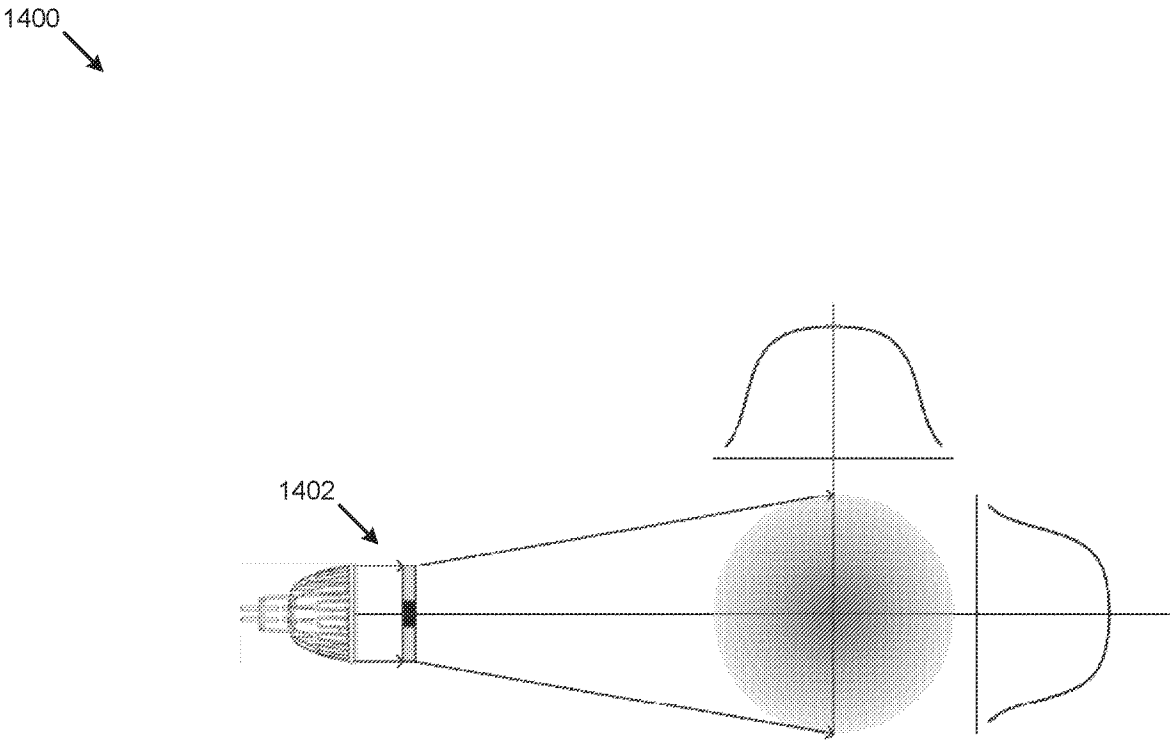
FIG. 14 is a schematic showing relative intensities of light after passing through a uniform circular beam shaping accessory as used with an LED lamp, according to some embodiments.

FIG. 14 is a schematic 1400 showing relative intensities of light after passing through a uniform circular beam shaping accessory 1402 as used with an LED lamp.

Figure 15:
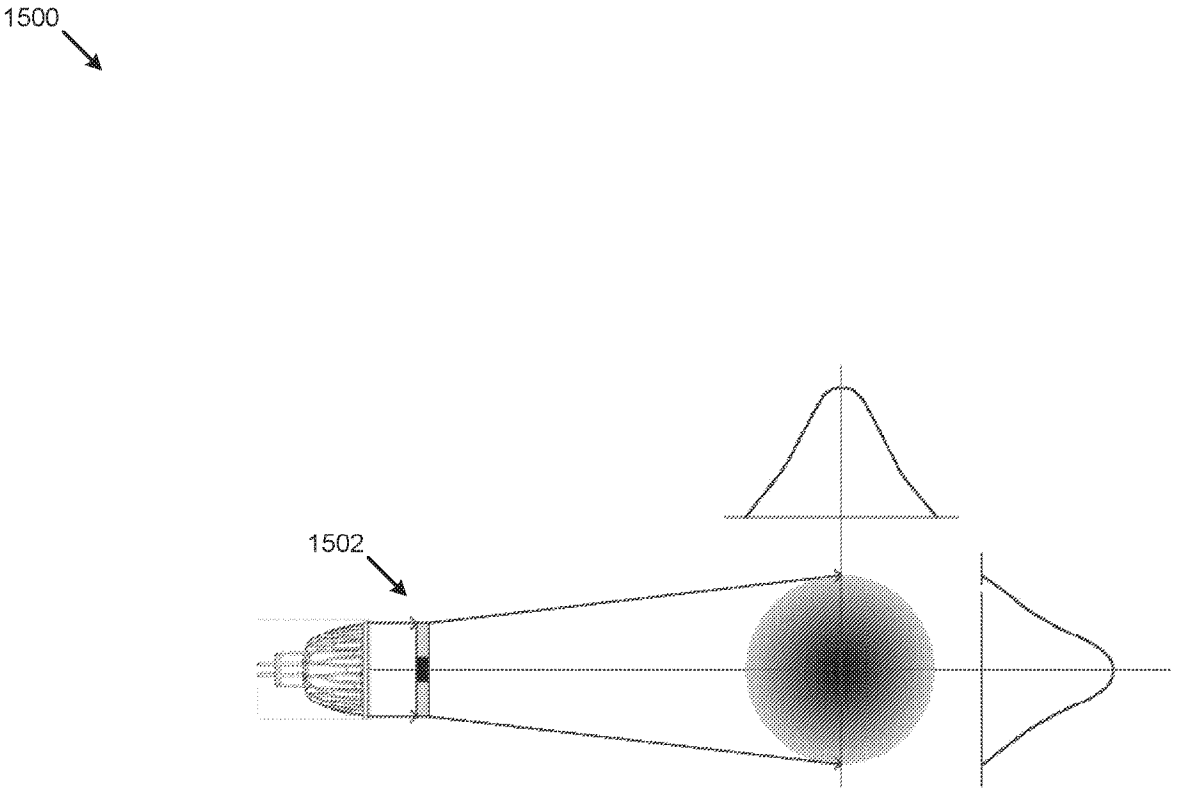
FIG. 15 is a schematic showing relative intensities of light after passing through a center-weighted circular beam shaping accessory as used with an LED lamp, according to some embodiments.

FIG. 15 is a schematic 1500 showing relative intensities of light after passing through a center-weighted circular beam shaping accessory 1502 as used with an LED lamp.

Figure 16:
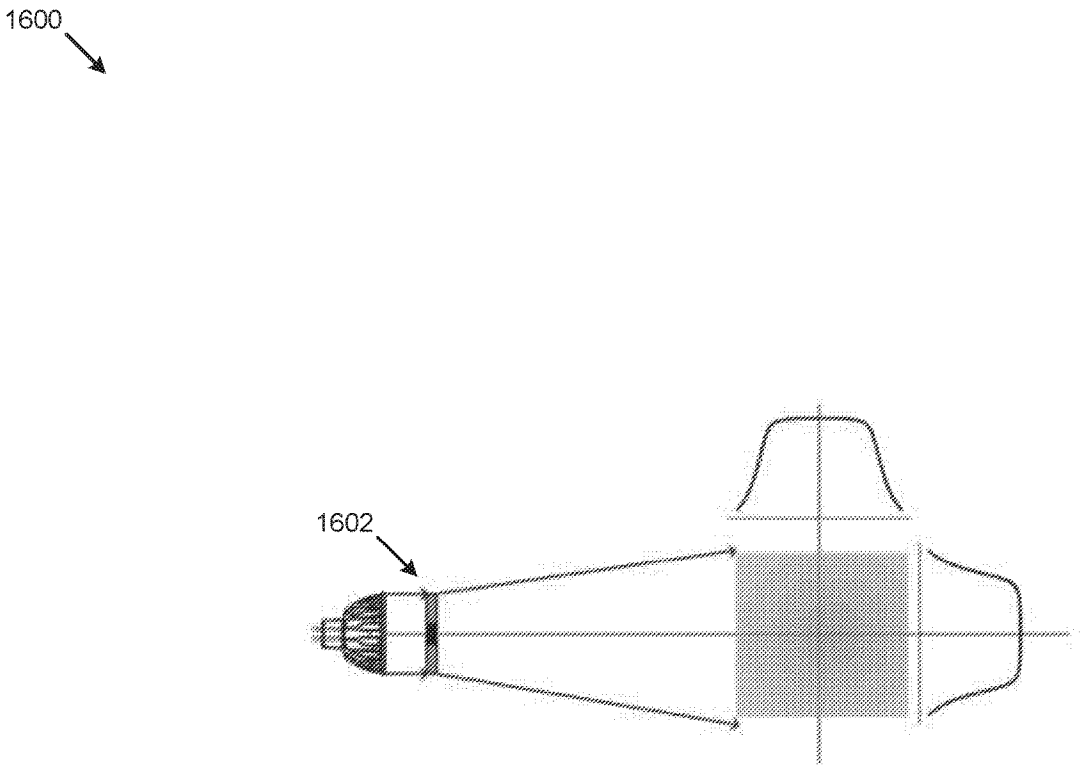
FIG. 16 is a schematic showing relative intensities of light after passing through a rectangular pattern beam shaping accessory as used with an LED lamp, according to some embodiments.

FIG. 16 is a schematic 1600 showing relative intensities of light after passing through a rectangular pattern beam shaping accessory 1602 as used with an LED lamp.

Figure 17:
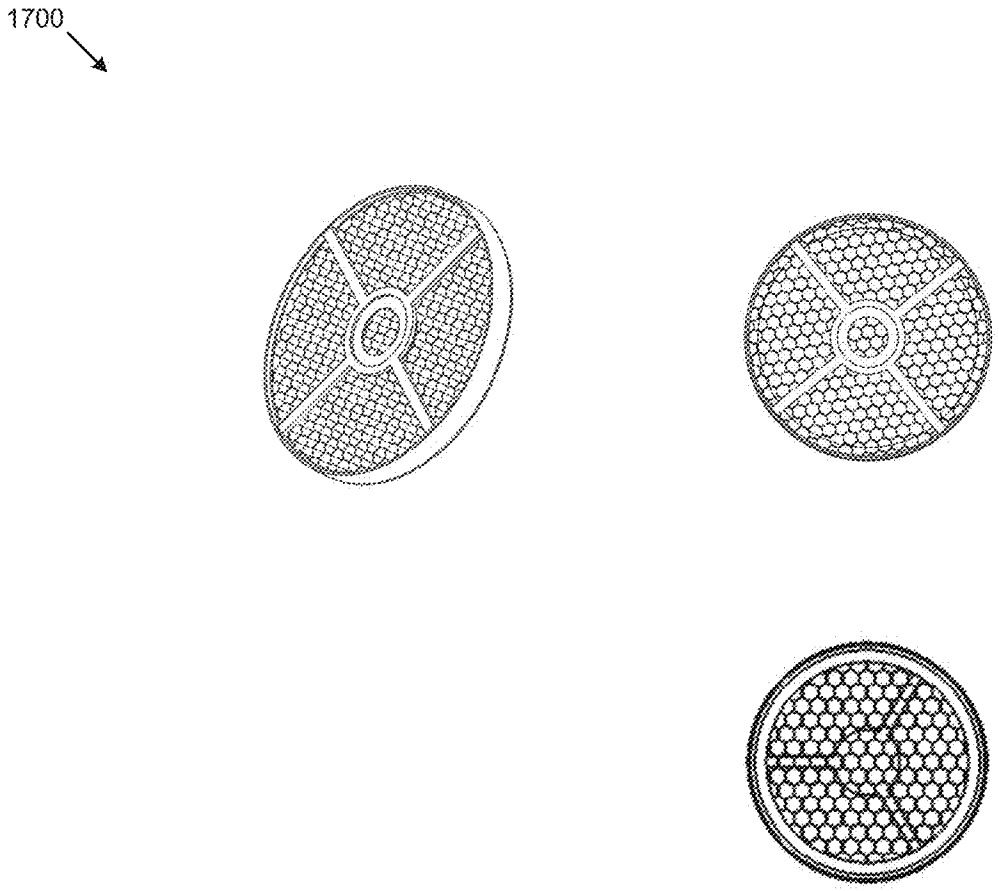
FIG. 17 presents views of a honeycomb louver accessory and attach features as used with an LED lamp, according to some embodiments.

FIG. 17 presents views of a honeycomb louver accessory 1700 and attach features as used with an LED lamp. The honeycomb shape of the accessory is used to cancel the incident glare from the light source and to direct the light to a specific area of interest.

Figure 18:
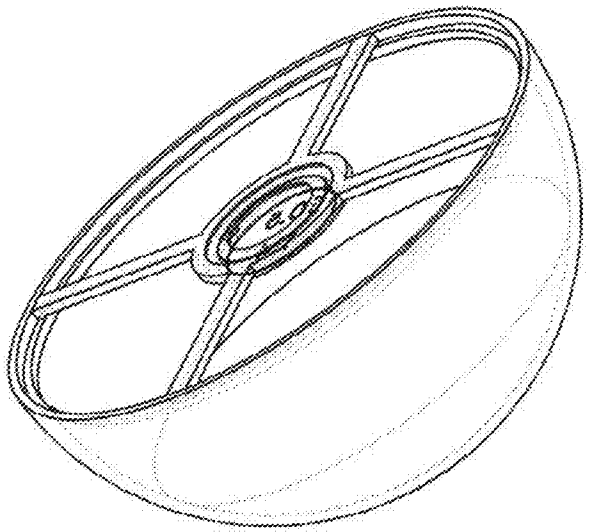
FIG. 18 presents a perspective view of a half-dome diffuser accessory that can serve to block the glare from the light source as used with an LED lamp, according to some embodiments.

FIG. 18 presents a perspective view of a half-dome diffuser accessory 1800 that can serve to block the glare from the light source 1800. Also shown are attach features as used with an LED lamp.

Figure 19:
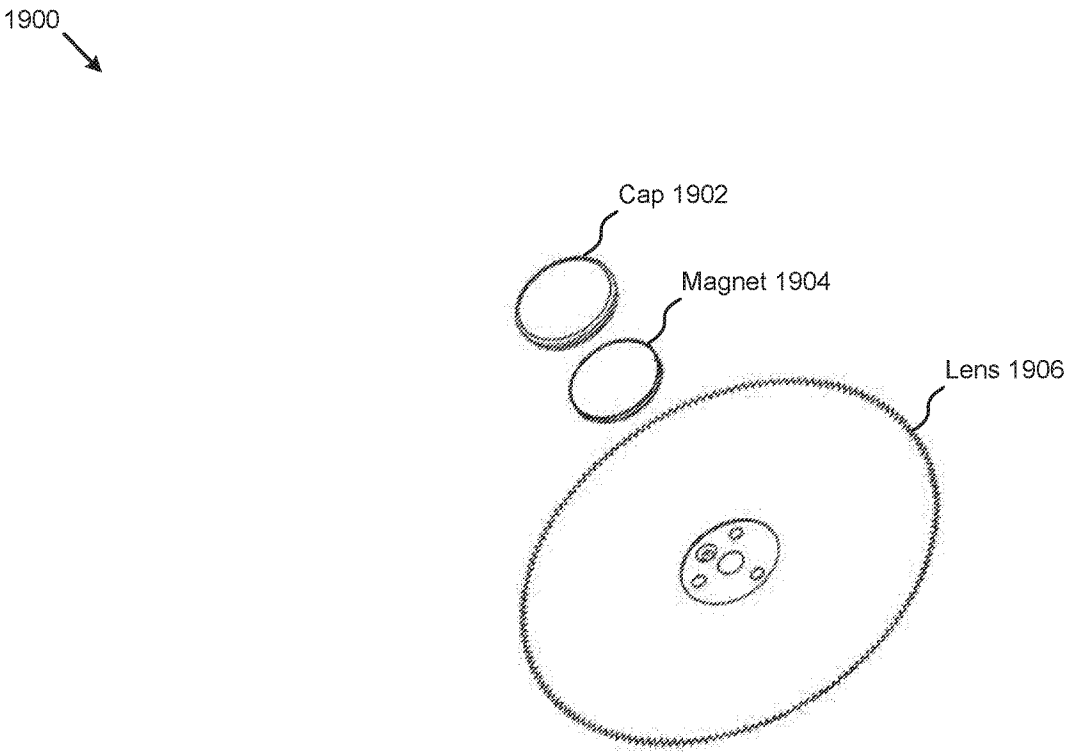
FIG. 19 is an exploded view of components in an assembly of a prism lens configured for use with an LED lamp, according to some embodiments.

FIG. 19 is an exploded view of components in an assembly of a prism lens 1900 configured for use with an LED lamp. Various techniques could be used to secure the magnet to a lens or to the aforementioned accessories. Such techniques are not limited to one or another of the various methods. Non-limiting examples are:

Mold in place: This technique relies in part on geometry that is suitable for a molding process. In some embodiments, the magnet is captured into place during an injection process.

Press-On: This technique relies at least in part on the friction and/or cohesion and/or adhesion between the magnet and the lens (or the magnet and the accessory) to hold the magnet in place. In certain applications, snap tabs can be used to flex open and snap-hold the magnet in place.

Glue: Various types of glue techniques are often capable of holding the magnet in place. An adhesive holds the magnet in place on the lens or the accessories. Depending on the material finish and temperature, various types of adhesive can be used to secure the magnet to other parts.

Ultrasonic Weld: Ultrasonic (US) welding is a process used to attach the magnet to the lens or to the accessories. The US process uses a thin plastic cap 1902 to encapsulate a magnet (e.g., magnet 1904 as shown) onto the lens or the accessory (e.g., lens 1906). In the shown embodiment, the internal geometry of the accessory is designed so as to allow the same cap to enshroud magnets of different thickness. In some cases such an arrangement is employed in order to affix a magnet to either a lens or to an accessory.

One aspect of affixing a magnet to a lens is the lens light efficiency. Therefore the pocket on the lens should be only as deep as necessary. A thin magnet is used for the specific application of affixing the magnet on the face of the lens. As shown, the cap geometry is designed to encapsulate the thin magnet on the lens (which assembly is shown in FIG. 20).

Figure 20:
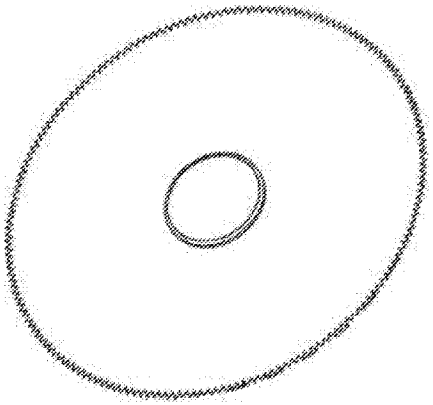
FIG. 20 shows an assembly of components to form a prism lens configured for use with an LED lamp, according to some embodiments.

FIG. 20 shows an assembly of components to form a prism lens 2000 configured for use with an LED lamp.

Figure 21:
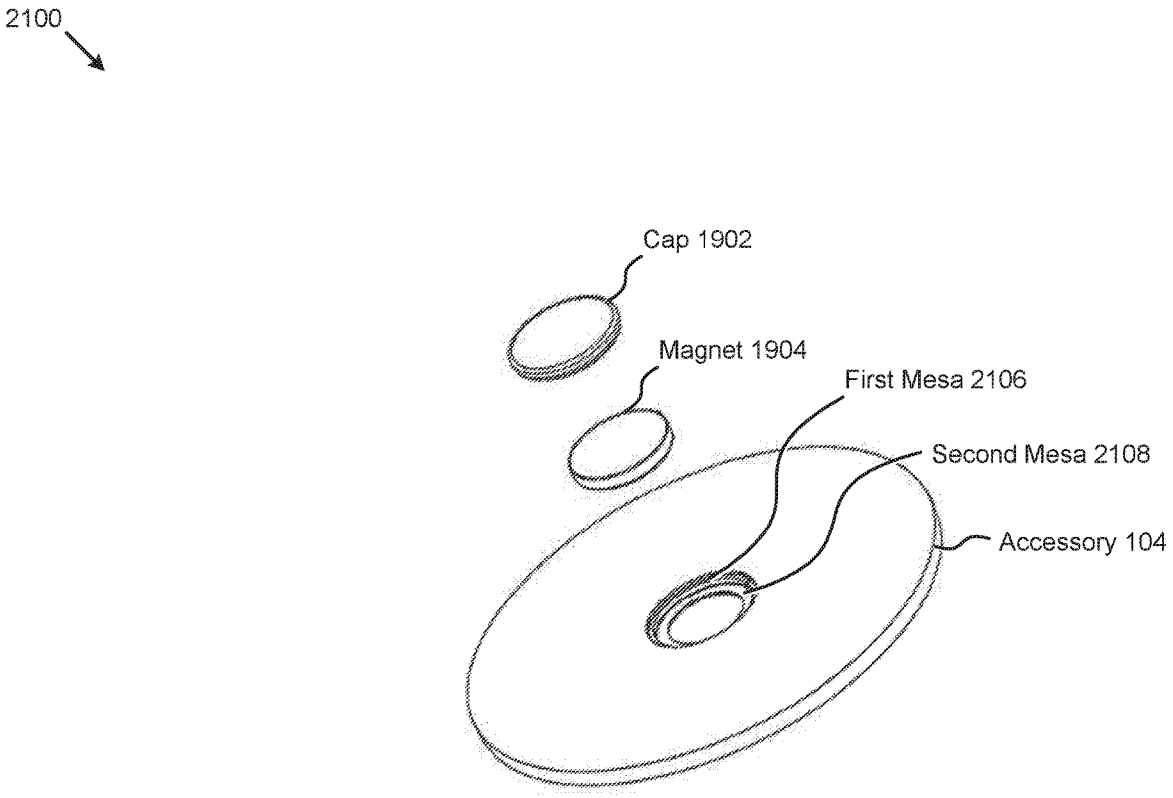
FIG. 21 is an exploded view of components in an assembly of an accessory or a filter configured for use with an LED lamp, according to some embodiments.

FIG. 21 is an exploded view of components in an assembly of an accessory or a filter 2100 configured for use with an LED lamp. The accessory shown has progressive pockets (e.g., having a first mesa 2106 and a second mesa 2108) for receiving the magnet and for receiving the cap. For example, the magnet is placed in the pocket, then the cap is placed on top of the magnet where the edges of the cap makes contact with a pocket. This assembly is then placed in an ultrasonic welding machine that joins the cap to the accessory. Different thickness of magnets can be used. In some cases a different thickness is used for the accessory as compared with the thickness used for the lens.

In some cases the pockets are designed such that the same cap can be used to encapsulate the magnet on either the lens or the accessory.

Figure 22:
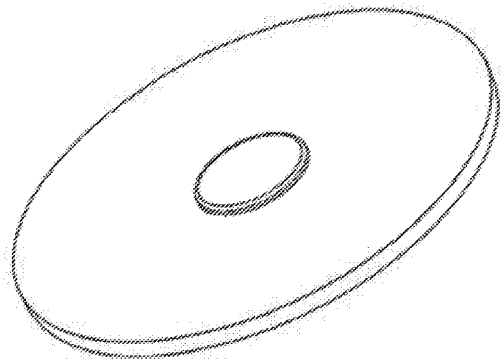
FIG. 22 shows an assembly of components to form a filter such as, for example, a color filter or a polarized configured for use with an LED lamp, according to some embodiments.

FIG. 22 shows an assembly of components to form a filter 2200 such as, for example, a color filter or a polarizer configured for use with an LED lamp.

In certain embodiments, an illumination source is configured to output light having a user-modifiable beam characteristic. Such an illumination source comprises an LED light unit configured to provide a light output in response to an output driving voltage; a driving module coupled to the LED light unit, wherein the driving module is configured to receive an input driving voltage and is configured to provide the output driving voltage; a heat sink coupled to the LED light unit, wherein the heat sink is configured to dissipate heat produced by the LED light unit and by the driving module; a reflector coupled to the heat sink, wherein the reflector is configured to receive the light output, and wherein the reflector is configured to output a first light beam having a first beam characteristic; and a lens coupled to the heat sink, wherein the lens is configured to receive the first light beam having the first beam characteristic, and wherein the lens is configured to output a second light beam having a second beam characteristic, wherein the lens is selected by the user to achieve the second beam characteristic and wherein the lens is coupled to the heat sink by the user.

In certain embodiments, such as the immediately preceding embodiment, an illumination source is provided comprising a transmissive optical lens and a retaining ring coupled to the transmissive optical lens, wherein the retaining ring is configured to couple the transmissive optical lens to the heat sink.

In certain embodiments, a retaining ring comprises an incomplete circle.

In certain embodiments of an illumination source, a lens that is coupled to a heat sink is configured to require use of a tool to decouple the lens from the heat sink.

In certain embodiments of an illumination source, the intensity for the light output from the illumination source is greater than approximately 1500 candela.

In certain embodiments of an illumination source, the first beam characteristic is selected from a beam angle, a cut-off angle, a roll-off characteristic, a field angle, and/or a combination of any of the foregoing.

In certain embodiments of an illumination source, a heat sink comprises a plurality of heat dissipation fins wherein at least one of the plurality of heat dissipation fins includes a retaining mechanism, and a lens is configured to be coupled to at least one of the plurality of heat dissipation fins by means of a retaining mechanism.

In certain embodiments of an illumination source, a retaining mechanism is selected from an indentation on the heat dissipation fin, a clip coupled to the heat dissipation fin, and/or a combination thereof.

In certain embodiments of an illumination source, a heat sink comprises an MR16 form factor heat sink.

In certain embodiments of an illumination source, a driving module comprises a GU5.3 compatible base.

Certain embodiments provided by the present disclosure include methods of providing accessories and components for assembling the accessories to a user. Certain embodiments further provide for methods of assembling accessories provided by the present disclosure.

In certain embodiments of methods for configuring a light source to provide a light beam having a user-selected beam characteristic comprise receiving a light source, wherein the light source comprises an LED light unit configured to provide a light output in response to an output driving voltage; a driving module coupled to the LED light unit, wherein the driving module is configured to receive an input driving voltage and is configured to provide the output driving voltage; a heat sink coupled to the LED light unit, wherein the heat sink is configured to dissipate heat produced by the LED light unit and by the driving module, and a reflector coupled to the heat sink, wherein the reflector is configured to receive the light output, and wherein the reflector is configured to output a light beam having a first beam characteristic; receiving a user selection of a lens to achieve a second beam characteristic, wherein the lens is configured to receive the light beam having the first beam characteristic and wherein the lens is configured to output a light beam having the second beam characteristic; receiving the lens in response to the user selection of the lens, separate from the light source; and coupling the lens to the light source.

In certain methods such as the immediately preceding method, the lens comprises an optical lens and a retaining ring coupled to the optical lens, wherein the retaining ring is configured to couple the optical lens to the heat sink and wherein coupling the lens to the heat sink comprises compressing the retaining ring about the optical lens; disposing the retaining ring that is compressed within a portion of the heat sink; and releasing the retaining ring such that the retaining ring is coupled to the portion of the heat sink.

In certain embodiments of methods, the retaining ring comprises a circular shaped metal.

In certain embodiments, methods further comprise decoupling the lens from the heat sink using a tool wherein the decoupling step requires use of a tool to decouple the lens from the heat sink.

In certain embodiments, the intensity for the light output is greater than approximately 1500 candela.

In certain embodiments of methods, the first beam characteristic is selected from a group consisting of: beam angle, cut-off angles, roll-offs characteristic, and/or field angle.

In certain embodiments of methods, the heat sink comprises a plurality of heat dissipation fins wherein at least one of the plurality of heat dissipation fins includes a retaining mechanism, and wherein coupling the lens to heat sink comprises coupling the lens to the at least one heat dissipation fin via the retaining mechanism.

In certain embodiments of methods, the retaining mechanism is selected from a group consisting of: an indentation on the heat dissipation fin, and a clip coupled to the heat dissipation fin.

In certain embodiments of methods, the heat sink comprises an MR16 form factor heat sink.

In certain embodiments of methods, the driving module comprises a GU5.3 compatible base.

Figure 23B:
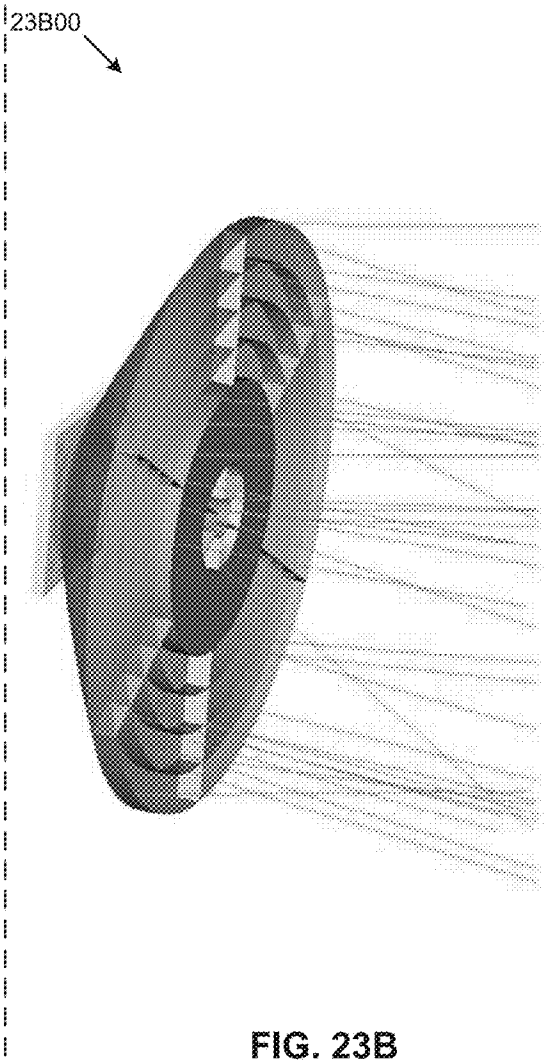
FIG. 23B shows a light pattern emanating from an LED lamp assembly adapted for magnetically mounted concentric baffles for LED lamp systems, according to some embodiments.
Figure 23A:
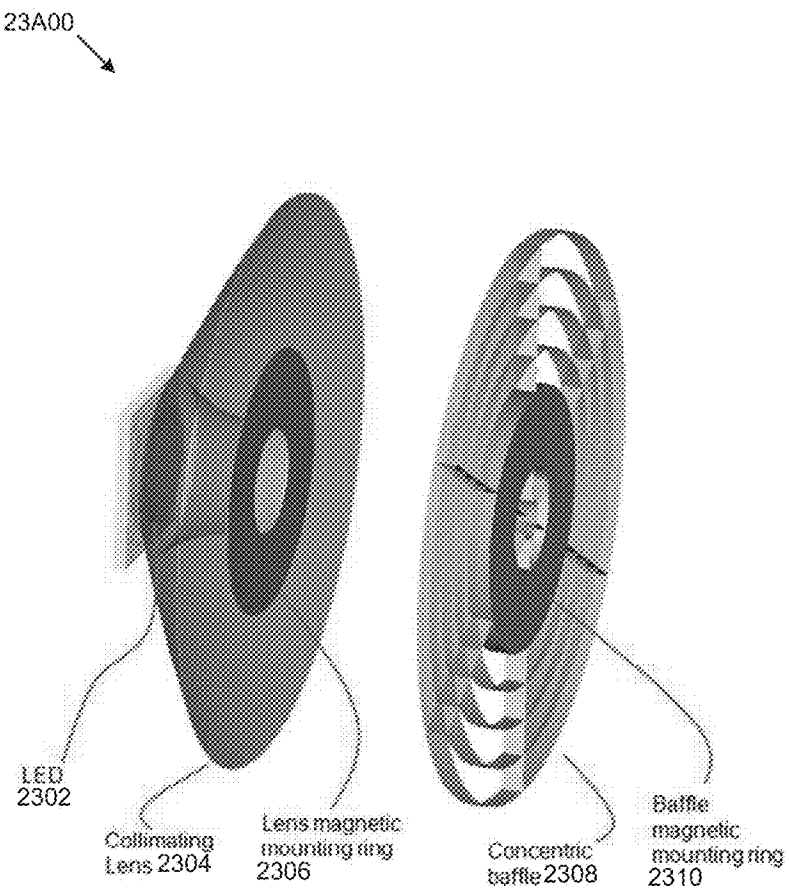
FIG. 23A exemplifies an LED lamp assembly adapted for magnetically mounted concentric baffles for LED lamp systems, according to some embodiments.

FIG. 23A exemplifies an LED lamp assembly 23A00 adapted for magnetically mounted concentric baffles for LED lamp systems.

FIG. 23A shows the lamp and the baffle each with a magnetic ring. The ring is sized so as to coincide with the domain on this lamp from where little light is emerging. The particular lamp shown is of what is known as folded total internal reflection (TIR) where light (when no baffle is present) is not emerging from the center ring domain where the baffle is mounted due to the TIR effect that occurs at that center ring location.

FIG. 23B shows a light pattern 23B00 emanating from an LED lamp assembly adapted for magnetically mounted concentric baffles for LED lamp systems.

FIG. 23B shows the lamp mounted with the concentric baffle by placing of the baffle magnetic surface over the lamp magnetic surface.

Figure 24:
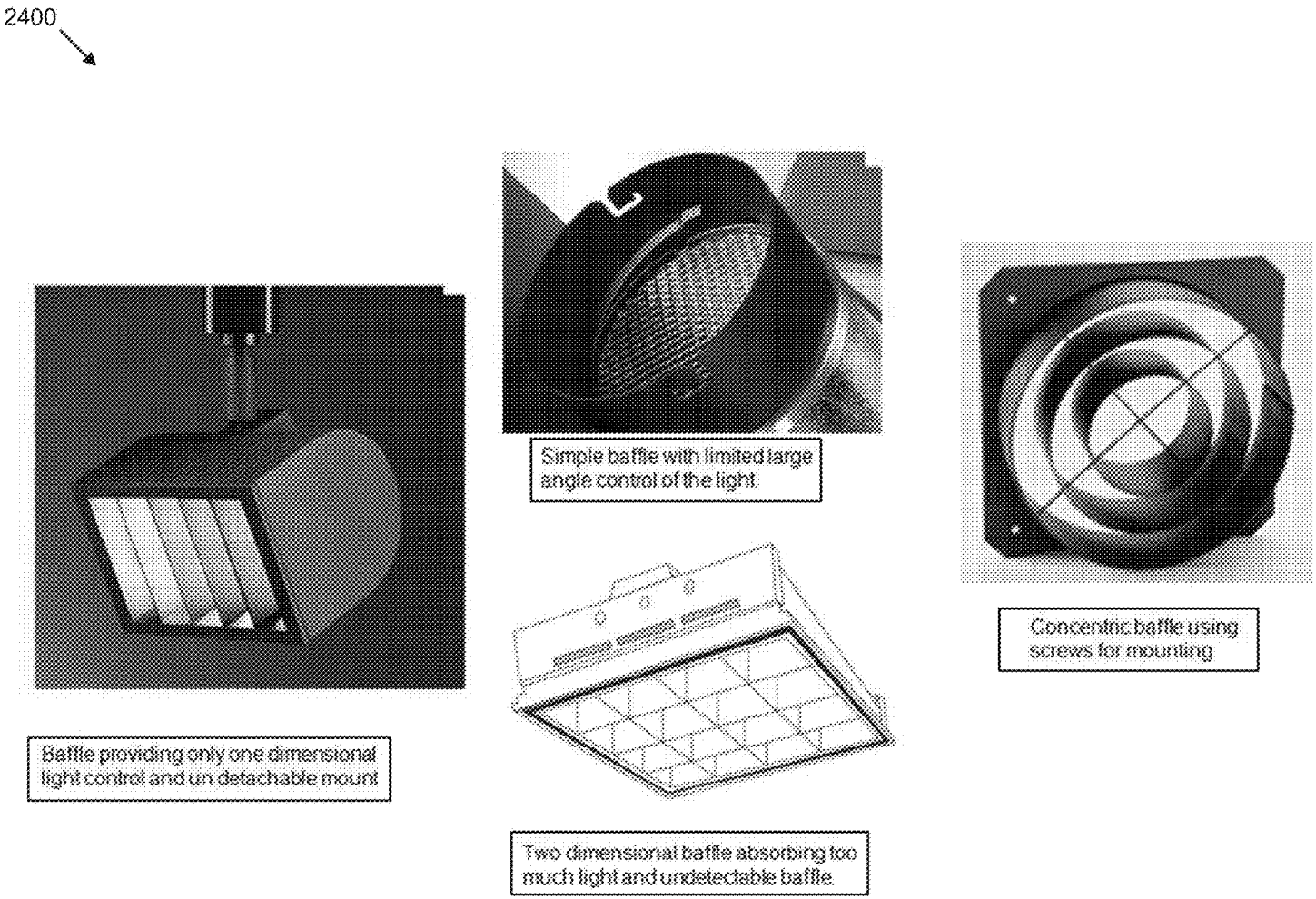
FIG. 24 shows a series of legacy baffles that can be improved for use in an LED lamp assembly adapted for magnetically mounted concentric baffles for LED lamp systems, according to some embodiments.

FIG. 24 shows a series of legacy baffles 2400 that can be improved for use in an LED lamp assembly adapted for magnetically mounted concentric baffles for LED lamp systems.

Figure 25A:
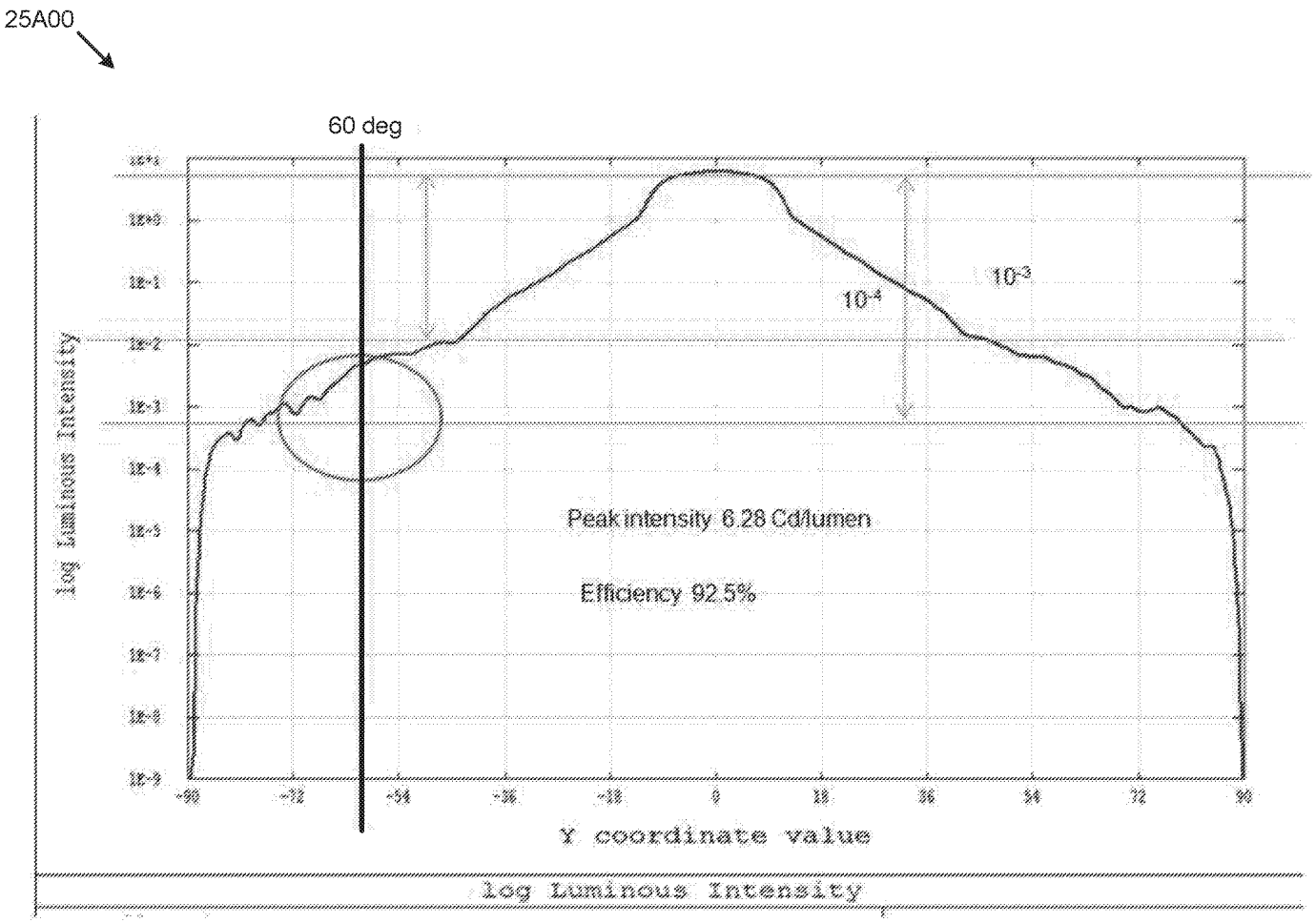
FIG. 25A is a chart showing the log distribution measurement of the intensity of the lamp without a baffle magnetically mounted concentric baffles for LED lamp systems, according to some embodiments.

FIG. 25A is a chart 25A00 showing the log distribution measurement of the intensity of the lamp without a baffle magnetically mounted concentric baffles for LED lamp systems.

It is desired to have the light at the low angles about the axis. This figure shows that some light is leaking to angles above 60 degrees.

Figure 25B:
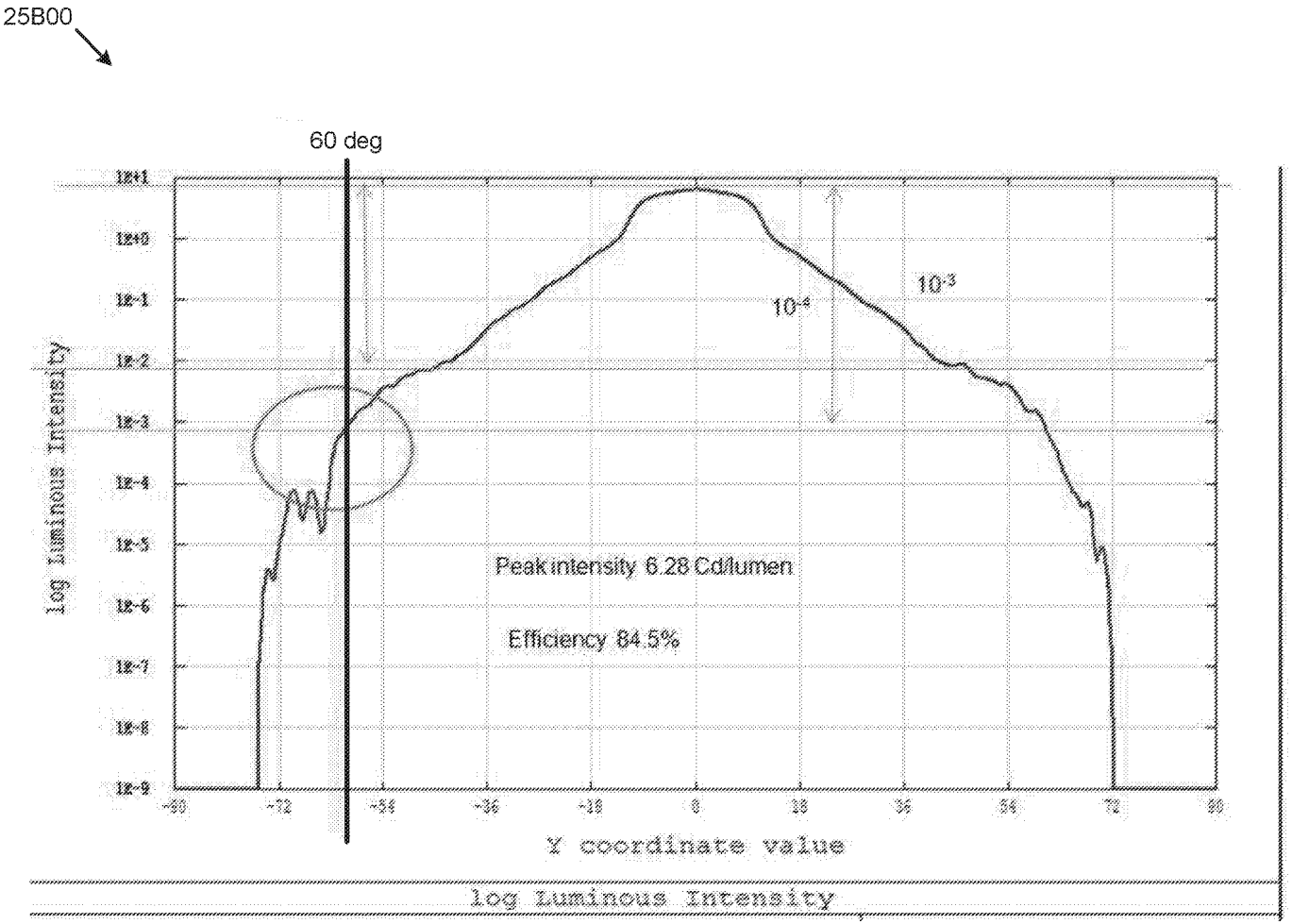
FIG. 25B is a chart showing the log distribution measurement of the intensity of the lamp with a baffle in an exemplary configuration using magnetically mounted concentric baffles for LED lamp systems, according to some embodiments.

FIG. 25B is a chart 25B00 showing the log distribution measurement of the intensity of the lamp with a baffle in an exemplary configuration using magnetically mounted concentric baffles for LED lamp systems.

FIG. 25B shows the light intensity with the concentric baffle mounted.

Figure 26:
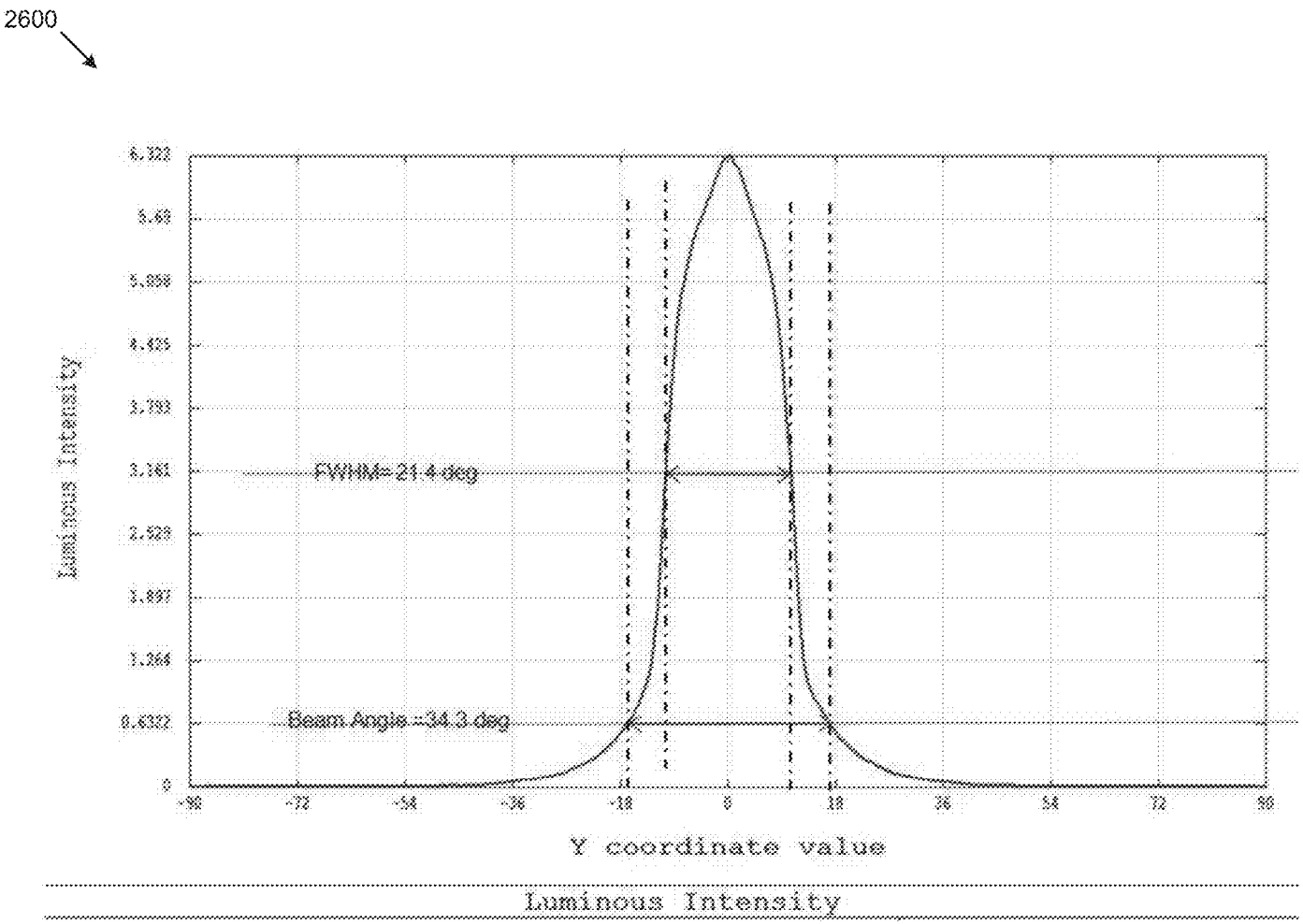
FIG. 26 is a chart showing beam and FWHM with no baffle, according to some embodiments.

FIG. 26 is a chart 2600 showing beam and FWHM with no baffle in an exemplary configuration of an LED lamp ready to use magnetically mounted concentric baffles for LED lamp systems.

The diagram shows beam and FWHM with no baffle. With the baffle these values do not change significantly.

Figure 27:
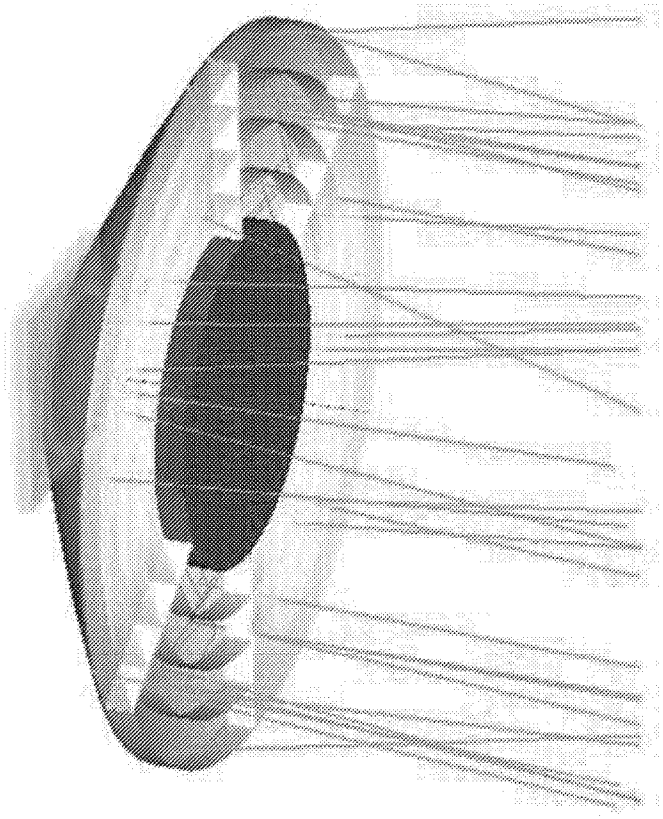
FIG. 27 exemplifies an LED lamp assembly having a magnetic mounting disk to implement magnetically mounted concentric baffles for LED lamp systems, according to some embodiments.

FIG. 27 exemplifies an LED lamp assembly 2700 having a magnetic mounting disk to implement magnetically mounted concentric baffles for LED lamp systems.

This figure shows an embodiment with a magnetic mounting disk (no center hole).

Figure 28:
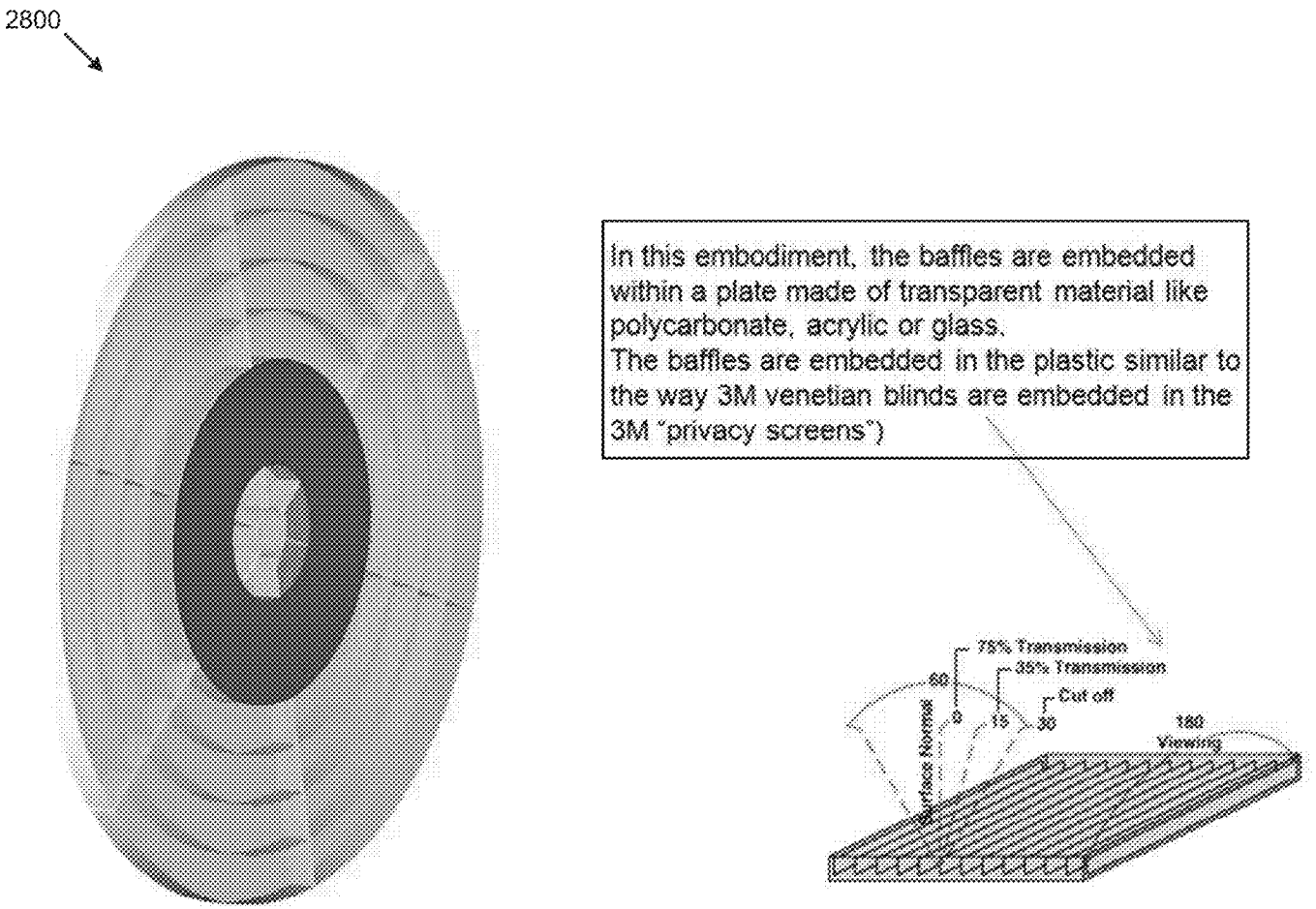
FIG. 28 exemplifies an assembly having embedded baffles for magnetically mounted concentric baffles for LED lamp systems, according to some embodiments.

FIG. 28 exemplifies an assembly 2800 having embedded baffles for magnetically mounted concentric baffles for LED lamp systems.

Figure 29:
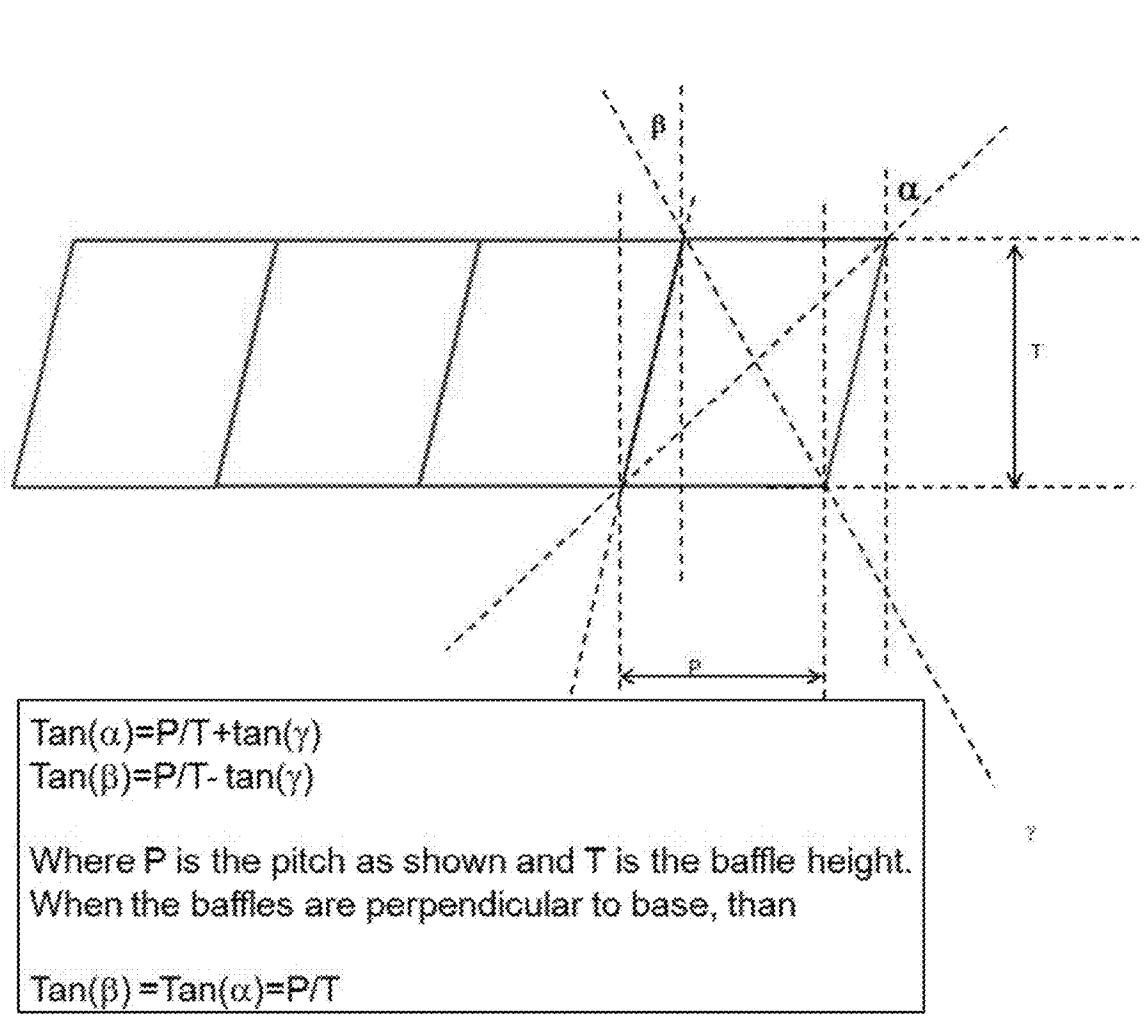
FIG. 29 is a diagram showing angles where baffles are used as angular low-pass filters in systems having magnetically mounted concentric baffles for LED lamp systems, according to some embodiments.

FIG. 29 is a diagram 2900 showing angles where baffles are used as angular low-pass filters in systems having magnetically mounted concentric baffles for LED lamp systems.

In this embodiment, the baffles are embedded within a plate made of transparent material such as polycarbonate, acrylic or glass. The baffles are embedded in the plastic similarly to the way 3M venetian blinds are embedded in the 3M "privacy screens"):

$$\mathrm{Tan}(a)=P/T+\tan(g)$$

$$\mathrm{Tan}(b)=P/T-\tan(g)$$

where P is the pitch as shown and T is the baffle height.

When the baffles are perpendicular to the base, then $$\mathrm{Tan}(b)=\mathrm{Tan}(a)=P/T$$

Figure 30:
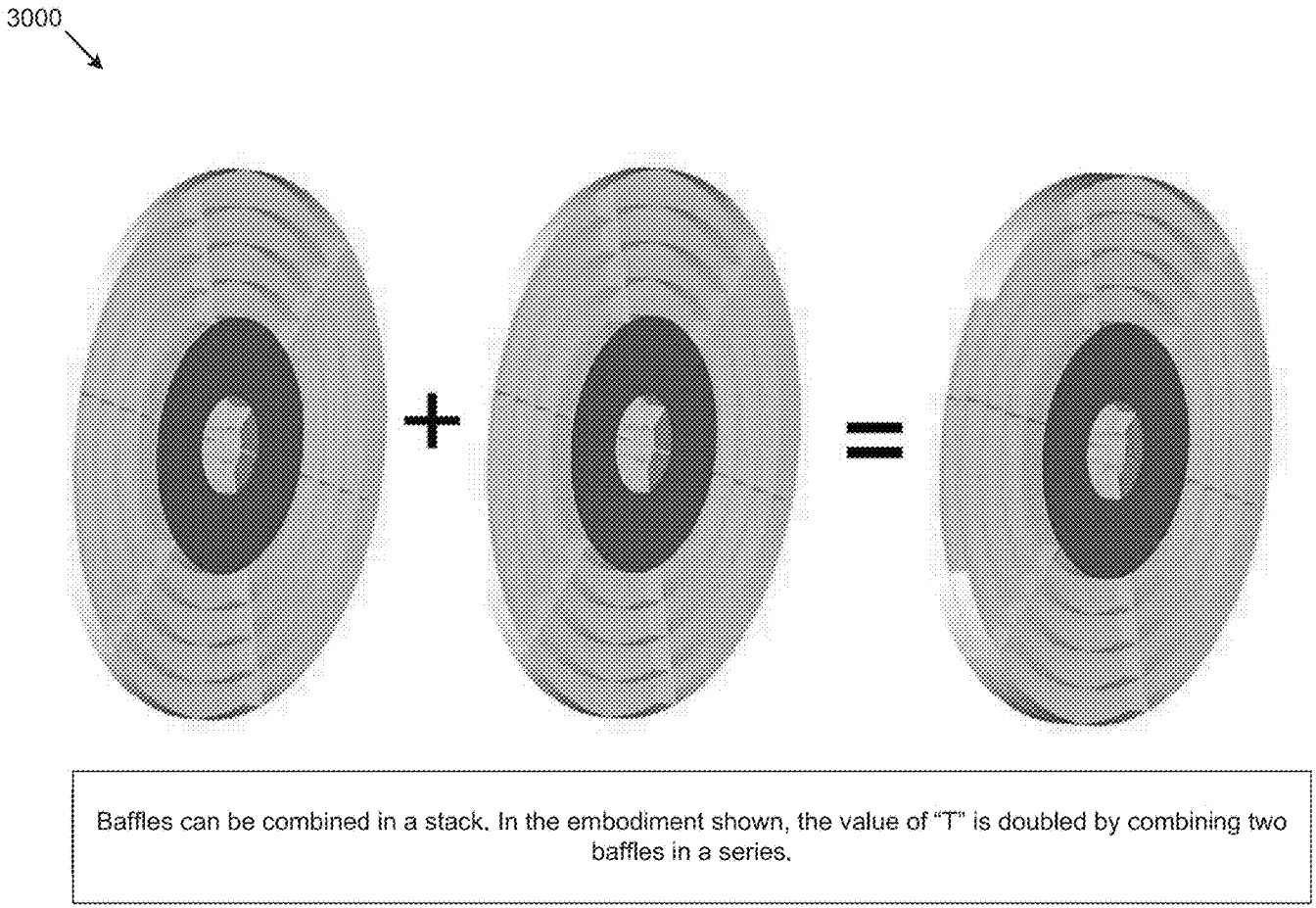
FIG. 30 is a diagram depicting extendable baffles for combining baffle effects in systems for magnetically mounted concentric baffles for LED lamp systems, according to some embodiments.

FIG. 30 is a diagram 3000 depicting extendable baffles for combining baffle effects in systems for magnetically mounted concentric baffles for LED lamp systems.

Baffles can be easily mounted on other baffles using the magnetic mount. The baffle is an angular low pass filter as shown on FIG. 29. In this example the value of T on FIG. 29 is doubled thus reducing the divergence angle.

Figure 31:
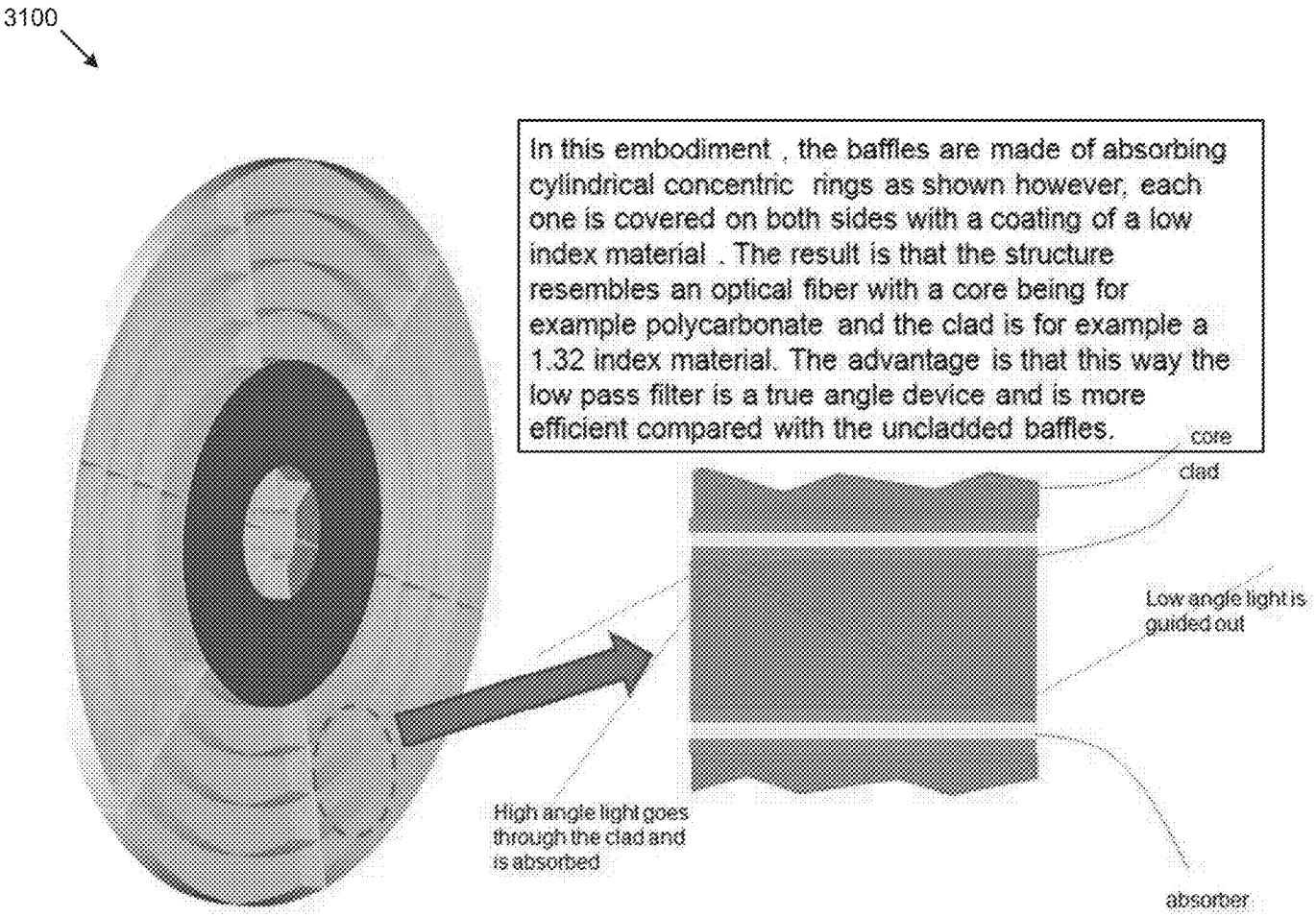
FIG. 31 shows a light process in a cladded baffle used in systems for magnetically mounted concentric baffles for LED lamp systems, according to some embodiments.

FIG. 31 shows a light process in a cladded baffle 3100 used in systems for magnetically mounted concentric baffles for LED lamp systems.

In this embodiment, the baffles are embedded within a plate made of transparent material such as polycarbonate, acrylic or glass. The baffles are embedded in the plastic similar to the way 3M venetian blinds are embedded in the 3M "privacy screens".

In this embodiment, the baffles are made of absorbing cylindrical concentric rings as shown however, each one is covered on both sides with a coating of a low index material. The result is that the structure resembles an optical fiber with a core being, for example, polycarbonate and the clad is, for example, a 1.32 index material. The advantage is that this way the low pass filter is a true angle device and is more efficient compared with uncladded baffles.

Figure 32:
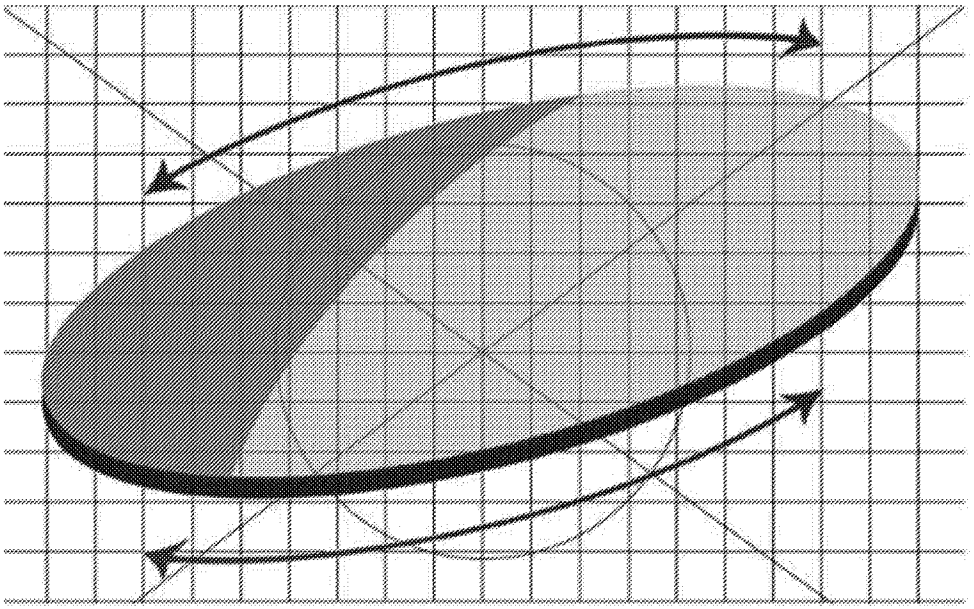
FIG. 32 shows a light process produced in a magnetically mounted reflective polarizer as used in systems for magnetically mounted concentric baffles for LED lamp systems, according to some embodiments.

FIG. 32 shows a light process produced in a magnetically mounted reflective polarizer 3200 as used in systems for magnetically mounted concentric baffles for LED lamp systems.

In this embodiment a magnetically mounted reflective polarizer is added to the lamp. This can be on top of other elements such as magnetically mounted baffles or it can be standalone. This produces a polarized light source that is beneficial for many applications. The advantage of using the wire grid polarizer (as, for example, the ones made by Moxtek Corporation), is that the polarizer can withstand high power densities and also serves as a polarization recycler where the reflected light is hitting the LED and scatters and some of it but will make it through on a second path. An additional retarder can be also used between the lamp and the polarizer and can be also magnetically mounted to improve recycling efficiency.

Figure 33:
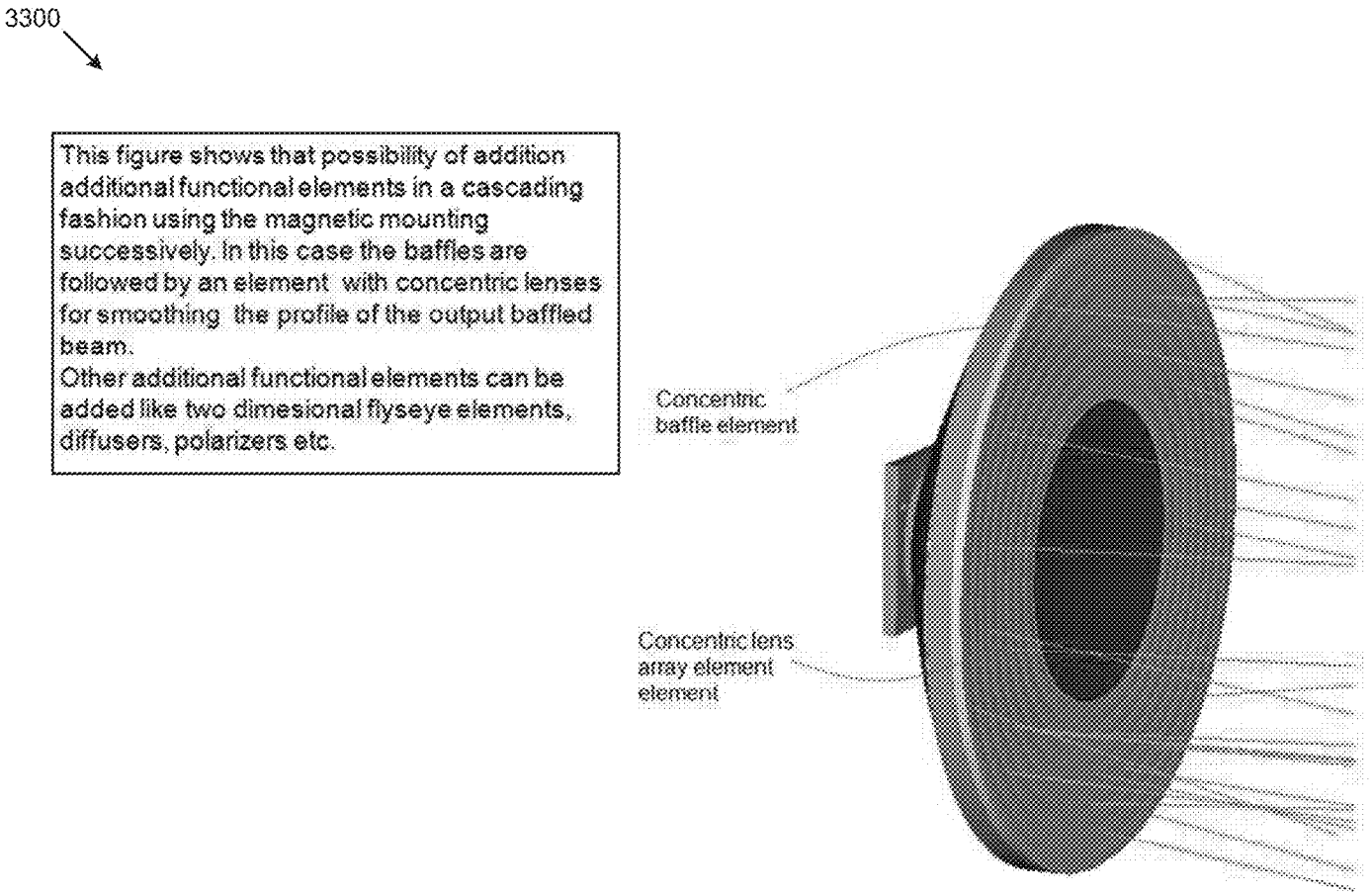
FIG. 33 is a diagram depicting one example of cascading baffles for combining baffle effects in systems for magnetically mounted concentric baffles for LED lamp systems, according to some embodiments.

FIG. 33 is a diagram 3300 depicting one example of cascading baffles for combining baffle effects in systems for magnetically mounted concentric baffles for LED lamp systems.

This figure shows the possibility of additional functional elements in a cascading fashion using the magnetic mounting successively. In this case the baffles are followed by an element with concentric lenses for smoothing the profile of the output baffled beam.

Other functional elements can be added such as two dimensional "flyseye" elements, diffusers, polarizers etc.

Figure 34:
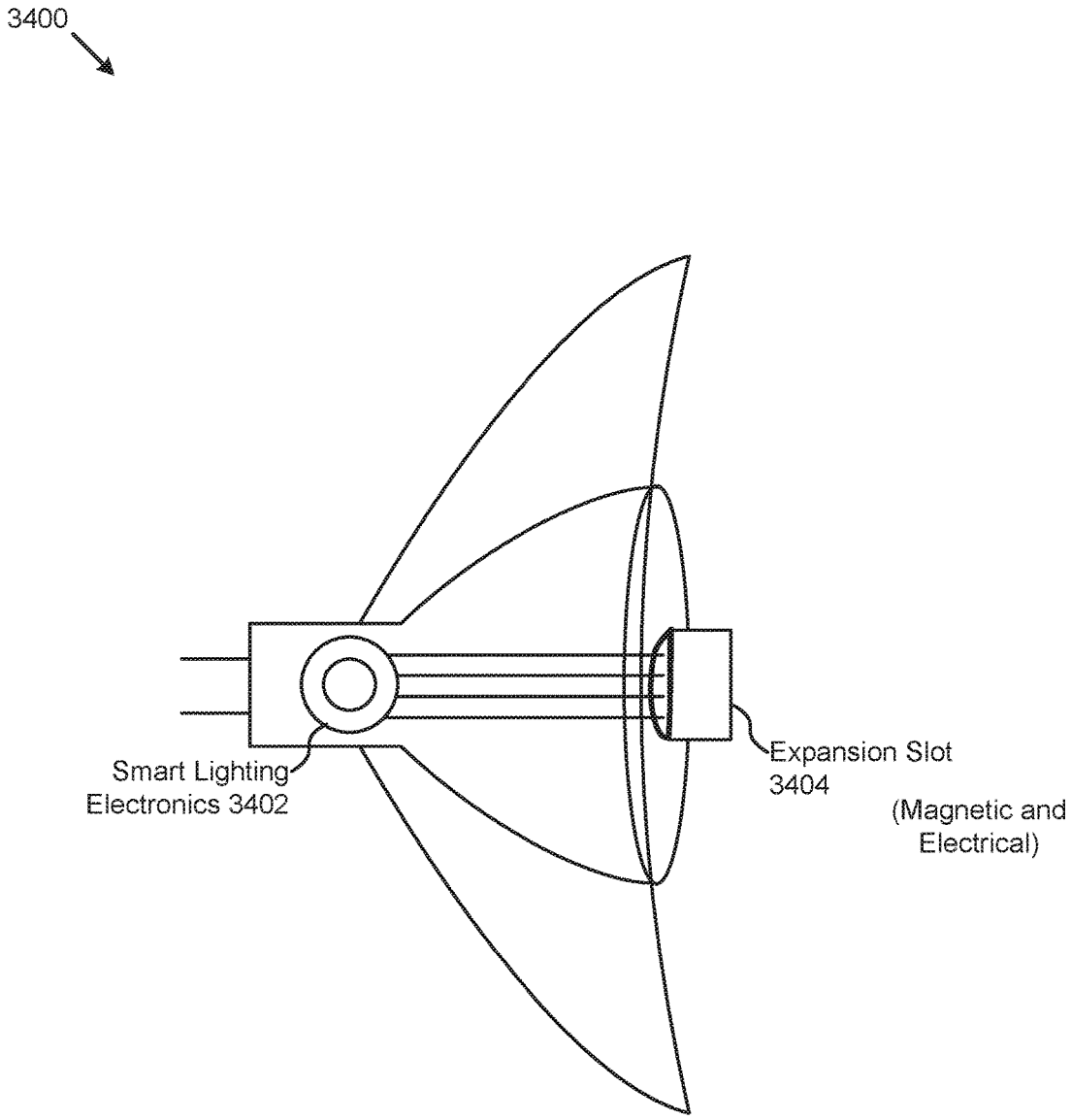
FIG. 34 superimposes profile shapes found in a range of lamp standards adapted to be used for providing active accessories in an LED lamp, according to some embodiments.

FIG. 34 superimposes profile shapes 3400 found in a range of lamp standards adapted to be used for providing active accessories in an LED lamp.

A home or business may have several lamp types installed. Creating a set of smart accessories that fit any/all of these lamp types, and communicate with each other and with a central computer in a consistent manner enables the consumer or business owner to monitor and control their environment efficiently and effectively. The accessories can have unique IDs and communicate with each other and a central computer using standard protocols like uPnP, DLNA, or other interoperable or interoperability protocols. By using an expandable approach (e.g., using smart buttons versus a pre-integrated one that has the intelligence built into each lamp) allows the lamps to be integrated into any operational environment of building management systems or smart lighting systems using a choice of smart buttons, and without having to replace the lamps.

Figure 35:
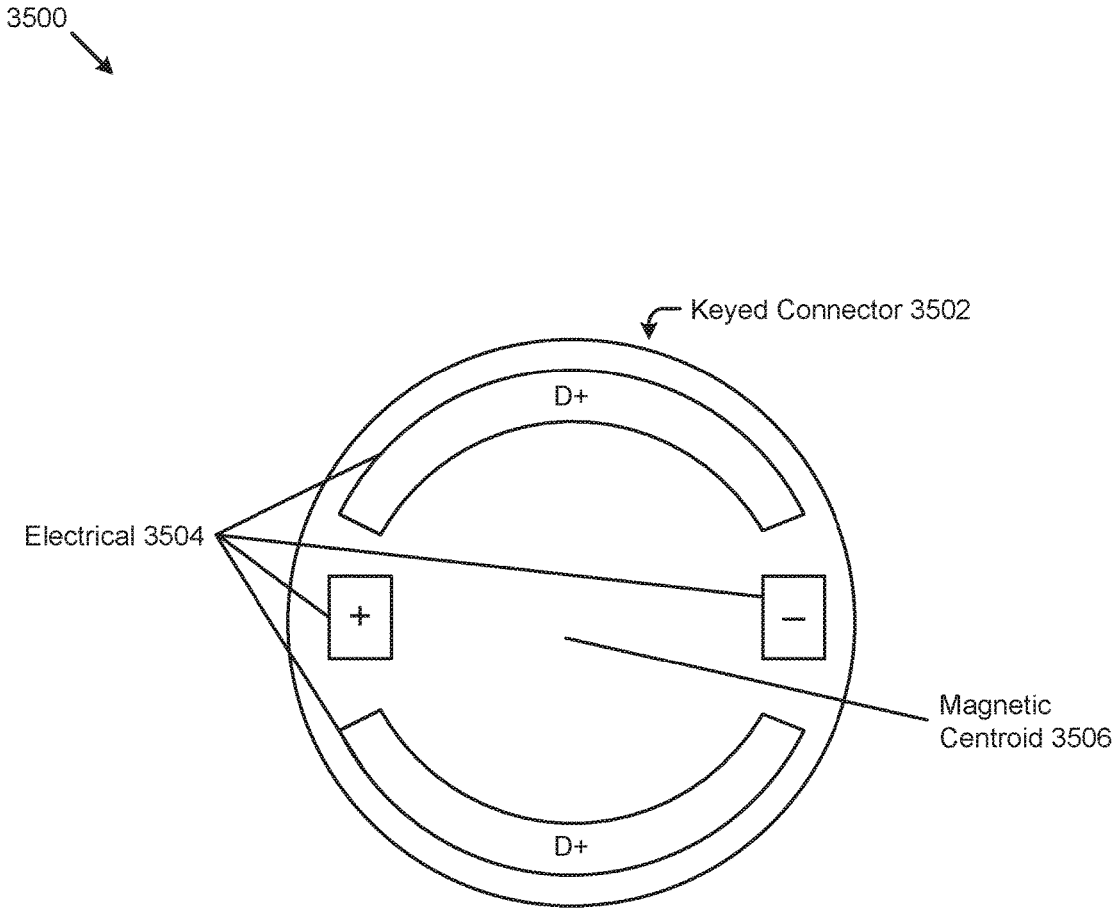
FIG. 35 is a top view of a hybrid connector adapted to be used for providing active accessories in an LED lamp, according to some embodiments.

FIG. 35 is a top view of a hybrid connector 3500 adapted to be used for providing active accessories in an LED lamp.

A standard interface like a universal serial bus (USB) can be implemented using a simple connector with four or five terminals that carry power and data. USB provides the opportunity to leverage the vast ecosystem of systems and devices that have been built over the past few decades for PCs, CE devices, smartphones, etc., as well as the continuous evolution of the interface to accommodate new usages for consumers and businesses.

Figure 36:
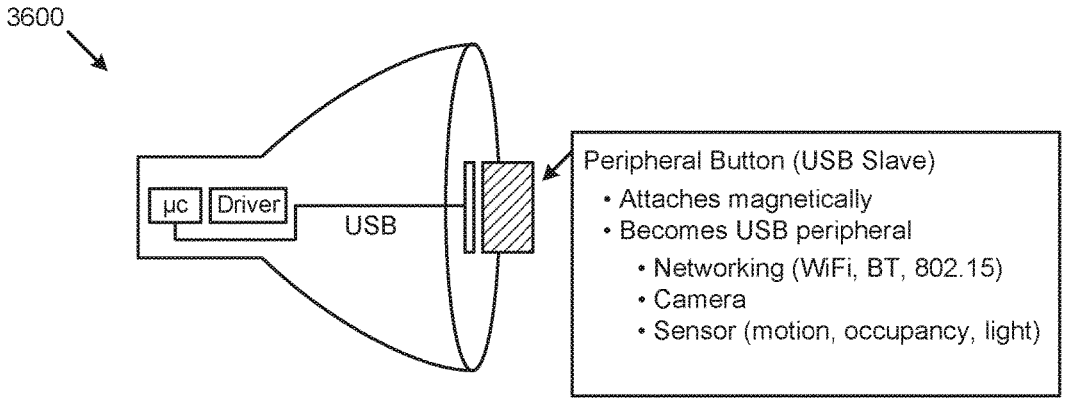
FIG. 36 is a side view of a hybrid connector adapted to be used as a USB slave device for providing active accessories in an LED lamp, according to some embodiments.

FIG. 36 is a side view of a hybrid connector 3600 adapted to be serve as a USB connector for a slave device in an LED lamp.

A lamp can be built with a standard microcontroller or microprocessor with associated software, and with or without persistent connectivity to other devices or a central computer. The microcontroller or microprocessor can be used for internal lamp functions like controlling the LED driver, storing operational data like hours of usage, current and temperature data, etc. By attaching a smart USB slave button, the functionality of the lamp can be extended to include wireless communication to other lamps and a central computer for lamp monitoring and control, connection to peripheral devices like a camera and sensors.

Figure 37:
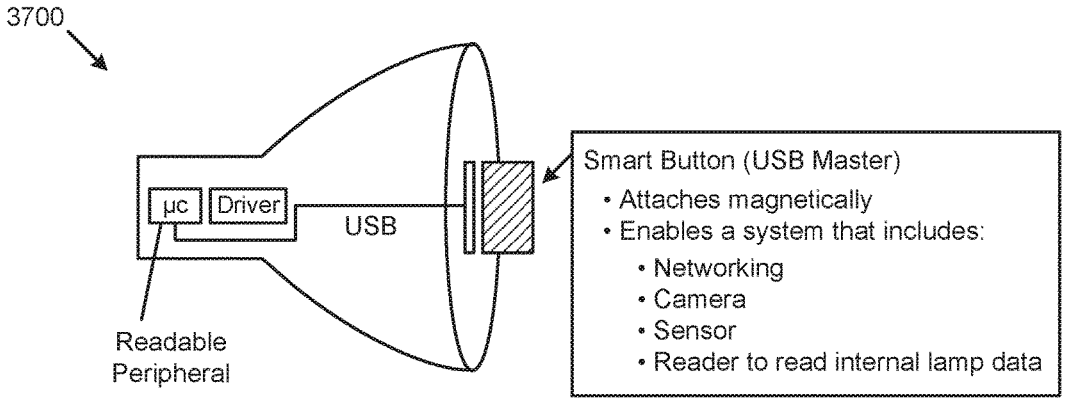
FIG. 37 is a side view of a hybrid connector adapted to be used as a USB master device for providing active accessories in an LED lamp, according to some embodiments.

FIG. 37 is a side view of a hybrid connector 3700 adapted to be used as a USB master device for providing active accessories in an LED lamp.

A lamp can be built even without a microcontroller or microprocessor, yet supporting a simple USB-based readable storage that stores operational data of the lamp like hours of usage, current and temperature data, etc. Once a smart USB master button that has a microcontroller or microprocessor is connected to the lamp, that USB device can be read by the microcontroller or microprocessor on the smart button. The smart button can also integrate wireless networking to implement lamp monitoring and control, and can communicate with other lamps and/or can communicate with a central computer. It may also contain a camera and/or other sensors.

Figure 38:
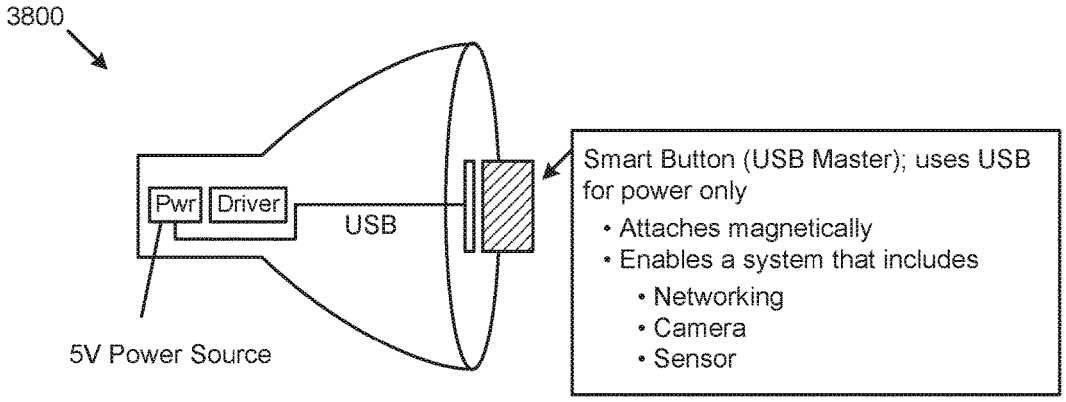
FIG. 38 is a side view of a hybrid connector adapted to be used as a power delivery device for providing active accessories in an LED lamp, according to some embodiments.

FIG. 38 is a side view of a hybrid connector 3800 adapted to be used as a power delivery device for providing active accessories in an LED lamp.

A lamp can be built with a device that provides power to the smart button connector. When a smart USB master button that has a microcontroller or microprocessor is connected to the lamp, the lamp can be turned into a smart lamp. The smart button can integrate wireless networking to implement lamp monitoring and control and communication with other lamps and a central computer. It may also contain a camera and sensors. It may also contain readable storage that stores operational data of the lamp such as hours of usage, current and temperature data, etc.

One embodiment disposes accessories on the face of the lamp, in a proximity that is thermally isolated from the heat source and high temperatures of the LED. In exemplary embodiments, the face of the lamp is open to the environment so as to facilitate heat dissipation of any electronics. Face-mounting further facilitates antenna placement (e.g., for wireless radio operation), and for camera and sensor operation. It also makes it easy to connect and disconnect accessories.

A well-known example of a color filter on a spot lamp is a correlated color temperature (CCT) shifting filter. Such filters rebalance the distribution of the lamp's spectral power distribution (SPD), typically by absorbing a fraction of the SPD which results in a shift of CCT. However, CCT is merely one characteristic of the SPD which can be modified by applying a filter. Other properties related to the quality of light include:

- Color fidelity (for instance the value of the color rendering index of other fidelity value).
- Color saturation (for instance the value of the CQS Qg or other gamut value).
- Color shift of a specific object.
- White point chromaticity (for instance, off-Planckian chromaticity).

The following paragraphs discuss some of these properties and show how they can be modified by applying filters, according to embodiments of the invention. The following discussions make use of color metrics defined in the Color Quality Scale metric. The numerical values pertain to the most current version of this metric, i.e., version 9.0.

One possible quality of light metric is the gamut of the light source. To illustrate gamut enhancement, consider the methodology of using the 15 reflectance samples of the Color Quality Scale, then compute their chromaticity in CIELAB space under illumination by various sources and consider the gamut of the resulting points. This methodology is referred to as Qg in the Color Quality Scale.

Figure 39:
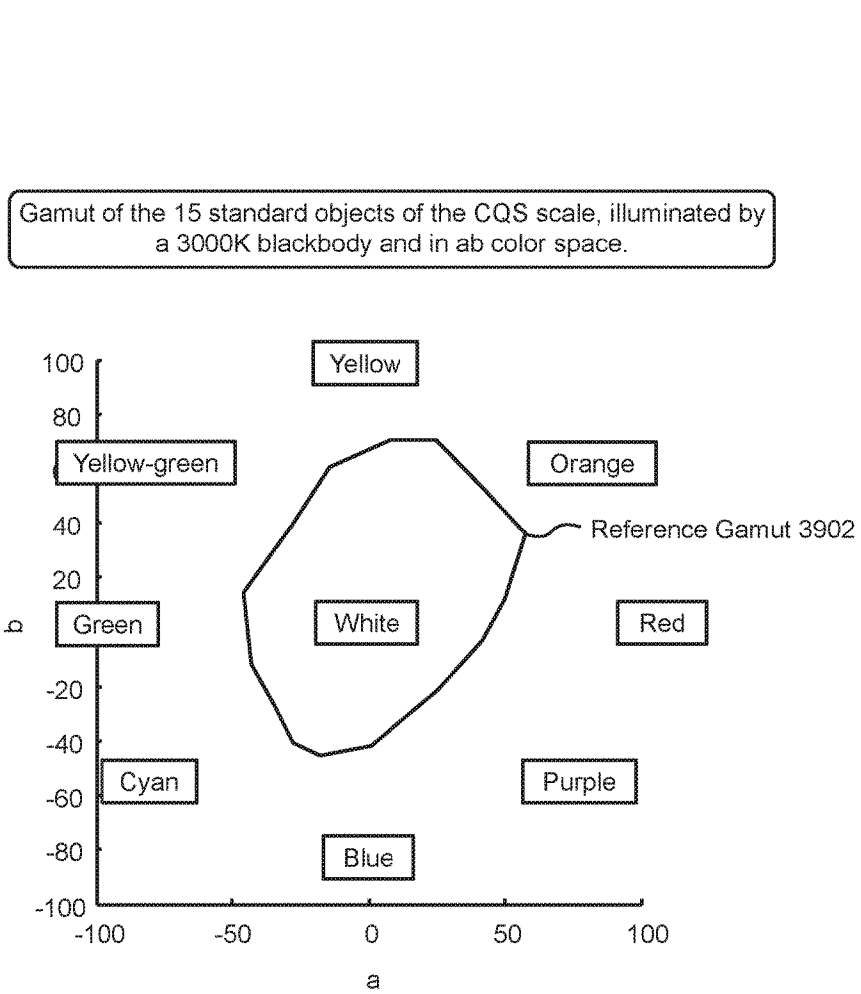
FIG. 39 shows, as an example, the gamut for a blackbody radiator with a correlated color temperature (CCT) of 3000K for comparison with LED lamps with improved quality of light.

FIG. 39 shows, as an example, the gamut for a blackbody radiator with a correlated color temperature (CCT) of 3000K. The objects are distributed around the white point, and cover various hues. These hues are indicated by labels on the figure. The distance between the origin and each object is a measure of its saturation—objects farther from the origin correspond to a higher saturation, which can be desirable. The reference gamut 3902 is shown here and in several following figures.

Figure 40:
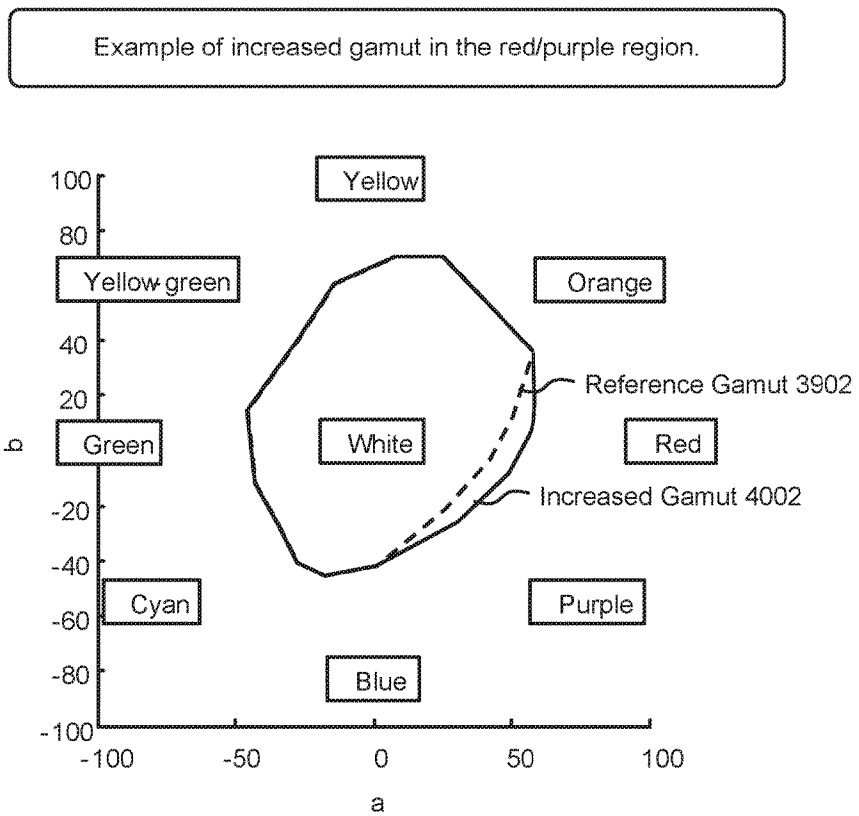
FIG. 40 shows the diagram of FIG. 39 where an exemplary increased gamut is also shown for comparison.

FIG. 40 shows the same diagram as FIG. 39 where an exemplary increased gamut is also shown for comparison to the reference gamut 3902. It can be seen that the increased gamut 4002 covers a larger area than the reference gamut. Specifically, the gamut is increased in the purple and red region. A source with a CCT of 3000K which has this gamut will show more saturated reds and purples than a blackbody radiator.

In the following, various sources are considered and compared to blackbody radiators of the same CCT. Also illustrated are the gamut enhancement as in FIG. 40. In some cases, it is desirable to increase the overall gamut of the source in order to obtain more saturated colors. This can be useful in applications such as retail, where consumers appreciate goods with saturated colors. This can be measured by a metric such as Qg.

Figures 41A, 41B:
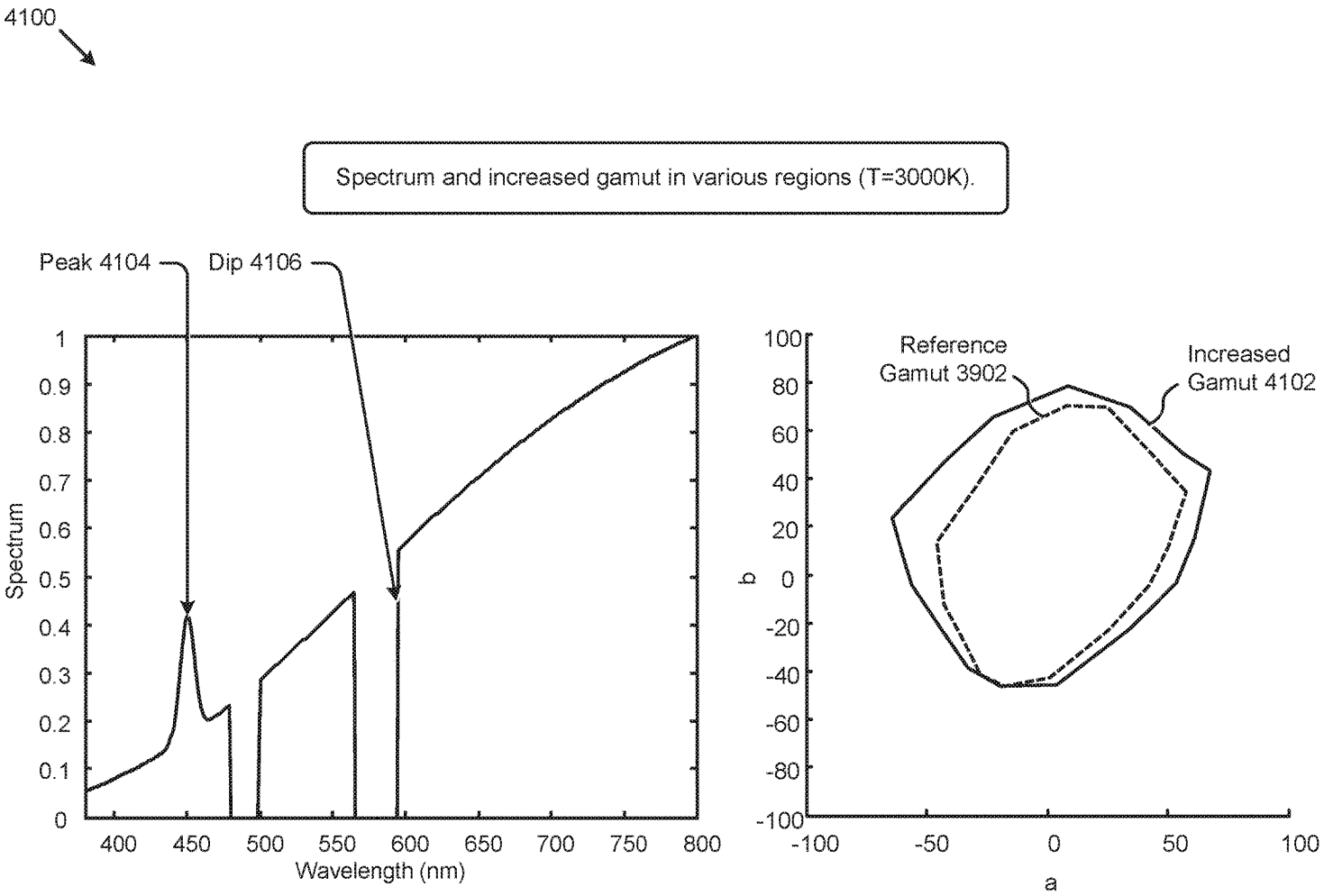
FIG. 41A shows an example of a spectrum with an increased overall gamut, according to some embodiments.
FIG. 41B is a chart showing the CIELAB color space and the position of various colored objects illuminated by a reference source forming a reference gamut and the spectrum of FIG. 41A forming an increased gamut, for comparison, according to some embodiments.

FIG. 41A shows an example of a spectrum with an increased overall gamut. The spectrum resembles a blackbody radiator with a CCT of 3000K, with additional dips 4106 and peaks 4104. These dips and peaks may be obtained by choosing the light-emitting elements (phosphor, LEDs) and, if needed, by additional filtering. The dips shown on this figure are very sharp, but this is not a necessary property—in some cases smoother dips provide a similar gamut increase. The corresponding increased gamut is also shown on FIG. 41B, and compared to a reference gamut. The increased gamut 4102 has Qg=134 whereas the reference gamut has Qg=100.

FIG. 41B is a chart showing the CIELAB color space and the position of various colored objects illuminated by a reference source forming a reference gamut and the spectrum of FIG. 41A forming an increased gamut 4102 for comparison.

Figure 42A:
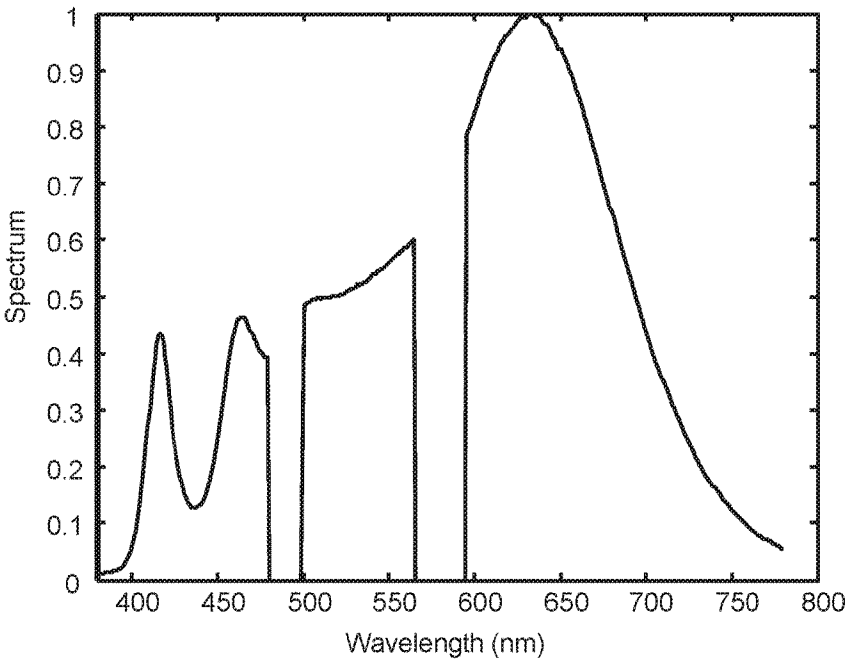
FIG. 42A is a chart showing the calculated SPD of an LED lamp having an increased gamut, according to some embodiments.

FIG. 42A is a chart showing the calculated SPD of an LED lamp having an increased gamut.

Figure 42B:
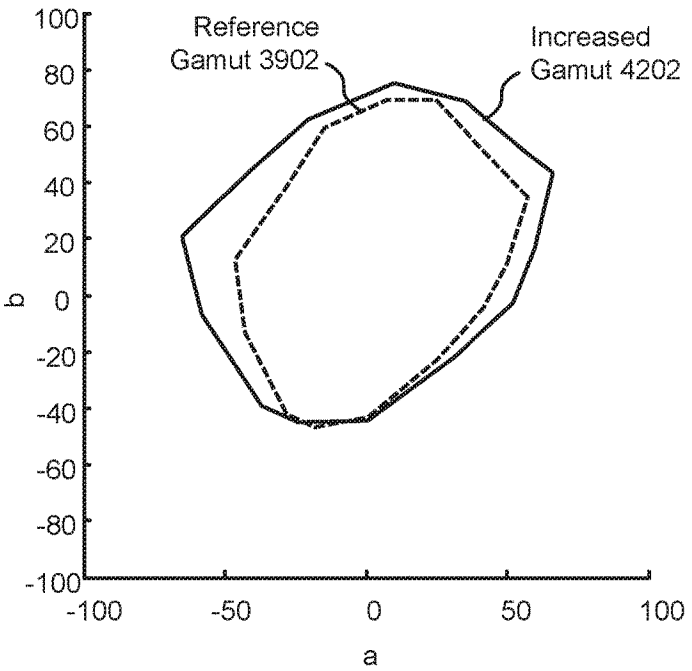
FIG. 42B shows the corresponding gamut, for comparison, according to some embodiments.

FIG. 42B shows the corresponding gamut for comparison.

FIG. 42A and FIG. 42B show another source with very similar gamut properties to FIG. 41A and FIG. 41B. Here however, the spectrum resembles an LED spectrum with additional dips and peaks. The spectrum contains a pronounced violet peak at 415 nm. The increased gamut 4202 has Qg=133.

Figures 43A, 43B:
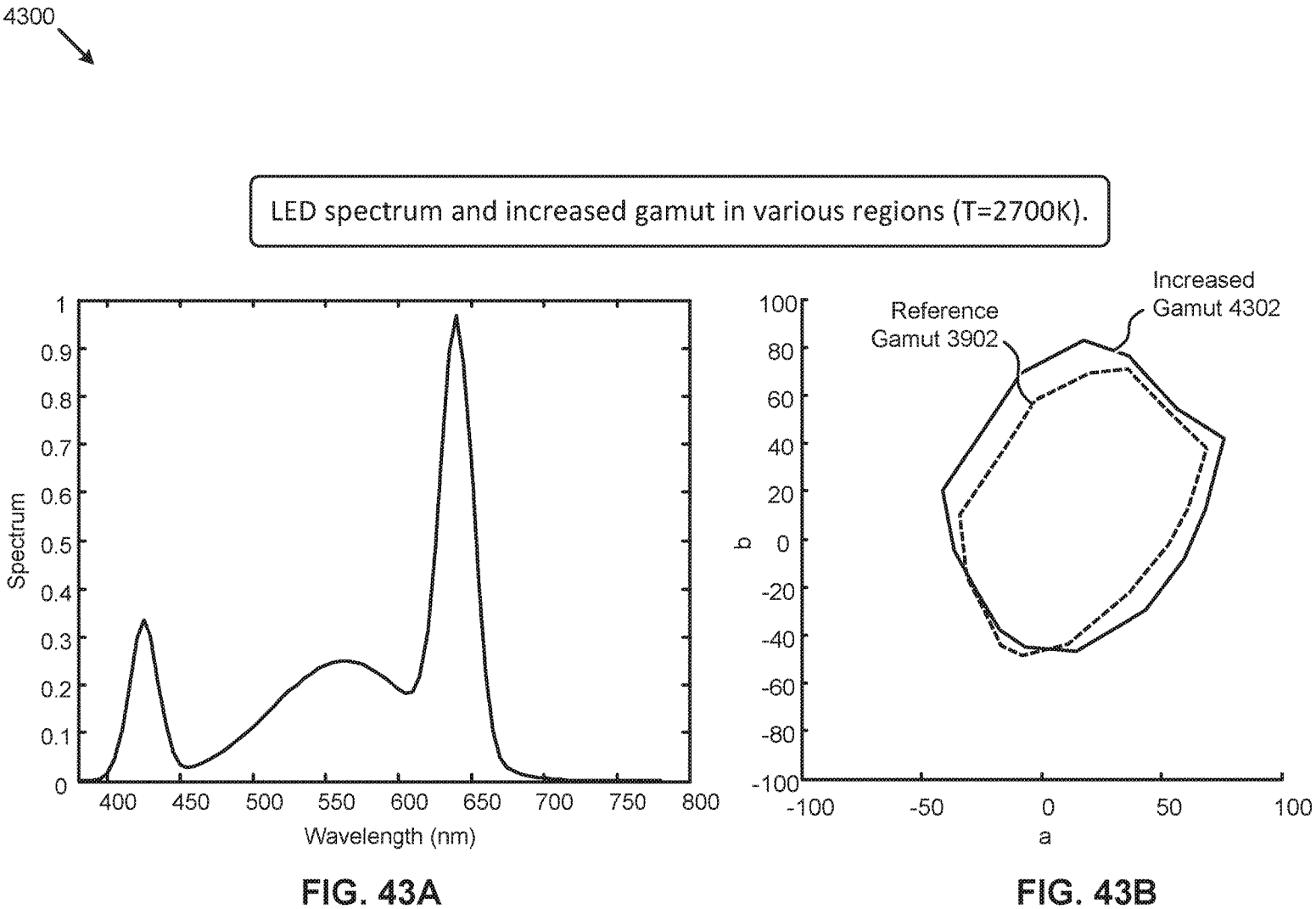
FIG. 43A is a chart showing the calculated SPD of an LED lamp having an increased gamut, according to some embodiments.
FIG. 43B shows the corresponding gamut, for comparison, according to some embodiments.

FIG. 43A is a chart showing the calculated SPD of an LED lamp having an increased gamut.

FIG. 43B shows the corresponding gamut.

FIG. 43A and FIG. 43B show yet another source with increased gamut 4302 and with a spectrum which resembles an LED spectrum. Here only peaks are present in the spectrum, and their width and position is chosen to increase the gamut. These peaks may correspond to a mixture of LED emission spectra and of phosphor emission spectra. The increased gamut 4302 has Qg=131.

In other cases, one does not seek to increase saturation for all colors but rather for a limited set of colors, which are then rendered more preferably. For instance, in some embodiments the SPD is modified in order to increase saturation specifically for yellow or red objects. In other embodiments the SPD is modified in order to increase the saturation of human skin of a given ethnicity, or to increase the red content in the rendering of said skin tone. A possible metric for such cases is the chromaticity shift of a given reflectance sample.

In some preferred embodiments of the invention, the increased saturation occurs for warm colors such as red, orange, pink rather than in colors such as yellow and blue. This is useful because end users frequently value warm colors the most.

In some preferred embodiments, the SPD of the invention is designed such that the skin of a given ethnicity (such as Caucasian) has increased saturation, either directly radial (redder) or in a slightly non-radial direction (red-yellow). In one preferred embodiment, the skin of a Caucasian ethnicity undergoes a chromatic shift which is substantially along the b* direction of the CIELAB space.

Figures 44A, 44B:
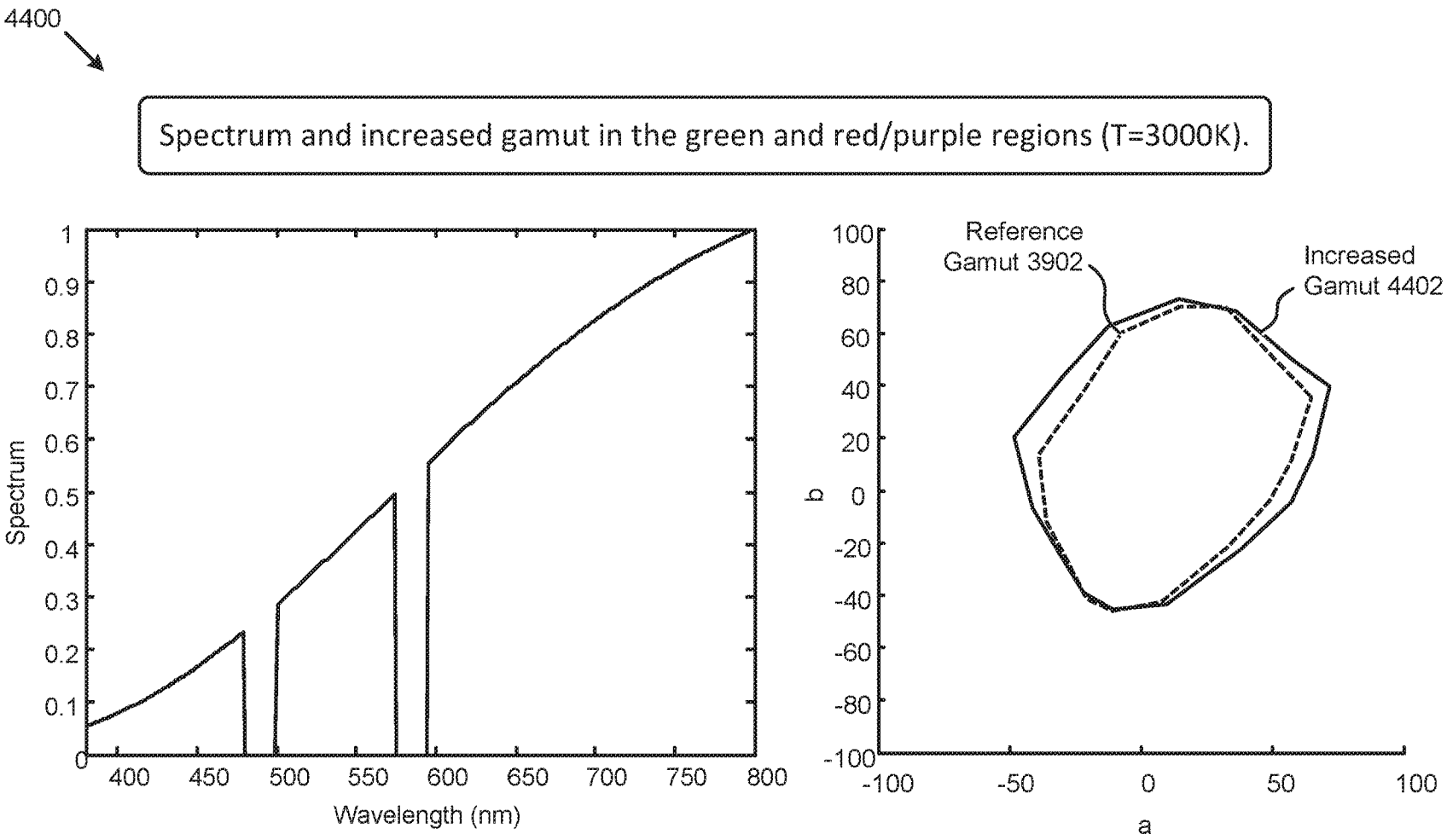
FIG. 44A is a chart showing the calculated SPD of an LED lamp having an increased gamut, according to some embodiments.
FIG. 44B shows the corresponding gamut, for comparison, according to some embodiments.

FIG. 44A is a chart showing the calculated SPD of an LED lamp having an increased gamut.

FIG. 44B shows the corresponding gamut.

FIG. 44A and FIG. 44B show an example of a spectrum with increased gamut 4402 in the green and red/purple regions. The spectrum resembles a blackbody radiator with additional dips.

Figures 45A, 45B:
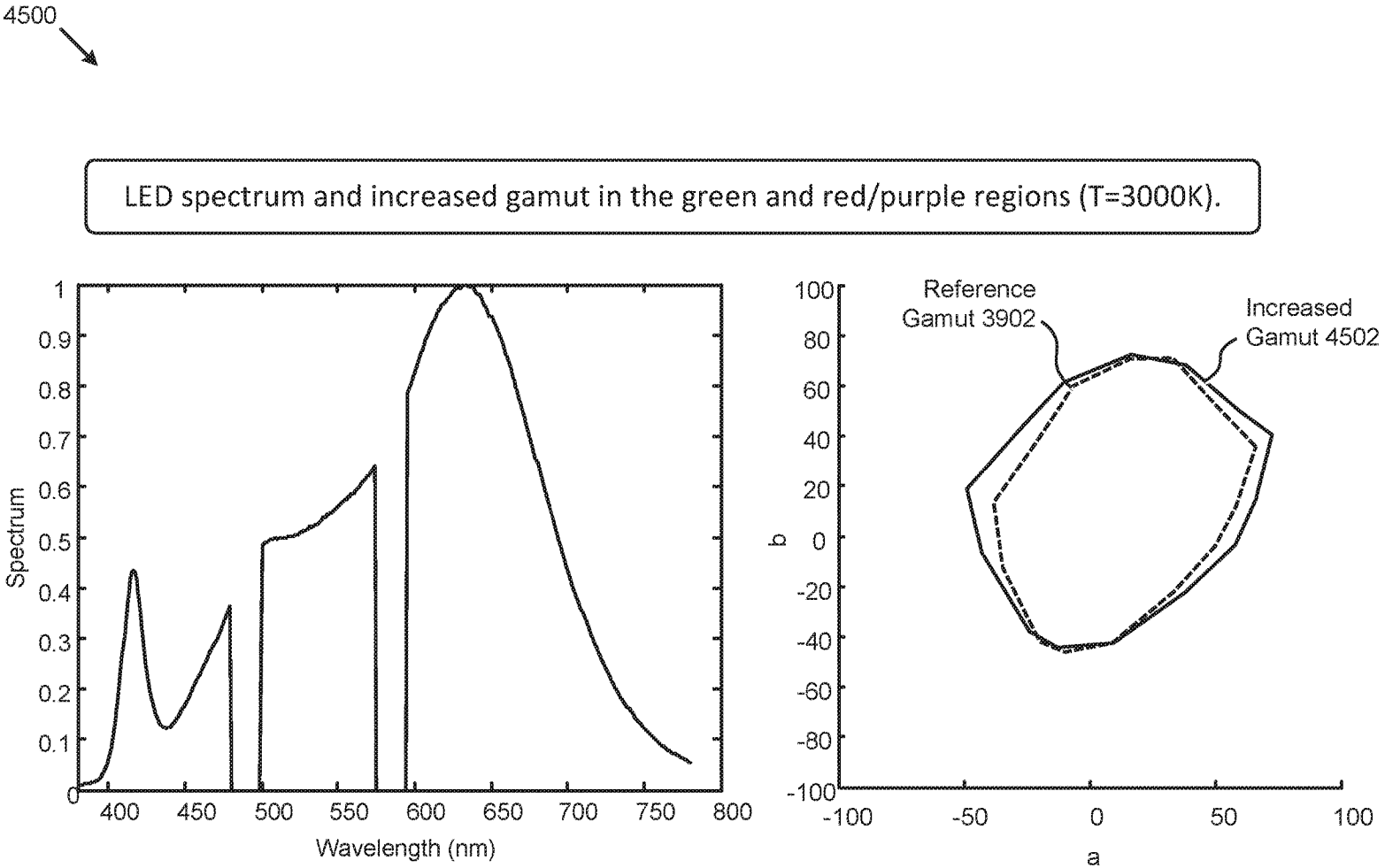
FIG. 45A is a chart showing the calculated SPD of an LED lamp having an increased gamut, according to some embodiments.
FIG. 45B shows the corresponding gamut, for comparison, according to some embodiments.

FIG. 45A is a chart showing the calculated SPD of an LED lamp having an increased gamut.

FIG. 45B shows the corresponding gamut.

FIG. 45A and FIG. 45B show another source with very similar gamut properties (e.g., increased gamut 4502). Here however, the spectrum resembles an LED spectrum with additional dips.

Figures 46A, 46B:
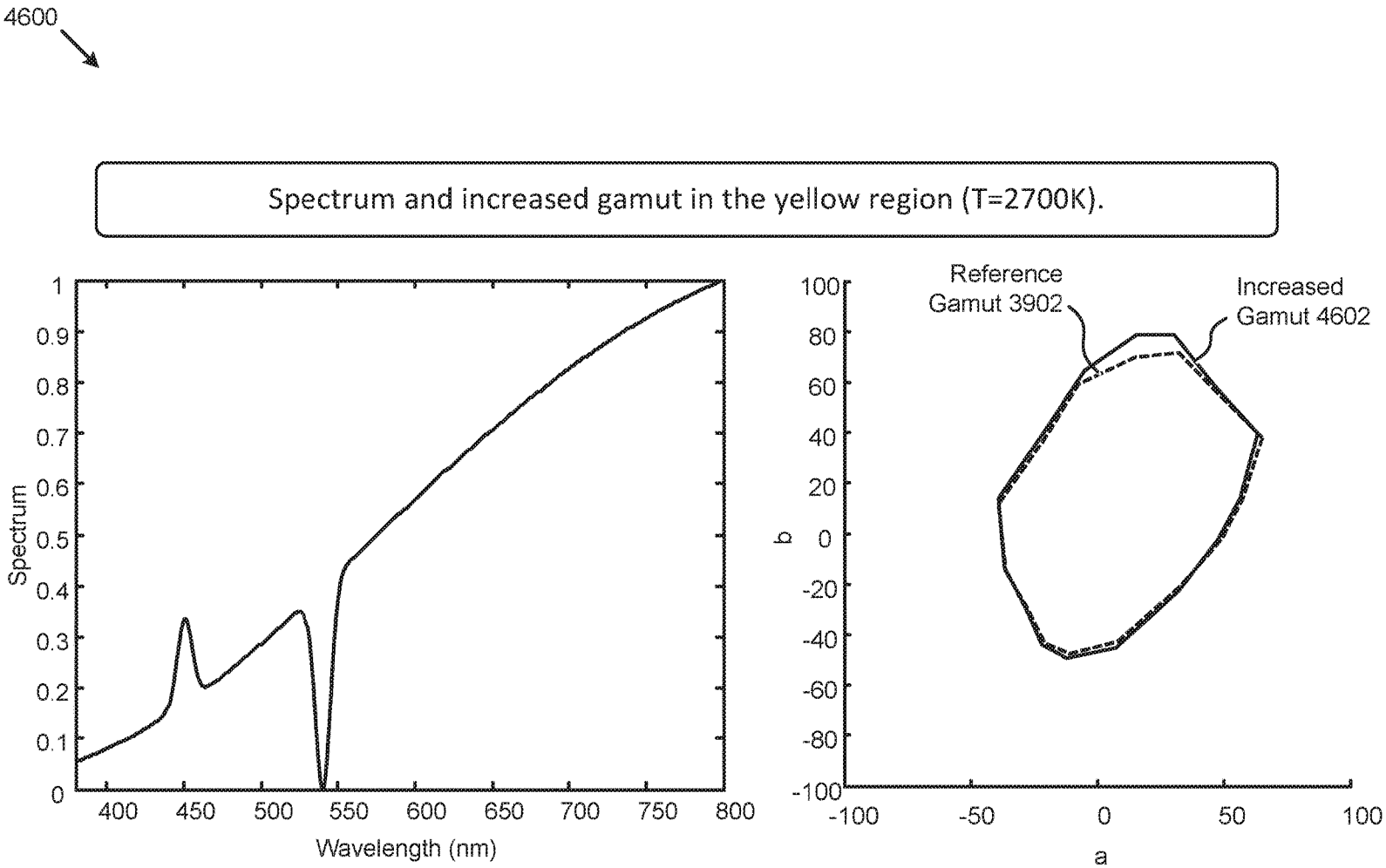
FIG. 46A is a chart showing the calculated SPD of an LED lamp having an increased gamut, according to some embodiments.
FIG. 46B shows the corresponding gamut, for comparison, according to some embodiments.

FIG. 46A is a chart showing the calculated SPD of an LED lamp having an increased gamut.

FIG. 46B shows the corresponding gamut.

FIG. 46A and FIG. 46B shows an example of a spectrum with increased gamut in the yellow region (e.g., increased gamut 4602). The spectrum resembles a blackbody radiator with additional dips and peaks.

Figure 47A:
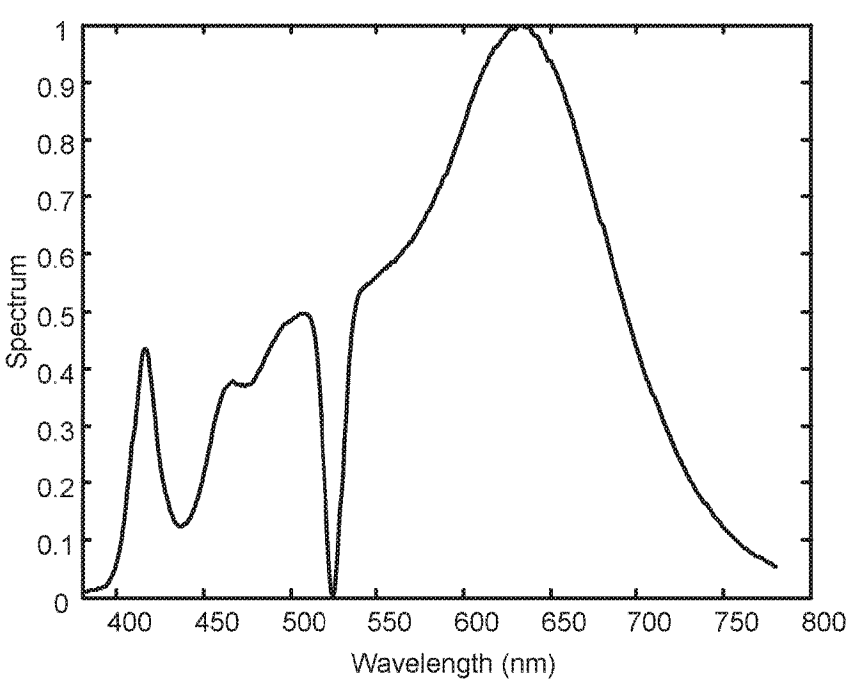
FIG. 47A is a chart showing the calculated SPD of an LED lamp having an increased gamut, according to some embodiments.

FIG. 47A is a chart showing the calculated SPD of an LED lamp having an increased gamut.

Figure 47B:
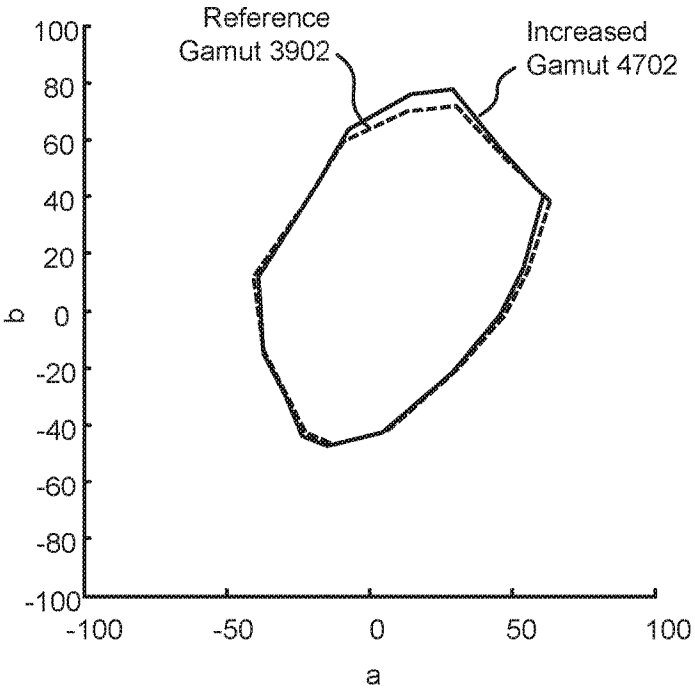
FIG. 47B shows the corresponding gamut, for comparison, according to some embodiments.

FIG. 47B shows the corresponding gamut.

FIG. 47A and FIG. 47B show another source with similar gamut properties (e.g., increased gamut 4702). Here however, the spectrum resembles an LED spectrum with additional dips and peaks.

While the previous examples were provided for warm-white spectra (CCT of about 2700-3000K), the same approach can be used for any CCT. For instance, if a CCT of 5000K is desired, the spectrum may be designed to increase the gamut.

Figures 48A, 48B:
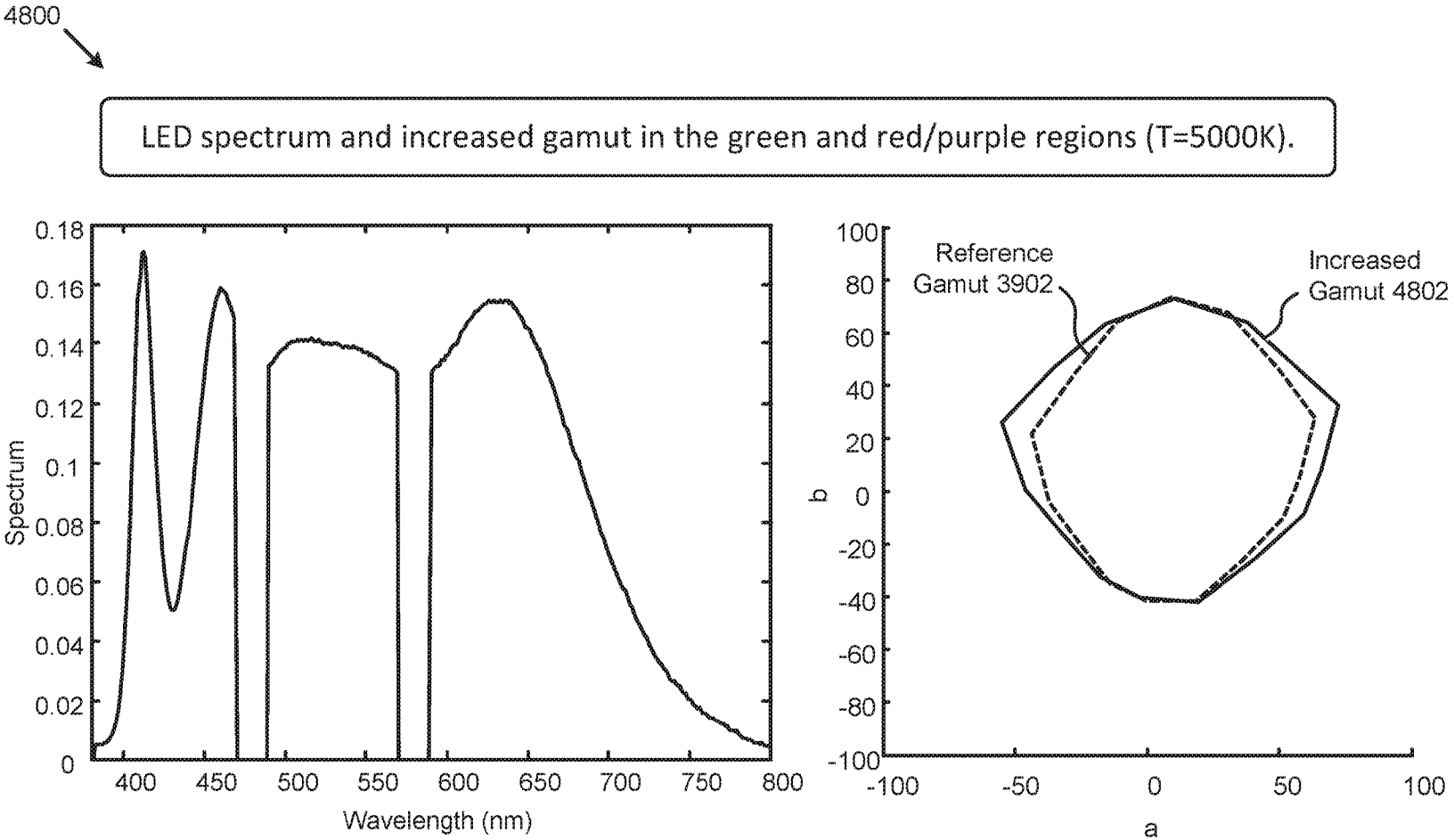
FIG. 48A is a chart showing the calculated SPD of an LED lamp having an increased gamut, according to some embodiments.
FIG. 48B shows the corresponding gamut, for comparison, according to some embodiments.

FIG. 48A is a chart showing the calculated SPD of an LED lamp having an increased gamut.

FIG. 48B shows the corresponding gamut.

FIG. 48A and FIG. 48B show a source with a CCT of about 5000K. The spectrum resembles an LED spectrum, with additional dips and peaks. The increased gamut 4802 has Qg=116.

In some cases, a large color contrast between two objects is desired. For instance in medical settings, some diagnoses are formulated by considering the color difference between two tissues (in the case of skin conditions) or the color difference between oxygenated and non-oxygenated blood (diagnosis of cyanosis). Again, modifications in the spectrum similar to those described above can be designed to meet such a requirement. Here, rather than increasing the gamut, one may seek to increase the color distance between the two objects.

In the particular case of diagnosis of cyanosis, relevant metrics are the cyanosis observation index (COI) defined in Standard AZ/NZS 1680.2.5:1997, and the CCT. According to Standard AZ/NZS 1680.2.5:1997, it is recommended that a source have 3300K<CCT<5300K and that the COI be no greater than 3.3, with lower COI values being preferred.

Figure 49:
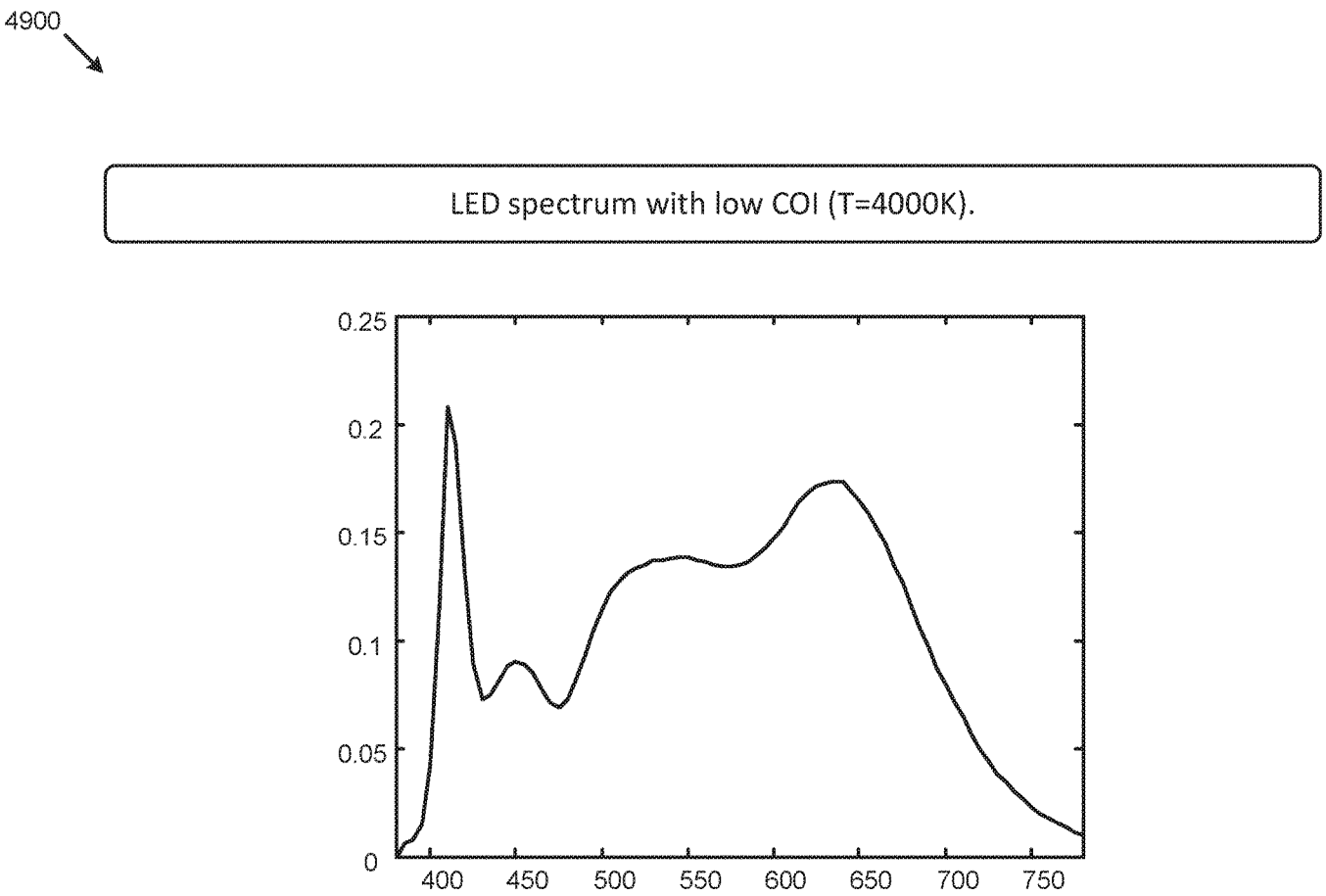
FIG. 49 is a chart showing the calculated SPD of an LED lamp having a CCT of 4000K and a low COI, according to some embodiments.

FIG. 49 shows a spectrum, according to such an embodiment, which spectrum has been designed (including the spectra of the phosphors and the amount of violet light) to obtain a low COI value of 0.59 and a CCT of 4000K.

The above discussion pertains to the rendering of various colors. In addition to color rendering, it is also possible to optimize the chromaticity (e.g., the white point) of the disclosure. Indeed, for a case where high fidelity is not required, there is more freedom in setting the chromaticity of the source. For instance it has been shown that sources with a chromaticity below the blackbody locus were preferred in some cases. For instance, a chromaticity located at Duv ~10 points below the blackbody locus can be preferred.

Figure 50B:
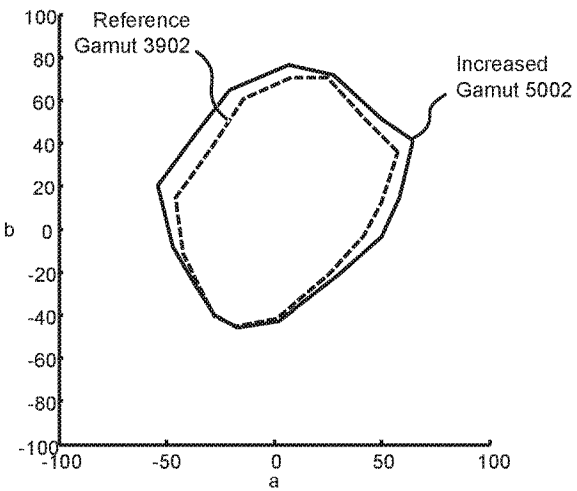
FIG. 50B is a chart showing the CIELAB color space and the position of various colored objects illuminated by a reference source forming a reference gamut and the spectrum of FIG. 26 forming an increased gamut for comparison.
Figure 50C:
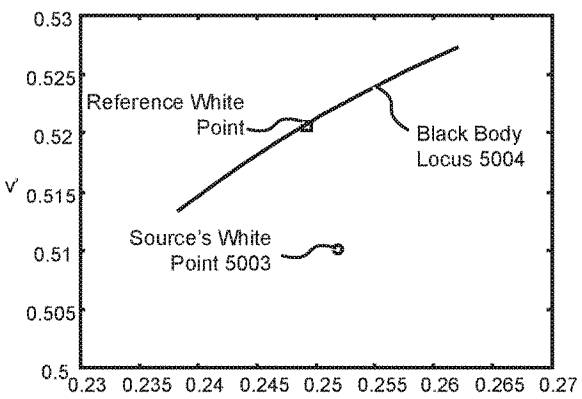
FIG. 50C is a chart showing the CIELUV (u'v') color space and the chromaticities of a reference illuminant, for comparison.
Figure 50A:
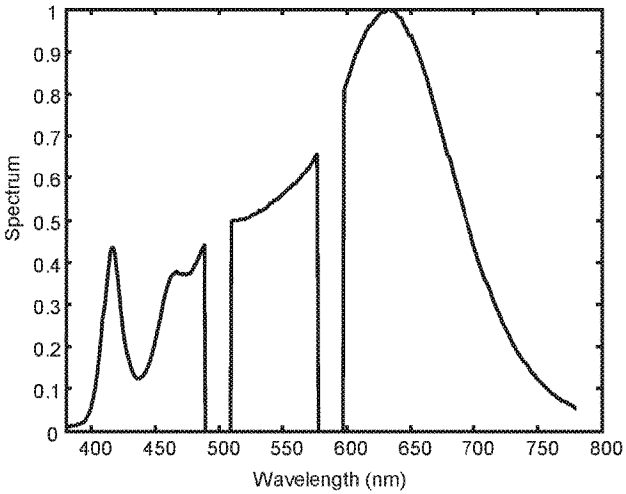
FIG. 50A is a chart showing the calculated SPD of an LED lamp having an increased gamut, according to some embodiments.

FIG. 50A is a chart showing the calculated SPD of an LED lamp having an increased gamut.

FIG. 50B is a chart showing the CIELAB color space and the position of various colored objects illuminated by a reference source forming a reference gamut and the spectrum of FIG. 39 forming an increased gamut for comparison.

FIG. 50C is a chart showing the CIELUV (u'v') color space and the chromacities of a reference illuminant.

It is possible to design the spectrum so that it combines increased gamut properties and a desired shift of the white point. FIG. 50A exemplifies such a source. The spectrum resembles an LED spectrum with additional dips. The gamut is increased (e.g., increased gamut 5002). In addition, the white point 5003 of the source is shown in the 1964 CIE (u'v') color space. It is located below the blackbody locus 5004. Also indicated is the white point of a blackbody radiator with the same CCT (3000K).

In addition to these various optimizations, the presence of violet light in the spectrum can be used to improve the quality of light. This can be done to improve the rendering of objects containing OBAs such as many manufactured white products. For instance, the amount of violet in the spectrum may be tuned to excite OBAs with enough intensity to reproduce the whiteness rendering of another source.

In other cases however, the presence of violet (or even ultra-violet) light is deleterious and should be avoided. This may be the case, for instance, in museums where the conservation of fragile works of art is contingent upon minimizing the amount of short-wavelength light. It is already known that in museums employing incandescent and halogen lamps, the use of ultra-violet cutting filters is important to preserve art. However, it is not trivial to remove short-wavelength radiation. If too much violet or blue light is taken out, chromaticity and CCT of the source is undesirably modified. Rather, care must be taken when designing the filter so that removing short-wavelength radiation is not done at the expense of quality of light.

Some embodiments of this disclosure achieve this as follows:

- The spectrum of the light is modified to contain a minimal amount of short-wavelength light. This is achieved by a filter which cuts any light below a given wavelength (for instance 430 nm).
- The filter further rebalances the spectrum at wavelengths above 430 nm so that it retains desired properties (such as CCT, chromaticity, Ra, R9).

Figure 51:
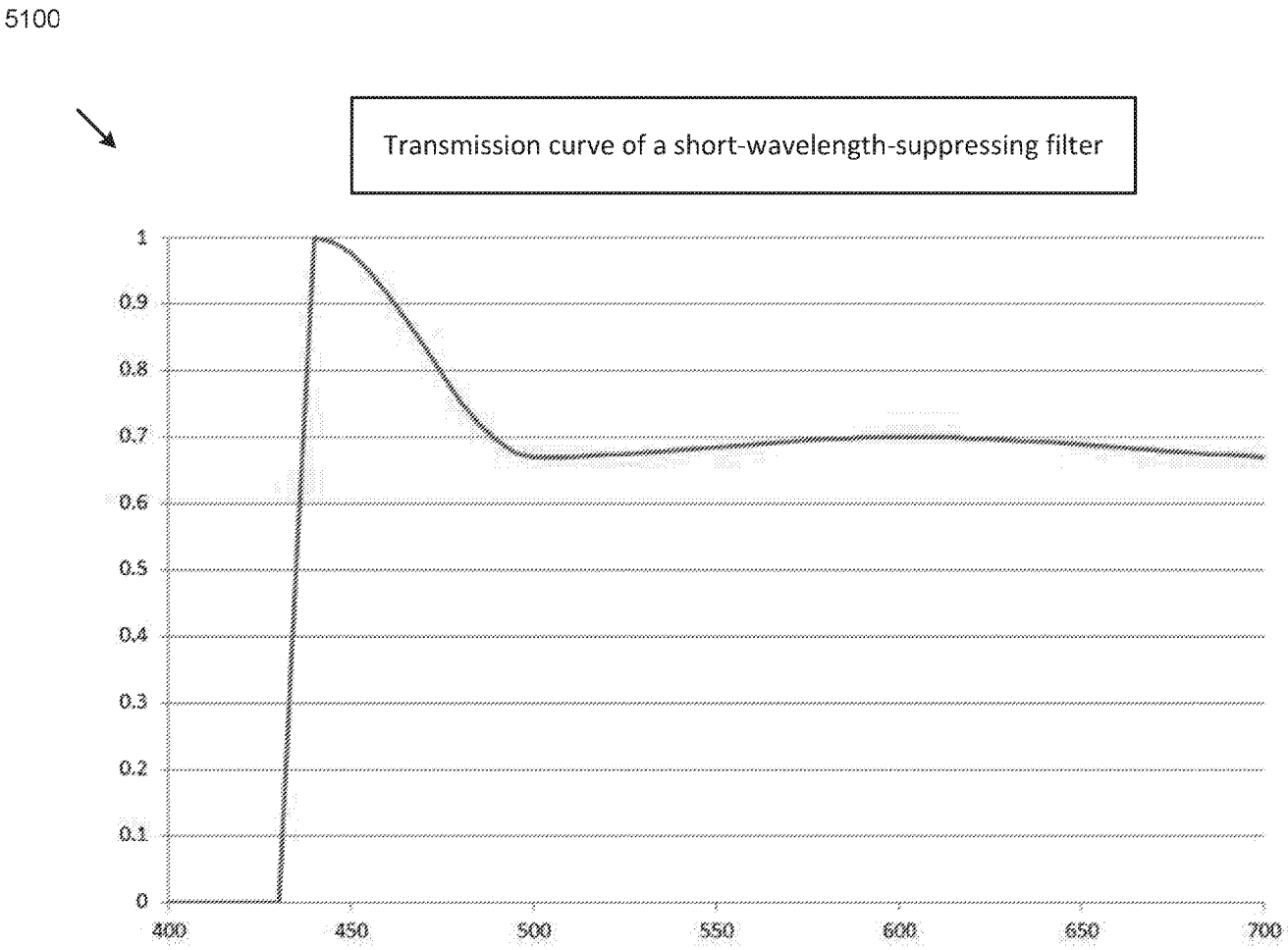
FIG. 51 shows the transmission of a short-wavelength suppressing filter, according to an embodiment.

FIG. 51 shows the transmission curve of a short-wavelength suppressing filter, according to an embodiment of the disclosure.

The filter of FIG. 51 can be used, for instance, as an accessory on an LED lamp. In one configuration, a filter exhibiting the transmission characteristics of FIG. 51 removes radiation below 430 nm, which reduces the amount of damage caused to sensitive materials such as some works of art. It also reshapes the spectrum above 430 nm, such that the CCT, chromaticity, and values of Ra and R9 are maintained.

Further, suppression of short-wavelength light can be combined with the gamut-enhancing effects discussed above. This results in a filter which removes short-wavelength radiation while also increasing the gamut of the spectrum. This can be desirable for a variety of applications.

For instance, some objects in museums have faded colors due to aging. In this case, use of a gamut-enhancing light source can restore the colors. In some embodiments of the invention, the filter is designed specifically to enhance the vividness of a given color (such as red, blue, or other) and make it visually more pleasant.

Another case is that of a low level of illumination. When light levels are low—for instance, about 10 lux—our ability to perceive colors diminishes (due to the partial scotopic contribution to our visual signal). Thus in museums where low light levels are maintained to ensure art conservation, this has the adverse effect of diminishing color saturation and making objects appear dull. To counter this effect, embodiments of the invention can be employed to increase color saturation in low-light conditions.

Similar to the removal of short-wavelength light, other embodiments of the invention provide suppression of another spectral band while maintaining the quality of light. For instance, consider a situation where one may desire to remove cyan light from the spectrum (this could be due to some health concern, for instance). A simple filter which blocks cyan light with no other effect will result in a CCT and chromaticity shift, and in a modification of the source's CRI. On the other hand, embodiments of the invention provide a block in the cyan spectral range, and further reshape the spectrum outside this range so that CCT, chromaticity or CRI can be maintained.

In addition, in some cases the spectrum may be tuned for optimal interaction with another device such as a photo or video camera. Such image capture devices use light sensors with color filters (typically red, green and blue) in order to capture color information. The filters can have cross-talk, e.g., the transmission window of two filters may overlap. Using a light source which possesses spectral gaps in the overlap regions can help subsequent treatment of the data to reproduce the images in the scene. This may be used in conjunction with software which takes the source spectrum into account in order to accurately reproduce colors.

As a consequence, it is desirable to configure an LED-based lamp which is useful for general illumination purposes and which improves on the quality-of-light limitations described above.

As discussed herein, this can in general be achieved by adding or removing light from a reference spectrum. Specifically, in the context of the invention, absorbing or reflecting filters can be formed on embodiments of the invention. The spectrum of a lamp, filtered by such a filter, then emanates improved quality of light. The lamp whose spectrum is modified may be a general-purpose lamp, or it may be a lamp whose spectrum has already been optimized to operate in conjunction with an embodiment of the invention (for instance, an LED lamp with a properly chosen phosphor set which interacts properly with a specific filter). The filter can be of various constructions, for instance a filter can comprise a dielectric stack with particular transmission characteristics, and/or a color gel, and/or an absorbing material (such as an absorbing glass), etc.

Further examples of certain embodiments are provided as follows:

Embodiment 1

An apparatus comprising:

an LED lamp (e.g., including spot lamps and non-spot lamps, including candelabras);

an optical element (e.g., a lens or diffuser), the optical element mechanically affixed to the LED lamp, such that an initial light pattern is emanated out of the lamp;

a first fixture mechanically attached to the optical element;

a first accessory comprising a second fixture, wherein the first accessory is mated in proximity to the optical element using the first fixture and the second fixture; and wherein the first accessory is configured to modulate the initial light pattern into a modified light pattern.

Embodiment 2

The apparatus of embodiment 1, wherein the first accessory is configured such that the modified light pattern has a Color Quality Scale gamut metric Qg of 1.05 or higher.

Embodiment 3

The apparatus of embodiment 1, wherein the first accessory is configured such that the modified light pattern has a Color Quality Scale gamut metric Qg in the range 1.10 to 1.40 and a Color Quality Scale fidelity metric Qf of 60 or higher.

Embodiment 4

The apparatus of embodiment 1, wherein the first accessory is configured such that the initial light pattern and the modified light pattern have Color Quality Scale gamut metrics Qg, and the Qg of the modified light pattern is at least 5% larger than the Qg of the initial light pattern.

Embodiment 5

The apparatus of embodiment 1, wherein the first accessory is configured to substantially increase a visual saturation of warm colors such as red, orange and pink objects, versus a conventional lamp with same correlated color temperature.

Embodiment 6

The apparatus of embodiment 1, wherein the first accessory is configured such that the modified light pattern modifies a saturation of at least one of the following Color Quality Scale samples: VS1 (red), VS2 (red-orange), VS3 (orange), VS14 (red-pink), VS15 (pink); the saturation being increased by at least 5% versus a conventional lamp with a same correlated color temperature.

Embodiment 7

The apparatus of embodiment 1, wherein the first accessory is configured such that the modified light pattern renders various Caucasian skins with a color distortion which is substantially along the CIELAB b* direction, with an increase in b* of at least 1 point.

Embodiment 8

The apparatus of embodiment 1, wherein the first accessory is configured such that the modified light pattern has a chromaticity lying below the Planckian locus by a distance of at least 3 Du'v' points.

Embodiment 9

The apparatus of embodiment 1, wherein the first accessory is configured to substantially suppress light at wavelengths below 430 nm in the modified light pattern.

Embodiment 10

The apparatus of embodiment 9, wherein the first accessory is further configured such that the initial and final light patterns have substantially similar chromaticities.

Embodiment 11

The apparatus of embodiment 9, wherein the first accessory is further configured such that a color rendering index of the final light pattern is at least as high as a color rendering index of the initial light pattern.

Embodiment 12

The apparatus of embodiment 9, wherein the first accessory is further configured such that a color rendering index of the modified light pattern is at least 90.

Embodiment 13

The apparatus of embodiment 9, wherein the first accessory is further configured such that the modified light pattern has a Color Quality Scale gamut metric Qg of 1.05 or higher.

Embodiment 14

The apparatus of embodiment 1, wherein the first accessory is configured to render common OBA-containing white objects such that their color is substantially similar to that under a natural light source of a same correlated color temperature.

Still further embodiments can be envisioned to one of ordinary skill in the art after reading this disclosure. In other embodiments, combinations or sub-combinations of this disclosure can be advantageously made. The block diagrams of the architecture and flow charts are grouped for ease of understanding. However it should be understood that combinations of blocks, additions of new blocks, rearrangement of blocks, and the like are contemplated in alternative embodiments of the present disclosure, such as, for example the lamp application configurations of the following figures.

FIG. 52A through FIG. 52I depict embodiments of the present disclosure in the form of lamp applications. In these lamp applications, one or more light emitting diodes are used in lamps and fixtures. Such lamps and fixtures include replacement and/or retro-fit directional lighting fixtures.

Figure 52A:
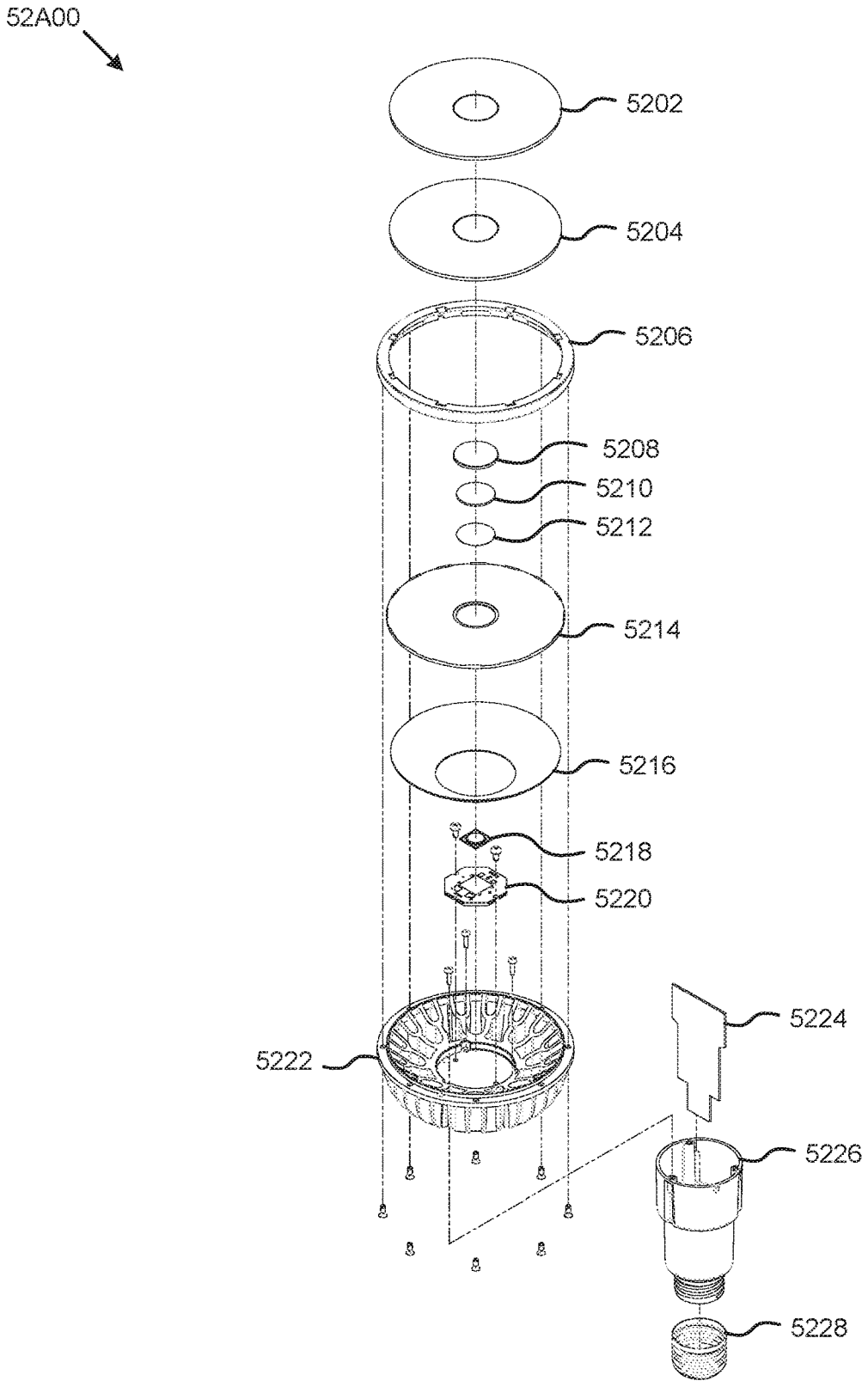
FIG. 52A, FIG. 52B, FIG. 52C, FIG. 52D, FIG. 52E, FIG. 52F, FIG. 52G.

In some embodiments, aspects of the present disclosure can be used in an assembly. As shown in FIG. 52A, the assembly comprises:

a screw cap 5228
a driver housing 5226
a driver board 5224
a heatsink 5222
a metal-core printed circuit board 5220
an LED lightsource 5218
a dust shield 5216
a lens 5214
a reflector disc 5212
a magnet 5210
a magnet cap 5208 a trim ring 5206 a first accessory 5204 a second accessory 5202

The components of assembly 52A00 may be described in substantial detail. Some components are 'active components' and some are 'passive' components, and can be variously-described based on the particular component's impact to the overall design, and/or impact(s) to the objective optimization function. A component can be described using a CAD/CAM drawing or model, and the CAD/CAM model can be analyzed so as to extract figures of merit as may pertain to e particular component's impact to the overall design, and/or impact(s) to the objective optimization function. Strictly as one example, a CAD/CAM model of a trim ring is provided in a model corresponding to the drawing of FIG. 52A2.

Figure 52B:
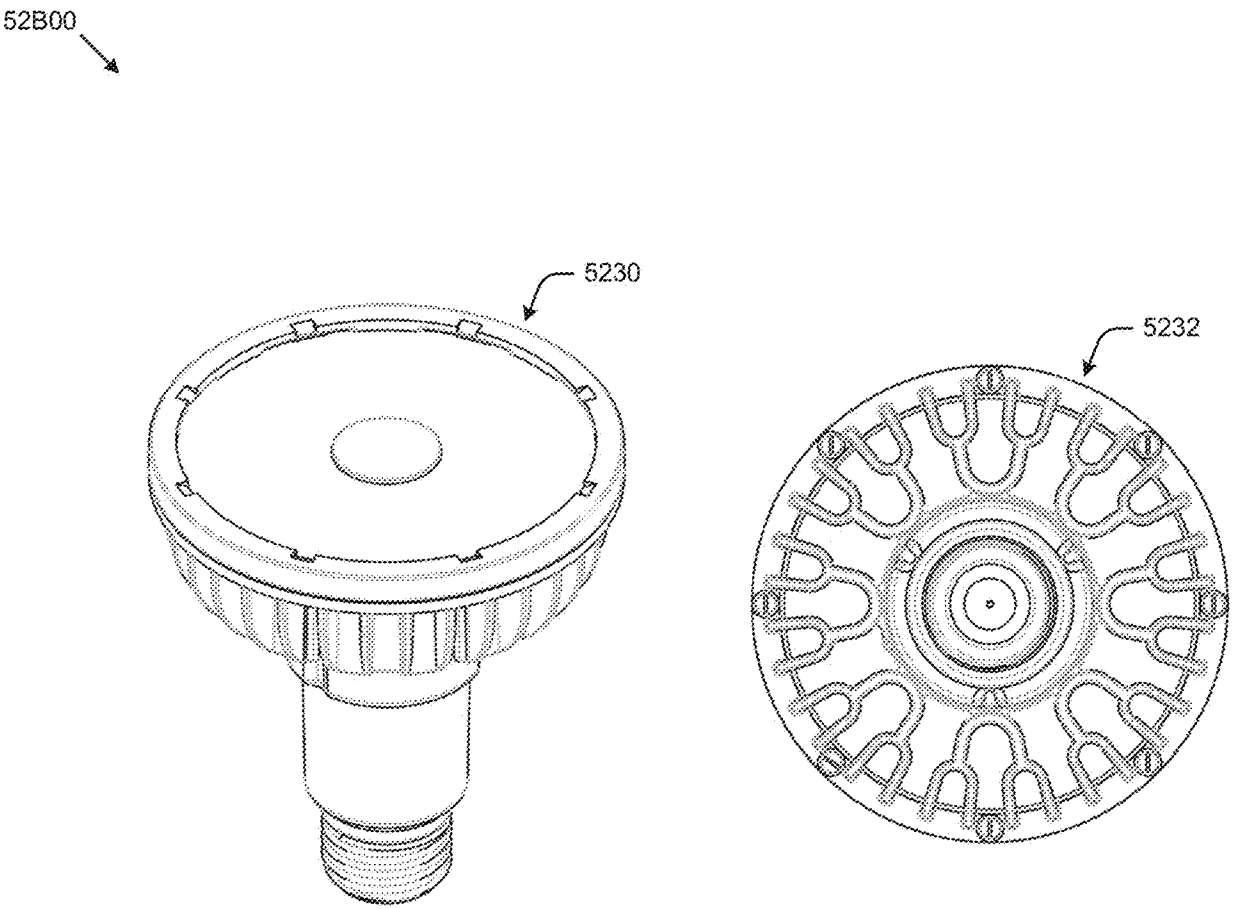
Figure 52C:
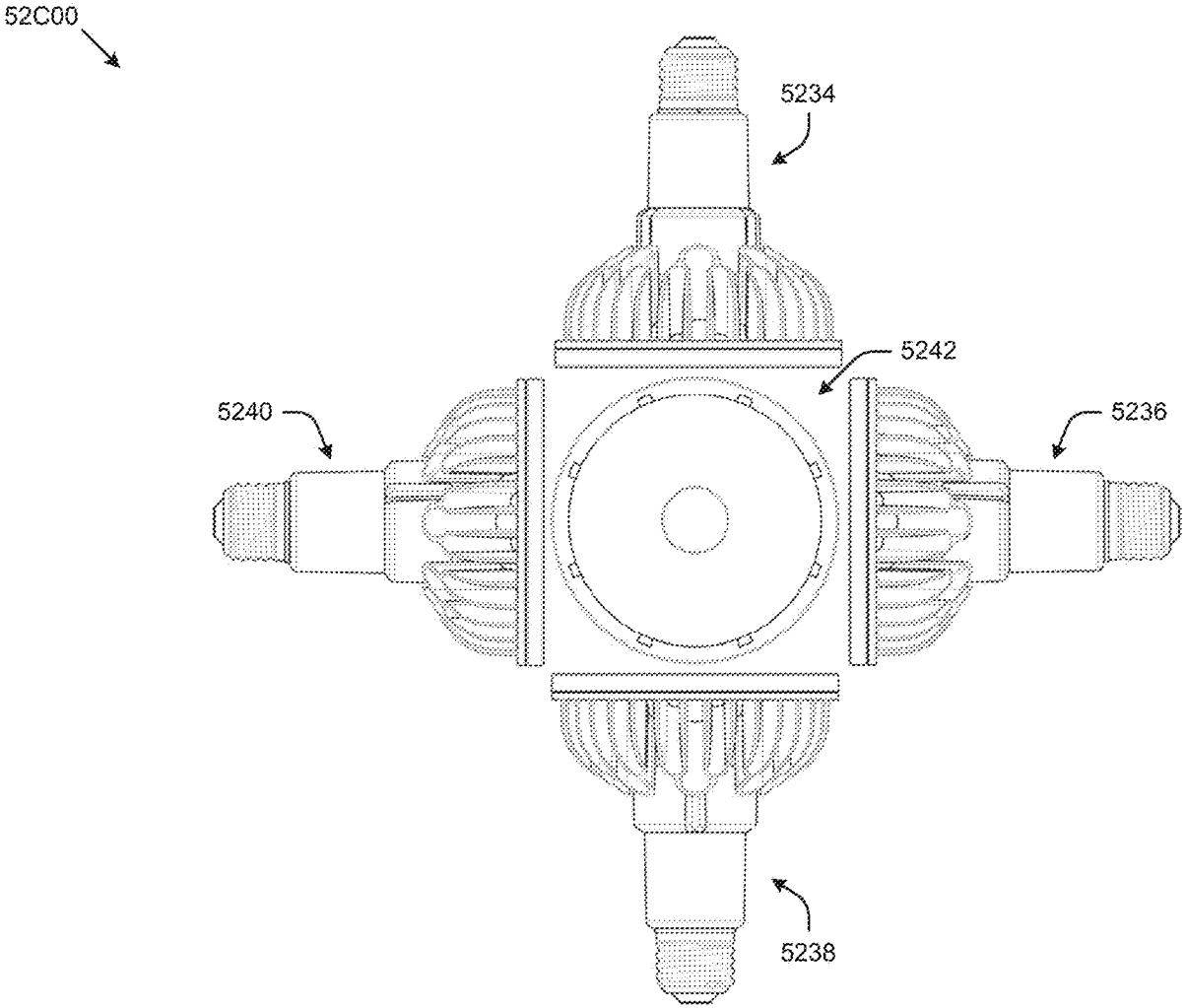

The components of the assembly 52A00 can be fitted together to form a lamp. FIG. 52B depicts a perspective view 5230 and top view 5232 of such a lamp. As shown in FIG. 52B, the lamp 52B00 comports to a form factor known as PAR30L. The PAR30L form factor is further depicted by the principal views (e.g., left 5240, right 5236, back 5234, front 5238 and top 5242) given in array 52C00 of FIG. 52C.

Figure 52D:
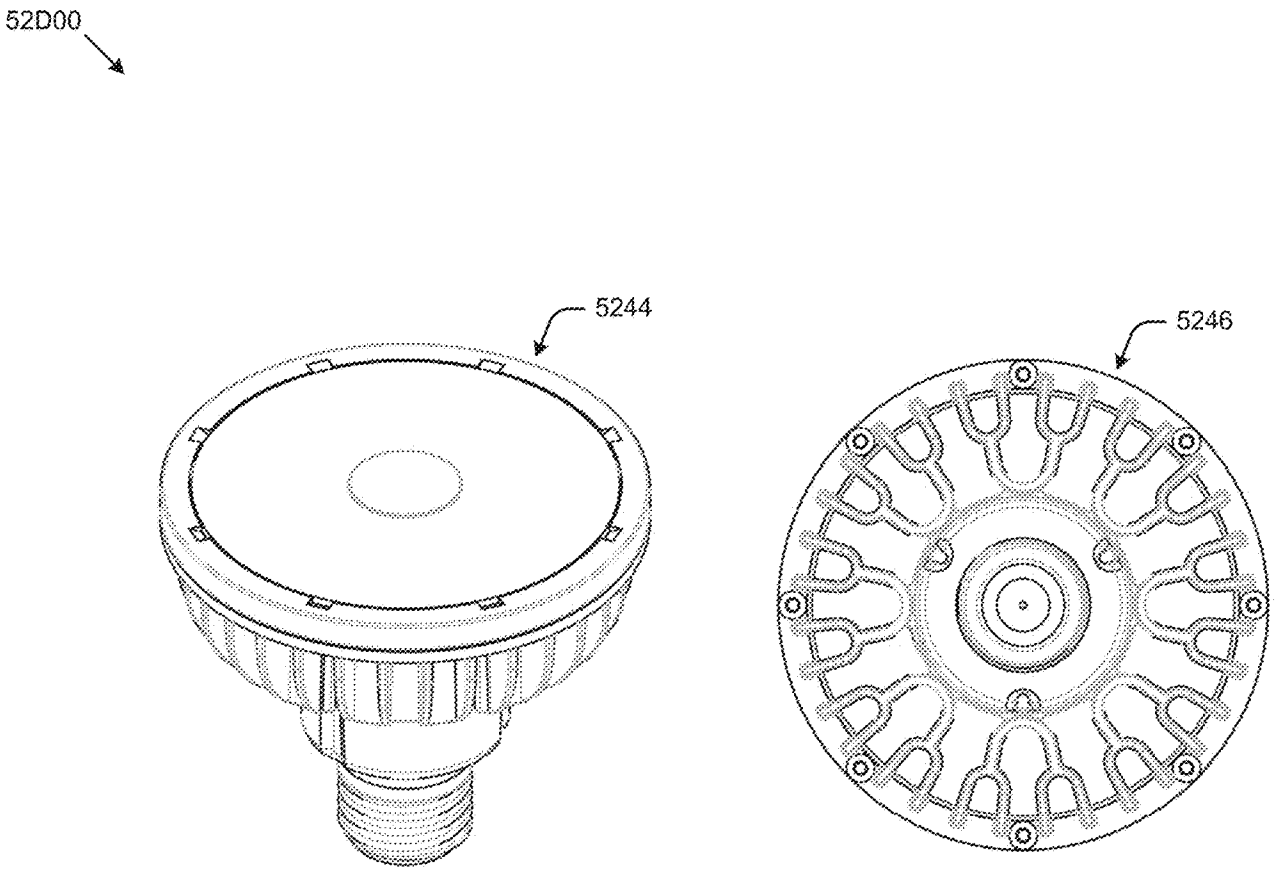
Figure 52E:
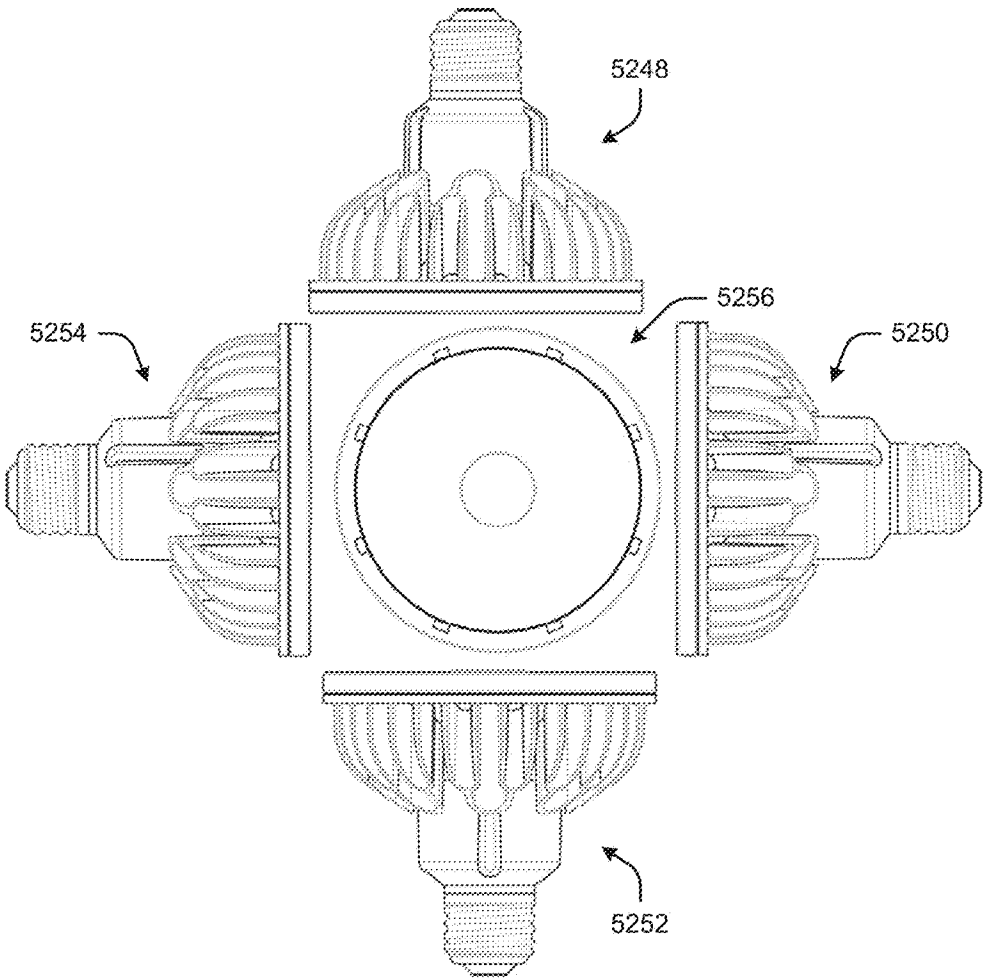

The components of the assembly 52A00 can be fitted together to form a lamp. FIG. 52D depicts a perspective view 5244 and top view 5246 of such a lamp. As shown in FIG. 52D, the lamp 52D00 comports to a form factor known as PAR30S. The PAR30S form factor is further depicted by the principal views (e.g., left 5254, right 5250, back 5248, front 5252 and top 5256) given in array 52E00 of FIG. 52E.

Figure 52F:
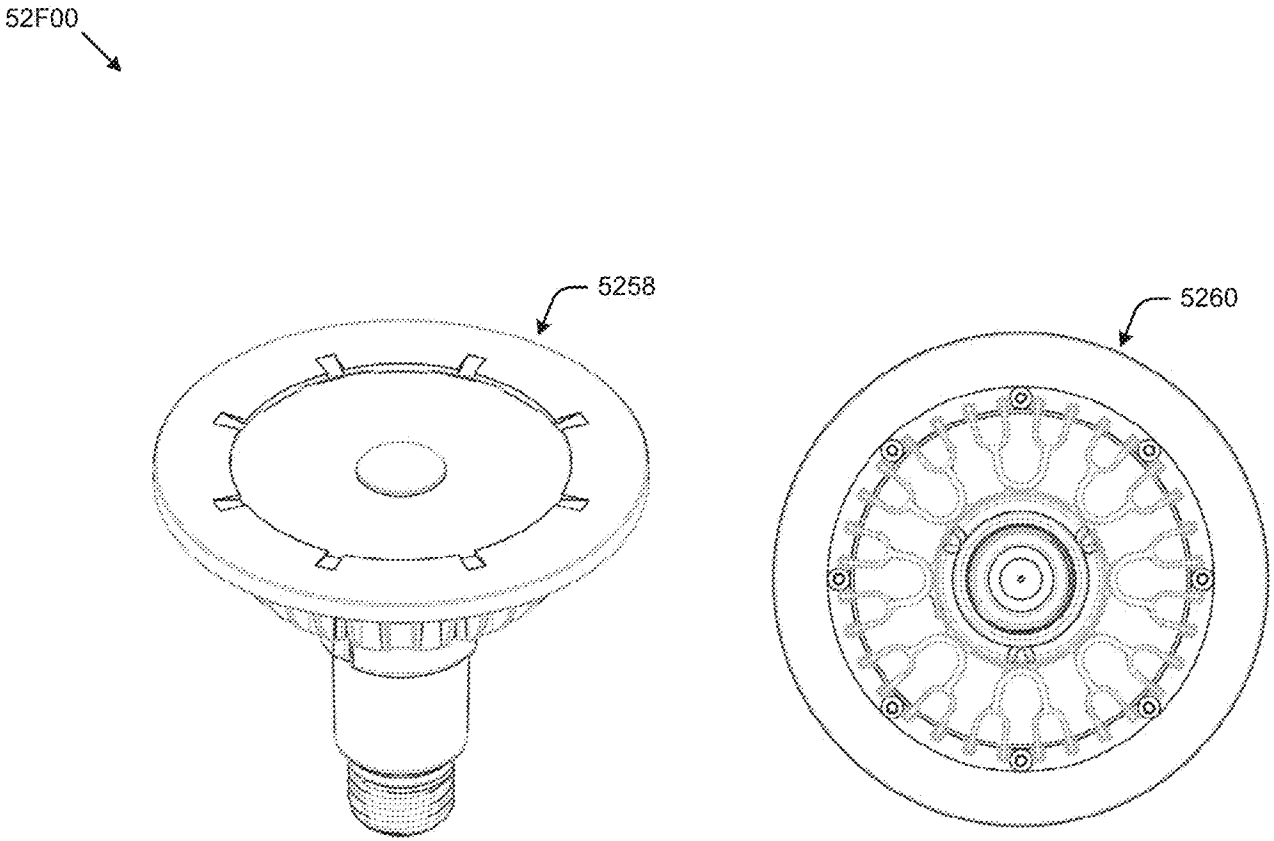
Figure 52G:
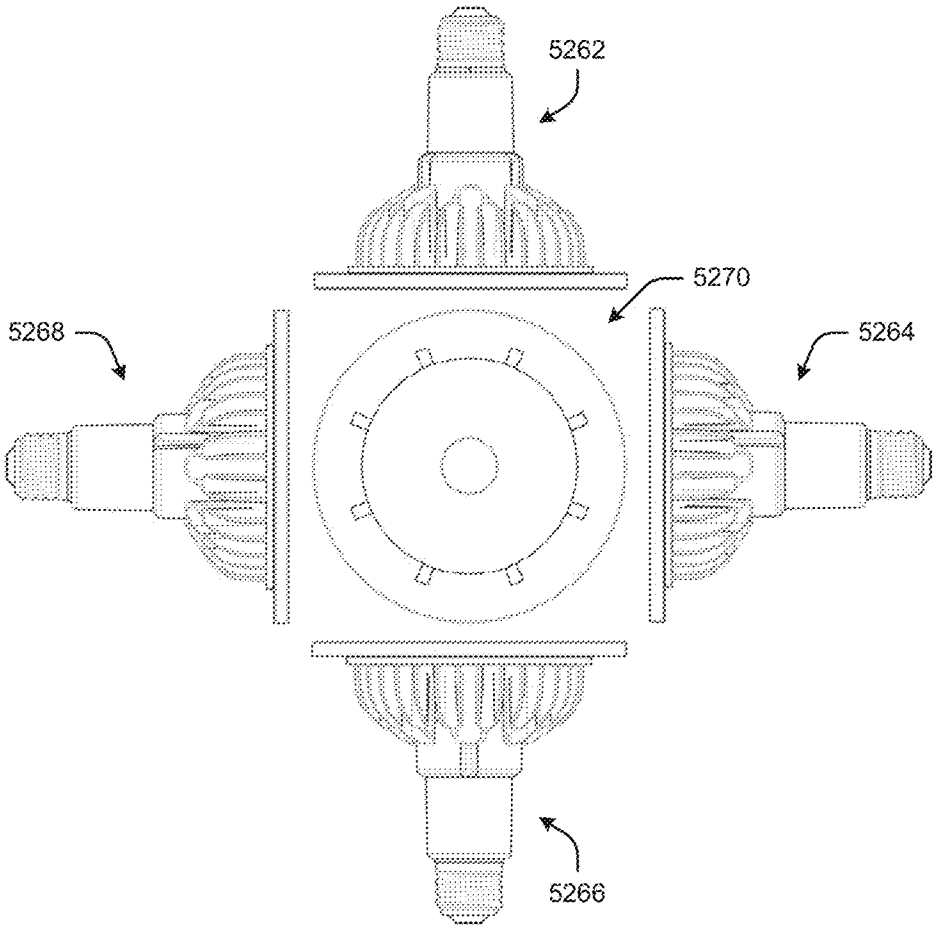

The components of the assembly 52A00 can be fitted together to form a lamp. FIG. 52F depicts a perspective view 5258 and top view 5260 of such a lamp. As shown in FIG. 52F, the lamp 52F00 comports to a form factor known as PAR38. The PAR38 form factor is further depicted by the principal views (e.g., left 5268, right 5264, back 5262, front 5266 and top 5270) given in array 52G00 of FIG. 52G.

Figure 52H:
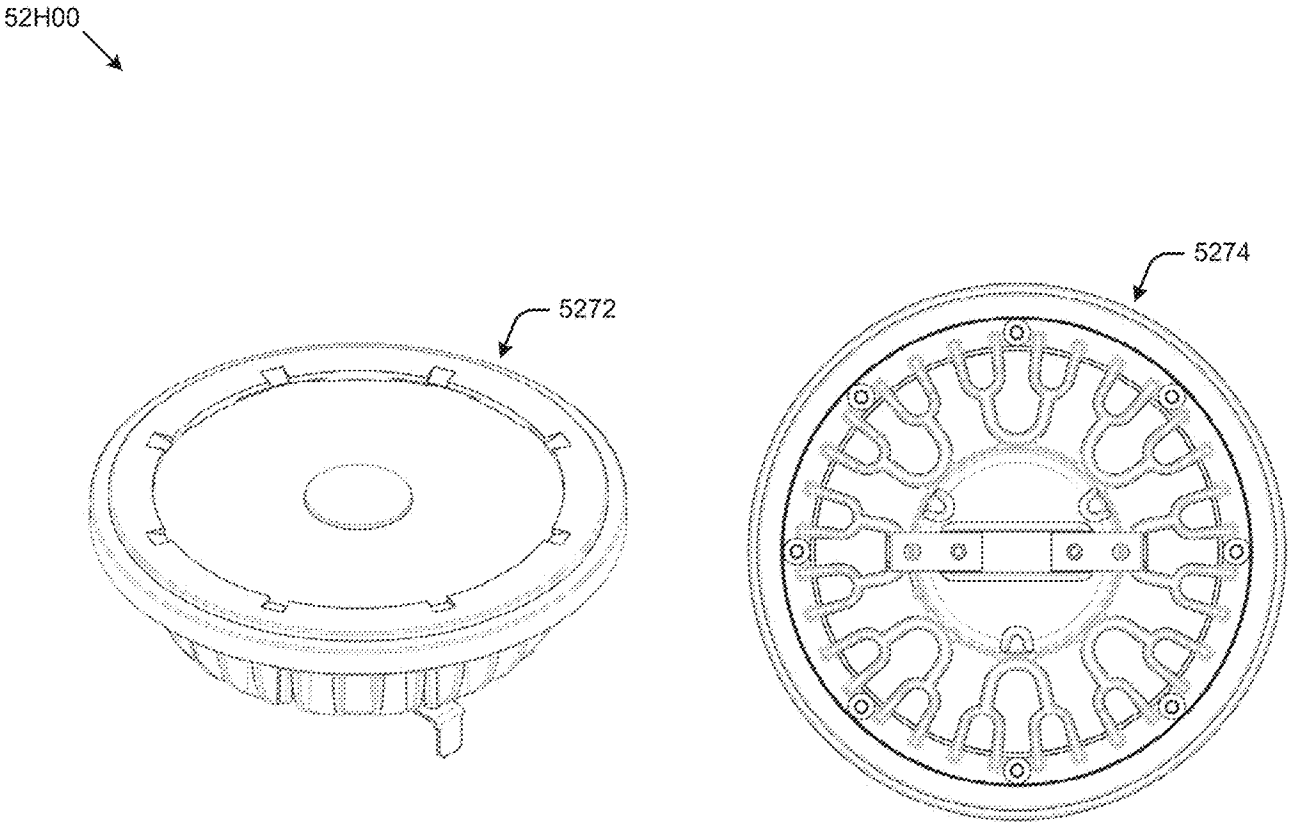
FIG. 52H, and FIG. 52I depict selected embodiments of the present disclosure in the form of lamp applications configured suited to be used in conjunction with the accessories disclosed herein.
Figure 52I:
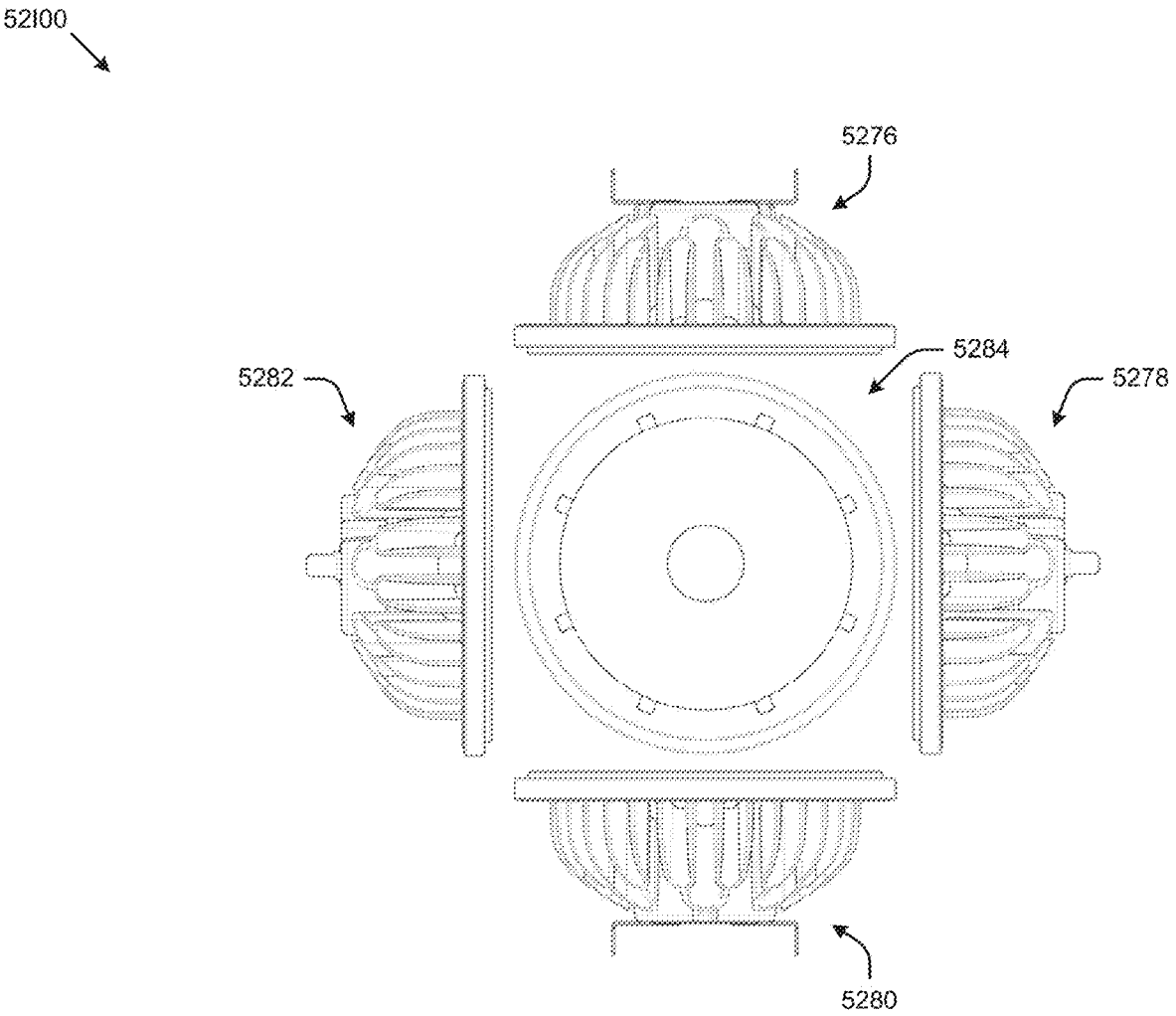

The components of the assembly 52A00 can be fitted together to form a lamp. FIG. 52H depicts a perspective view 5272 and top view 5274 of such a lamp. As shown in FIG. 52H, the lamp 52H00 comports to a form factor known as PAR111. The PAR111 form factor is further depicted by the principal views (e.g., left 5282, right 5278, back 5276, front 5280 and top 5284) given in array 52I00 of FIG. 52I.

The specification and drawings are, accordingly, to be regarded in an illustrative rather than a restrictive sense. It will, however, be evident that various modifications and changes may be made thereunto without departing from the broader spirit and scope.

The examples describe constituent elements of the herein-disclosed embodiments. It will be apparent to those skilled in the art that many modifications, both to materials and methods, may be practiced without departing from the scope of the disclosure. And, it should be noted that there are alternative ways of implementing the embodiments disclosed herein. Accordingly, the present embodiments are to be considered as illustrative and not restrictive, and the claims are not to be limited to the details given herein, but may be modified within the scope and equivalents thereof.

What is claimed is:

1. An accessory for an LED lamp having a housing, a connector, and an electronic component, comprising:

at least one electronic element, said at least one electronic element being configured to facilitate communication to at least another lamp, and being configured for wireless communication with a remote controller; and a mounting member configured to be releasably coupled to said a connector within said a housing of said LED lamp and electrically couple said at least one electronic element with said an electronic component of said LED lamp, wherein said electronic component is at least one of a microprocessor, readable storage, power supply, and power conditioning circuitry.

2. The accessory of claim 1, wherein said at least one electronic element is a sensor.

3. The accessory of claim 2, Wherein said sensor is one of a motion sensor, occupancy sensor and a light sensor.

4. The accessory of claim 1, wherein said at least one electronic element is a camera.

5. The accessory of claim 1, wherein said at least one electronic element is a microprocessor.

6. The accessory of claim 1, wherein said at least one electronic element is a networking module.

7. The accessory of claim 6, wherein said networking module is configured for wireless communication.

8. The accessory of claim 1, where said at least one electronic element comprises readable storage configured to store operational data of said LED lamp.

9. The accessory of claim 1, wherein said accessory is a slave device or a master device.

10. The accessory of claim 1, wherein said mounting member comprises a magnet.

11. The accessory of claim 1, wherein said accessory is a USB device.

12. The accessory of claim 1, wherein said electronic component is at least one of a microprocessor, readable storage, power supply, and power conditioning circuitry.

13. The accessory of claim 1, wherein said at least one electronic element is configured to facilitate communication to at least another lamp or a central computer for lamp monitoring and control.

14. The accessory of claim 1, wherein said at least one electronic element is configured to communicate with an electronic element of an accessory of a second LED lamp.

15. The accessory of claim 1, wherein said mounting member is removably coupled to said connector.

16. The accessory of claim 1, wherein said at least one electronic element receives power from said electronic component.

17. The accessory of claim 1, wherein said connector is within a lens of said LED lamp.

18. The accessory of claim 1, wherein said at least one electrical element comprises a first electrical element and a second electrical element.

19. The accessory of claim 18, wherein said first electrical element and said second electrical element are each one of a sensor, camera, microprocessor, networking module and a readable memory.

* * * * *